US009903558B2

(12) United States Patent
Hoshino

(10) Patent No.: US 9,903,558 B2
(45) Date of Patent: Feb. 27, 2018

(54) VEHICLE LIGHTING FIXTURE

(71) Applicant: Stanley Electric Co., Ltd., Tokyo (JP)

(72) Inventor: Shinya Hoshino, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 13 days.

(21) Appl. No.: 15/158,379

(22) Filed: May 18, 2016

(65) Prior Publication Data

US 2016/0341389 A1 Nov. 24, 2016

(30) Foreign Application Priority Data

May 19, 2015 (JP) ..... 2015-101793

(51) Int. Cl.
*F21V 17/02* (2006.01)
*F21S 8/10* (2006.01)
*F21Y 101/02* (2006.01)

(52) U.S. Cl.
CPC ..... *F21S 48/1757* (2013.01); *F21S 48/1145* (2013.01); *F21S 48/1225* (2013.01); *F21S 48/14* (2013.01); *F21S 48/17* (2013.01); *F21S 48/328* (2013.01); *F21Y 2101/02* (2013.01); *F21Y 2101/025* (2013.01)

(58) Field of Classification Search
CPC combination set(s) only.
See application file for complete search history.

(56) References Cited

U.S. PATENT DOCUMENTS

2006/0285078 A1 12/2006 Kasazumi et al.
2007/0159312 A1* 7/2007 Chen ..... B60Q 9/005 340/435
2007/0177250 A1 8/2007 Duncan
(Continued)

FOREIGN PATENT DOCUMENTS

EP 2 581 648 A1 4/2013
JP 2008-40240 A 5/2008
(Continued)

OTHER PUBLICATIONS

Extended European search report for the related European Patent Application No. 16170269.1 dated Oct. 19, 2016.

*Primary Examiner* — Tuyen K Vo
(74) *Attorney, Agent, or Firm* — Kenealy Vaidya LLP

(57) ABSTRACT

A vehicle lighting fixture can be configured to form a predetermined light distribution pattern by two-dimensionally scanning light with resolutions different in part, for example, in which the resolution in the horizontal direction is high at the center area and is gradually lowered toward the outer periphery from the center area. The vehicle lighting unit can include an optical deflector configured to two-dimensionally scan with groups of spots of light having been incident thereon from a light source; a screen member in which the light scanning by the optical deflector forms a luminance distribution corresponding to a predetermined light distribution pattern; an optical system configured to project the luminance distribution forward; and an optical controlling member configured to change a pitch between spots in a group of spots among the groups of spots of light scanned by the optical deflector on the screen member.

9 Claims, 53 Drawing Sheets

(56) References Cited

U.S. PATENT DOCUMENTS

| | | | | |
|---|---|---|---|---|
| 2010/0146175 | A1* | 6/2010 | Choe | G09G 3/2096 710/110 |
| 2011/0128602 | A1* | 6/2011 | Hamano | G02B 13/0005 359/205.1 |
| 2011/0249460 | A1 | 10/2011 | Kushimoto | |
| 2012/0243065 | A1* | 9/2012 | Koyama | F21S 48/1145 359/199.4 |
| 2012/0262680 | A1 | 10/2012 | Hudman | |
| 2012/0300276 | A1 | 11/2012 | Ohnishi | |
| 2013/0063754 | A1* | 3/2013 | Saisho | G02B 26/0858 358/1.13 |
| 2013/0242365 | A1* | 9/2013 | Koyanagi | G02B 27/48 359/207.9 |
| 2014/0168940 | A1 | 6/2014 | Shiomi et al. | |
| 2014/0293237 | A1 | 10/2014 | Nakao | |
| 2015/0124468 | A1 | 5/2015 | Reiners | |
| 2015/0175054 | A1 | 6/2015 | Yatsuda et al. | |
| 2016/0018075 | A1 | 1/2016 | Ohno | |
| 2016/0109074 | A1 | 4/2016 | Hirasawa | |

FOREIGN PATENT DOCUMENTS

| | | | |
|---|---|---|---|
| JP | 2011-222238 | A | 11/2011 |
| JP | 2013-16277 | A | 1/2013 |
| JP | 2013-526759 | A | 6/2013 |
| JP | 2014-149975 | A | 8/2014 |
| JP | 2015-43346 | A | 3/2015 |
| WO | 2011/141377 | A1 | 11/2011 |

* cited by examiner

FIG. 29

| (a) | Projection Angle ($\alpha$h) | Scanning Range on Wavelength Conversion Member (L) | Deflection Angle of Mirror ($\beta$ h_max) | Mechanical Swing Half Angle of Mirror ($\gamma$ h_max) | Load Voltage |
|---|---|---|---|---|---|
| WIDE | ±15 deg. | ±8.57 mm | ±19.7 deg. | ±9.8 deg. | 5.41 Vpp |
| MID | ±8.5 deg. | ±4.78 mm | ±11.3 deg. | ±5.3 deg. | 2.31 Vpp |
| HOT | ±3.5 deg. | ±1.96 mm | ±4.7 deg. | ±2.3 deg. | 0.93 Vpp |

| (b) | Projection Angle ($\alpha$v) | Scanning Range on Wavelength Conversion Member (S) | Deflection Angle of Mirror ($\beta$ v_max) | Mechanical Swing Half Angle of Mirror ($\gamma$ v_max) | Control Voltage |
|---|---|---|---|---|---|
| WIDE | ±6.5 deg. | ±3.65 mm | ±8.6 deg. | ±4.3 deg. | 41.2 Vpp |
| MID | ±3.5 deg. | ±1.96 mm | ±4.7 deg. | ±2.3 deg. | 24.4 Vpp |
| HOT | ±1.5 deg. | ±0.84 mm | ±2.0 deg. | ±1.0 deg. | 13.3 Vpp |

FIG. 32

| (a) | Projection Angle ($\alpha$h) | Scanning Range on Wavelength Conversion Member (L) | Deflection Angle of Mirror ($\beta$ h_max) | Mechanical Swing Half Angle of Mirror ($\gamma$ h_max) | Distance between Mirror and Wavelength Conversion Member |
|---|---|---|---|---|---|
| WIDE | ± 15 deg. | ± 8.57 mm | ± 19.7 deg. | ± 9.8 deg. | 24.0 mm |
| MID | ± 8.5 deg. | ± 4.78 mm | ± 19.7 deg. | ± 9.8 deg. | 13.4 mm |
| HOT | ± 3.5 deg. | ± 1.96 mm | ± 19.7 deg. | ± 9.8 deg. | 5.5 mm |

| (b) | Projection Angle ($\alpha$v) | Scanning Range on Wavelength Conversion Member (S) | Deflection Angle of Mirror ($\beta$ v_max) | Mechanical Swing Half Angle of Mirror ($\gamma$ v_max) | Distance between Mirror and Wavelength Conversion Member |
|---|---|---|---|---|---|
| WIDE | ± 6.5 deg. | ± 3.65 mm | ± 8.6 deg. | ± 4.3 deg. | 24.0 mm |
| MID | ± 3.6 deg. | ± 1.96 mm | ± 8.6 deg. | ± 4.3 deg. | 13.4 mm |
| HOT | ± 1.5 deg. | ± 0.84 mm | ± 8.6 deg. | ± 4.3 deg. | 5.5 mm |

FIG. 39
(a)
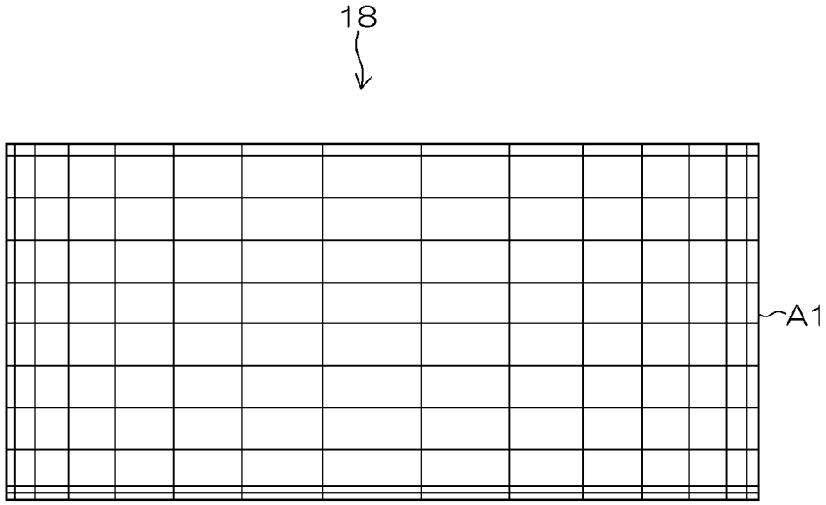
(b)
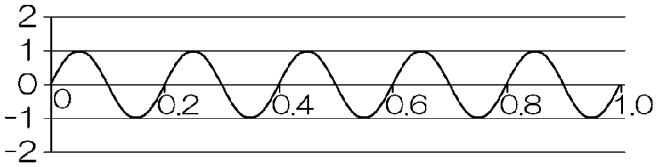
(c)
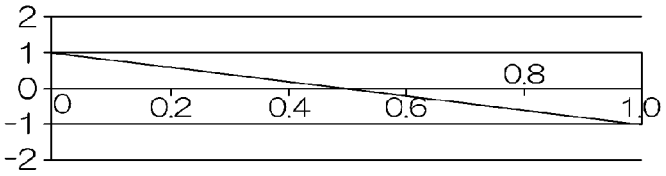

FIG. 41
(a)
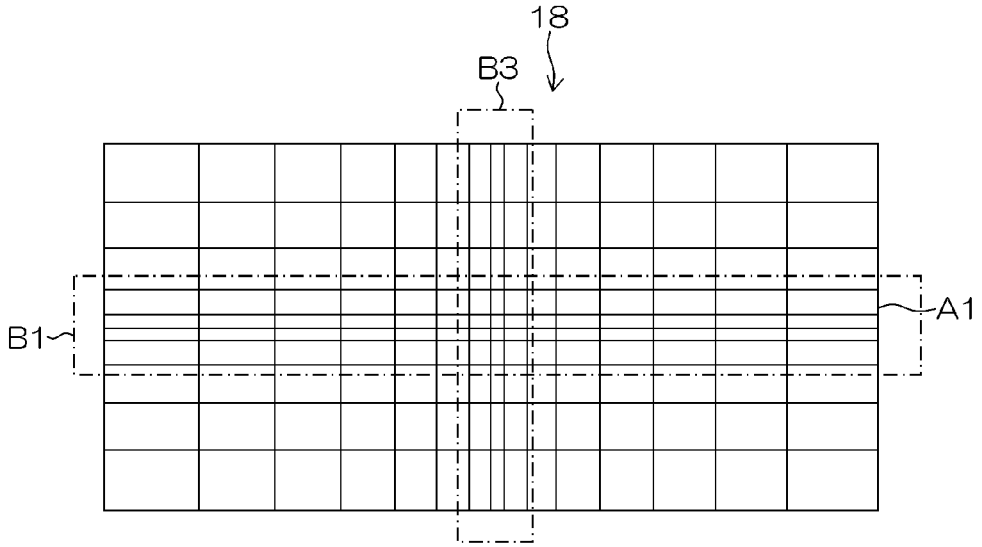
(b)
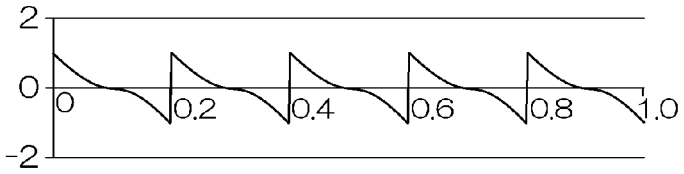
(c)
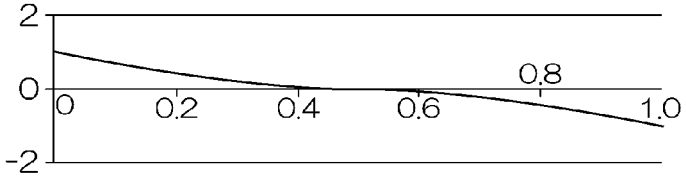

FIG. 42
(a)
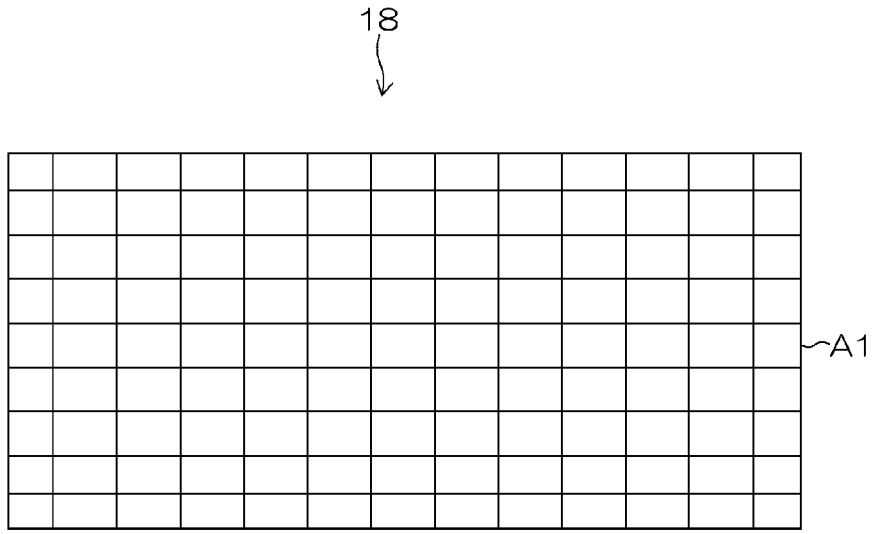
(b)
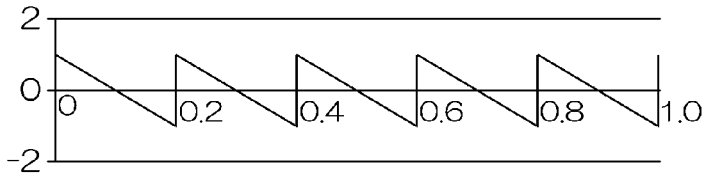
(c)
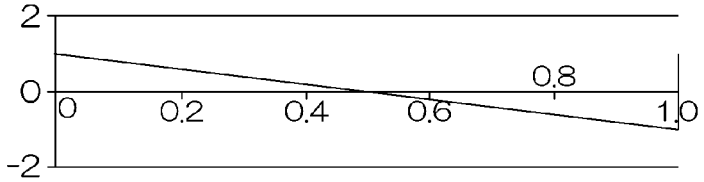

FIG. 43
(a)
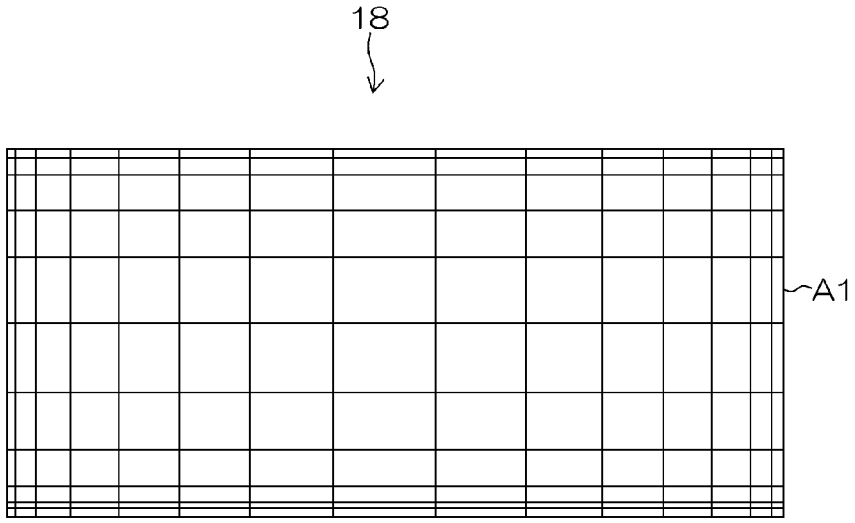
(b)
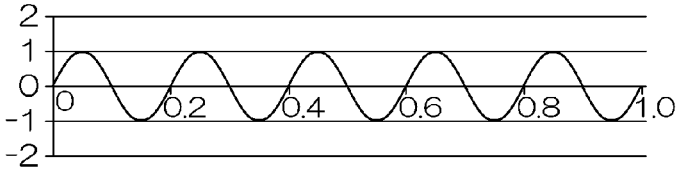
(c)
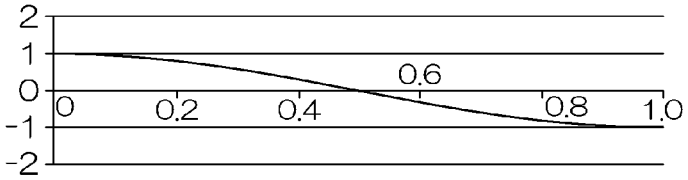

VEHICLE LIGHTING FIXTURE

This application claims the priority benefit under 35 U.S.C. § 119 of Japanese Patent Application No. 2015-101793 filed on May 19, 2015, which is hereby incorporated in its entirety by reference.

TECHNICAL FIELD

The presently disclosed subject matter relates to vehicle lighting fixtures, and in particular, to a vehicle lighting fixture configured to two-dimensionally scan with light to form a predetermined light distribution pattern.

BACKGROUND ART

FIG. 1 is a schematic diagram illustrating a conventional vehicle lighting fixture 800.

As illustrated in FIG. 1, the conventional vehicle lighting fixture 800 can include laser light sources 812, condenser lenses 814, optical deflectors (MEMS mirrors) 816, a wavelength conversion member (phosphor panel) 818, and a projector lens 820. Laser light emitted from the laser light sources 812 can be two-dimensionally scanned by the respective optical deflectors 816. The two-dimensionally scanned laser light can form a luminance distribution on the wavelength conversion member 818. The formed luminance distribution can be projected by the projector lens 820 to thereby allow the vehicle lighting fixture 800 to form a predetermined light distribution pattern corresponding to the luminance distribution. This type of vehicle lighting fixture can include those proposed in Japanese Patent Application Laid-Open No. 2011-222238 (or US2011/0249460A1 corresponding thereto), for example.

This publication, however, is silent about the resolution as to which order the resolution of the predetermined light distribution pattern should be set to and how such a resolution can be achieved in the vehicle lighting fixture 800 when the light distribution pattern, in particular including an unirradiation region(s), is formed by two-dimensionally scanning with light.

SUMMARY

The presently disclosed subject matter was devised in view of these and other problems and features in association with the conventional art. According to an aspect of the presently disclosed subject matter, a vehicle lighting fixture can be configured to form a predetermined light distribution pattern by two-dimensionally scanning with light, wherein the predetermined light distribution can be formed with resolutions different in part, for example, in which the resolution in the horizontal direction is high at the center area and is gradually lowered toward the outer periphery from the center area.

According to another aspect of the presently disclosed subject matter, a vehicle lighting fixture can be configured to form a predetermined light distribution pattern with groups of spots of light scanning in a two-dimensional manner and include an optical controlling member configured to change a pitch between spots in a group of spots among the groups of spots of light.

The vehicle lighting fixture with the above-mentioned configuration can form the predetermined light distribution pattern with resolutions different in part, for example, in which the resolution in the horizontal direction is high at the center area and is gradually lowered toward the outer periphery from the center area.

According to another aspect of the presently disclosed subject matter, the vehicle lighting fixture of the above-mentioned aspect can be configured such that the optical controlling member can change the pitch between spots such that the pitch becomes large as the light scanning in a two-dimensional manner is directed by a larger deflection angle.

The vehicle lighting fixture with the above-mentioned configuration can reliably form the predetermined light distribution pattern with resolutions in which the resolution in the horizontal direction is high at the center area and is gradually lowered toward the outer periphery from the center area.

According to still another aspect of the presently disclosed subject matter, a vehicle lighting fixture can be configured to include a light source; an optical deflector configured to two-dimensionally scan with groups of spots of light having been incident thereon from the light source; a screen member in which the light scanning by the optical deflector forms a luminance distribution corresponding to a predetermined light distribution pattern; an optical system configured to project the luminance distribution formed in the screen member forward of a vehicle body; and an optical controlling member configured to change a pitch between spots in a group of spots among the groups of spots of light scanning by the optical deflector on the screen member.

The vehicle lighting fixture with the above-mentioned configuration can form the luminance distribution with groups of spots of light scanning in a two-dimensional manner on the screen member and project the luminance distribution forward to form the predetermined light distribution pattern. In this case, the vehicle lighting fixture can form the luminance distribution and the predetermined light distribution pattern with resolutions different in part, for example, in which the resolution in the horizontal direction is high at the center area and is gradually lowered toward the outer periphery from the center area.

According to another aspect of the presently disclosed subject matter, the vehicle lighting fixture of the above-mentioned aspect can be configured such that the optical controlling member can change the pitch between spots on the screen member such that the pitch on the screen member becomes large as the light scanning in a two-dimensional manner is directed by a larger deflection angle.

The vehicle lighting fixture with the above-mentioned configuration can reliably form the predetermined light distribution pattern with resolutions in which the resolution in the horizontal direction is high at the center area and is gradually lowered toward the outer periphery from the center area.

According to another aspect of the presently disclosed subject matter, the vehicle lighting fixture of any of the above-mentioned aspects can be configured such that the optical controlling member can be a multifocal lens disposed between the optical deflector and the screen member and configured to allow the light scanning by the optical deflector to pass therethrough. Here, the screen member can be configured to form the luminance distribution with the light scanning with the optical deflector and passing through the multifocal lens. The multifocal lens can be configured to have lens portions having respective focal distances such that the focal distance is shorter at a lens portion of the multifocal lens where the light with a larger deflection angle passes.

The vehicle lighting fixture with the above-mentioned configuration can reliably form the luminance distribution (corresponding to the predetermined light distribution pattern) with resolutions in which the resolution in the horizontal direction is high at the center area and is gradually lowered toward the outer periphery from the center area.

In the vehicle lighting fixture with the above-mentioned configuration, the multifocal lens can be configured to have the lens portions having the respective focal distances such that the focal distance is shorter at a lens portion of the multifocal lens where the light with a larger deflection angle in a horizontal direction passes.

The vehicle lighting fixture with the above-mentioned configuration can reliably form the luminance distribution (corresponding to the predetermined light distribution pattern) with resolutions in which the resolution in the horizontal direction is high at the center area and is gradually lowered toward the outer periphery from the center area.

Furthermore, in the vehicle lighting fixture with the above-mentioned configuration, the multifocal lens can be configured to have the lens portions having the respective focal distances such that the focal distance is shorter at a lens portion of the multifocal lens where the light with a larger deflection angle in a vertical direction passes.

The vehicle lighting fixture with the above-mentioned configuration can reliably form the luminance distribution (corresponding to the predetermined light distribution pattern) with resolutions in which the resolution in the vertical direction is high at the center area and is gradually lowered toward the outer periphery from the center area.

BRIEF DESCRIPTION OF DRAWINGS

These and other characteristics, features, and advantages of the presently disclosed subject matter will become clear from the following description with reference to the accompanying drawings, wherein:

FIG. 29 is a table summarizing the conditions to be satisfied in order to change the scanning regions $A_{Wide}$, $A_{Mid}$, and $A_{Hot}$ when the distances between each of the optical deflectors $\mathbf{201}_{Wide}$, $\mathbf{201}_{Mid}$, and $\mathbf{201}_{Hot}$ (the center of the mirror part 202) and the wavelength conversion member 18 are the same (or substantially the same) as each other;

FIG. 32 is a table summarizing the conditions to be satisfied in order to change the scanning regions $A_{Wide}$, $A_{Mid}$, and $A_{Hot}$ when the driving voltages to be applied to the respective optical deflectors $\mathbf{201}_{Wide}$, $\mathbf{201}_{Mid}$, and $\mathbf{201}_{Hot}$ are the same (or substantially the same) as one another;

FIG. 39 includes graphs showing (a) an example of a light intensity distribution (reference example), (b) an example of a drive signal (sinusoidal wave) in order to form the light intensity distribution of (a), and (c) an example of a drive signal (sawtooth wave or rectangular wave) including a linear region in order to form the light intensity distribution of (a);

FIG. 41 includes graphs showing (a) an example of a light intensity distribution in which the light intensities at regions B1 and B3 near its center are relatively high, (b) an example of a drive signal (sawtooth wave or rectangular wave) including a nonlinear region in order to form the light intensity distribution of (a), and (c) an example of a drive signal (sawtooth wave or rectangular wave) including a nonlinear region in order to form the light intensity distribution of (a);

FIG. 42 includes graphs showing (a) an example of a light intensity distribution (reference example), (b) an example of a drive signal (sawtooth wave or rectangular wave) including a linear region in order to form the light intensity distribution of (a), and (c) an example of a drive signal (sawtooth wave or rectangular wave) including a linear region in order to form the light intensity distribution of (a);

FIG. 43 includes graphs showing (a) an example of a light intensity distribution (reference example), (b) an example of a drive signal (sinusoidal wave) in order to form the light intensity distribution of (a), and (c) an example of a drive signal (sinusoidal wave) in order to form the light intensity distribution of (a);

DESCRIPTION OF EXEMPLARY EMBODIMENTS

A description will now be made below to vehicle lighting fixtures of the presently disclosed subject matter with reference to the accompanying drawings in accordance with reference examples and an exemplary embodiment(s). The definition relating to directions is based on the irradiation direction of the vehicle lighting fixture that can form a light distribution pattern in front of a vehicle body on which the vehicle lighting fixture is installed.

Before discussing the presently disclosed subject matter by way of an exemplary embodiment(s), the basic configuration that can be adopted by the presently disclosed subject matter will be described as several reference examples with the use of a simple system configuration.

Figure 1:
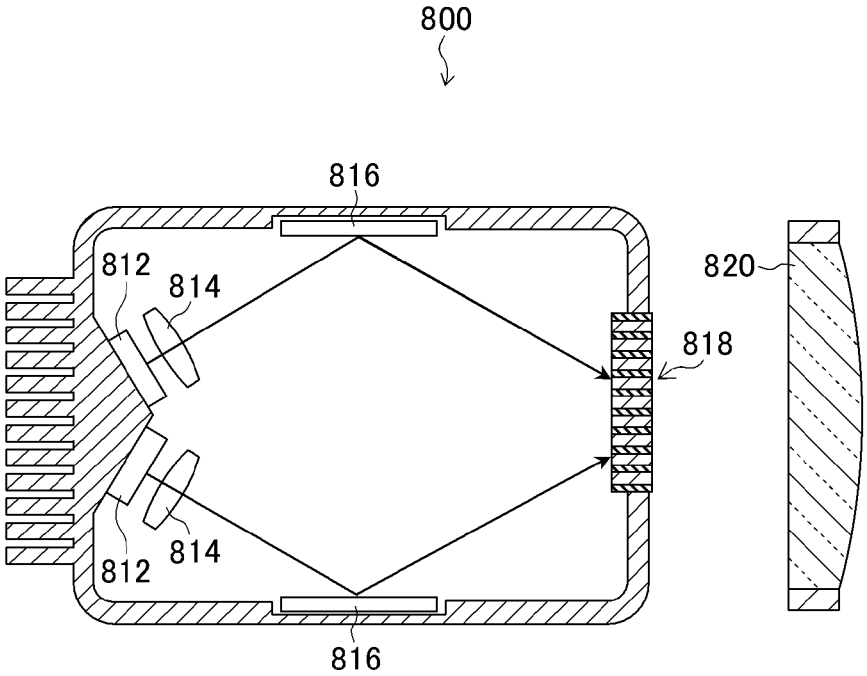
FIG. 1 Conventional Art
FIG. 1 is a schematic diagram illustrating a conventional vehicle lighting fixture 600.
Figure 2:
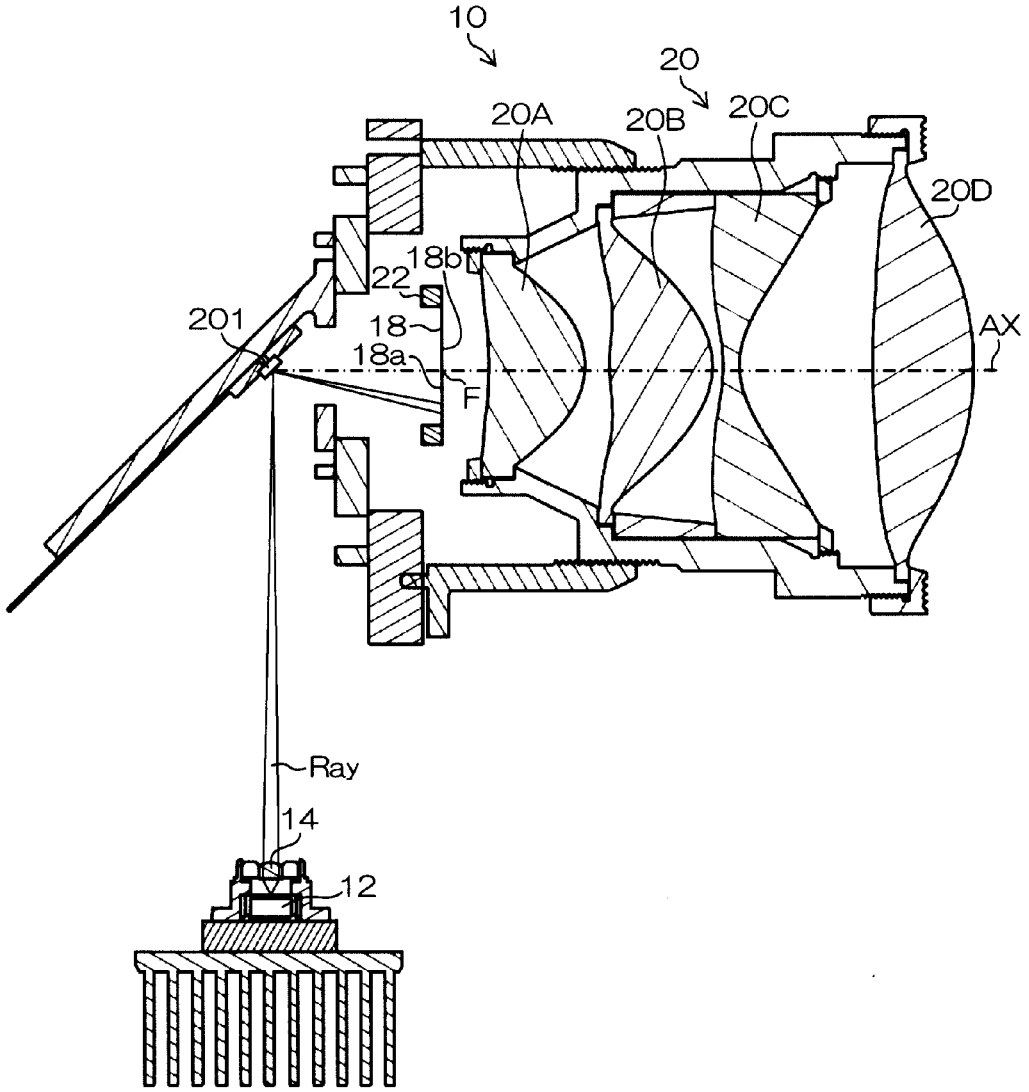
FIG. 2 is a vertical cross-sectional view illustrating a vehicle lighting fixture 10 of a first reference example.

FIG. 2 is a vertical cross-sectional view illustrating a vehicle lighting fixture 10 of a first reference example.

As illustrated in FIG. 2, the vehicle lighting fixture 10 according to the reference example is configured as a vehicle headlamp and can include: an excitation light source 12; a condenser lens 14 configured to condense excitation light rays Ray from the excitation light source 12; an optical deflector 201 configured to scan with the excitation light rays Ray, which are condensed by the condenser lens 14, in a two-dimensional manner in a horizontal direction and a vertical direction; a wavelength conversion member 18 configured to form a two-dimensional image corresponding to a predetermined light distribution pattern drawn by the excitation light rays Ray with which the wavelength conversion member is scanned in the two-dimensional manner in the horizontal and vertical directions by the optical deflector 201; and a projector lens assembly 20 configured to project the two-dimensional image drawn on the wavelength conversion member 18 forward.

The optical deflector 201, the wavelength conversion member 18, and the projector lens assembly 20 can be disposed, as illustrated in FIG. 2, so that the excitation light rays Ray which are emitted from the excitation light source 12 and with which the optical deflector 201 scans in the two-dimensional manner (in the horizontal and vertical directions) can be incident on a rear face 18*a* of the wavelength conversion member 18 and pass therethrough to exit through a front face 18*b* thereof. Specifically, the optical deflector 201 can be disposed on the rear side with respect to the wavelength conversion member 18 while the projector lens assembly 20 can be disposed on the front side with respect to the wavelength conversion member 18. This type of arrangement is called as a transmission type. In this case, the excitation light source 12 may be disposed either on the front side or on the rear side with respect to the wavelength conversion member 18. In FIG. 2, the projector lens assembly 20 can be configured to include four lenses 20A to 20D, but the projector lens assembly 20 may be configured to include a single aspheric lens, for example.

Figure 3:
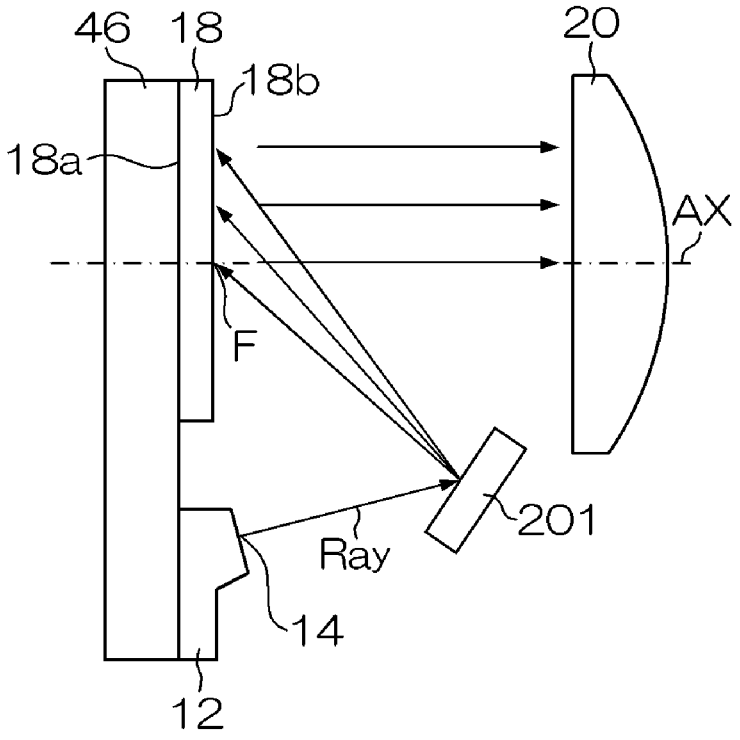
FIG. 3 is a schematic view illustrating a modified example of the vehicle lighting fixture 10.

The optical deflector 201, the wavelength conversion member 18, and the projector lens assembly 20 may be disposed, as illustrated in FIG. 3, so that the excitation light rays Ray which are emitted from the excitation light source 12 and with which the optical deflector 201 scans in the two-dimensional manner (in the horizontal and vertical directions) can be incident on the front face 18*b* of the wavelength conversion member 18. In this case, the optical deflector 201 and the projector lens assembly 20 may be disposed on the front side with respect to the wavelength conversion member 18. This type of arrangement is called as a reflective type. In this case, the excitation light source 12 may be disposed either on the front side or on the rear side with respect to the wavelength conversion member 18. The reflective type arrangement as illustrated in FIG. 3, when compared with the transmission type arrangement as illustrated in FIG. 2, is advantageous in terms of the dimension of the vehicle lighting fixture 10 in a reference axis Ax direction being shorter. In FIG. 3, the projector lens assembly 20 is configured to include a single aspheric lens, but the projector lens assembly 20 may be configured to include a lens group composed of a plurality of lenses.

The excitation light source 12 can be a semiconductor light emitting element such as a laser diode (LD) that can emit laser light rays of blue color (for example, having an emission wavelength of 450 nm). The excitation light source 12 may be a semiconductor light emitting element such as a laser diode (LD) that can emit laser light rays of near ultraviolet light (for example, having an emission wavelength of 405 nm) or an LED. The excitation light rays emitted from the excitation light source 12 can be converged by the condenser lens 14 (for example, collimated) and be incident on the optical deflector 201 (in particular, on a mirror part thereof).

The wavelength conversion member 18 can be a plate-shaped or laminate-type wavelength conversion member having a rectangular outer shape. The wavelength conversion member 18 can be scanned with the laser light rays as the excitation light rays by the optical deflector 201 in a two-dimensional manner (in the horizontal and vertical directions) to thereby convert at least part of the excitation light rays to light rays with different wavelength. In the case of FIG. 2, the wavelength conversion member 18 can be fixed to a frame body 22 at an outer periphery of the rear face 18*a* thereof and disposed at or near the focal point F of the projector lens assembly 20. In the case of FIG. 3, the wavelength conversion member 18 can be fixed to a support 46 at the rear face 18*a* thereof and disposed at or near the focal point F of the projector lens assembly 20.

Specifically, when the excitation light source 12 is a blue laser diode for emitting blue laser light rays, the wavelength conversion member 18 can employ a plate-shaped or laminate-type phosphor that can be excited by the blue laser light rays to emit yellow light rays. With this configuration, the optical deflector 201 can scan the wavelength conversion member 18 with the blue laser light rays in a two-dimensional manner (in the horizontal and vertical directions), whereby a two-dimensional white image can be drawn on the wavelength conversion member 18 corresponding to a predetermined light distribution pattern. Specifically, when the wavelength conversion member 18 is irradiated with the blue laser light rays, the passing blue laser light rays and the yellow light rays emitted from the wavelength conversion member 18 can be mixed with each other to emit pseudo white light, thereby drawing the two-dimensional white image on the wavelength conversion member 18.

Further, when the excitation light source 12 is a near UV laser diode for emitting near UV laser light rays, the wavelength conversion member 18 can employ a plate-shaped or laminate-type phosphor that can be excited by the near UV laser light rays to emit three types of colored light rays, i.e., red, green, and blue light rays. With this configuration, the optical deflector 201 can scan the wavelength conversion member 18 with the near UV laser light rays in a two-dimensional manner (in the horizontal and vertical directions), whereby a two-dimensional white image can be drawn on the wavelength conversion member 18 corresponding to a predetermined light distribution pattern. Specifically, when the wavelength conversion member 18 is irradiated with the near UV laser light rays, the red, green, and blue light rays emitted from the wavelength conversion member 18 due to the excitation by the near UV laser light rays can be mixed with each other to emit pseudo white light, thereby drawing the two-dimensional white image on the wavelength conversion member 18.

The projector lens assembly 20 can be composed of a group of four lenses 20A to 20D that have been aberration-corrected (have been corrected in terms of the field curvature) to provide a planar image formed, as illustrated in FIG. 2. The lenses may also be color aberration-corrected. Then, the planar wavelength conversion member 18 can be disposed in alignment with the image plane (flat plane). The focal point F of the projector lens assembly 20 can be located at or near the wavelength conversion member 18. When the projector lens assembly 20 is a group of plural lenses, the projector lens assembly 20 can remove the adverse effect of the aberration on the predetermined light distribution pattern more than a single convex lens used. With this projector lens assembly 20, the planar wavelength conversion member 18 can be employed. This is advantageous because the planar wavelength conversion member 18 can be produced easier than a curved wavelength conversion member. Furthermore, this is advantageous because the planar wavelength conversion member 18 can facilitate the drawing of a two-dimensional image thereon easier than a curved wavelength conversion member.

Further, the projector lens assembly 20 composed of a group of plural lenses is not limitative, and may be composed of a single aspheric lens without aberration correction (correction of the field curvature) to form a planar image. In this case, the wavelength conversion member 18 should be a curved one corresponding to the field curvature and disposed along the field curvature. In this case, also the focal point F of the projector lens assembly 20 can be located at or near the wavelength conversion member 18.

The projector lens assembly 20 can project the two-dimensional image drawn on the wavelength conversion member 18 corresponding to the predetermined light distribution pattern forward to form the predetermined light distribution pattern (low-beam light distribution pattern or high-beam light distribution pattern) on a virtual vertical screen in front of the vehicle lighting fixture 10 (assumed to be disposed in front of the vehicle lighting fixture approximately 25 m away from the vehicle body).

Next, a description will be given of the optical deflector 201. The optical deflector 201 can scan the wavelength conversion member 18 with the excitation light rays Ray emitted from the excitation light source 12 and converged by the condenser lens 14 (for example, collimated) in a two-dimensional manner (in the horizontal and vertical direction).

The optical deflectors 201 can be configured by, for example, an MEMS scanner. The driving system of the optical deflectors is not limited to a particular system, and examples thereof may include a piezoelectric system, an electrostatic system, and an electromagnetic system. In the present reference example, a description will be given of an optical deflector driven by a piezoelectric system as a representative example.

The piezoelectric system used in the optical deflector is not limited to a particular system, and examples thereof may include a one-dimensional nonresonance/one-dimensional resonance type, a two-dimensional nonresonance type, and a two-dimensional resonance type.

The following reference example may employ the one-dimensional nonresonance/one-dimensional resonance type (2-D optical scanner (fast resonant and slow static combination)) of optical deflector 201 using the piezoelectric system, as one example.

<One-Dimensional Nonresonance/One-Dimensional Resonance Type (2-D Optical Scanner (Fast Resonant and Slow Static Combination))>

Figure 4:
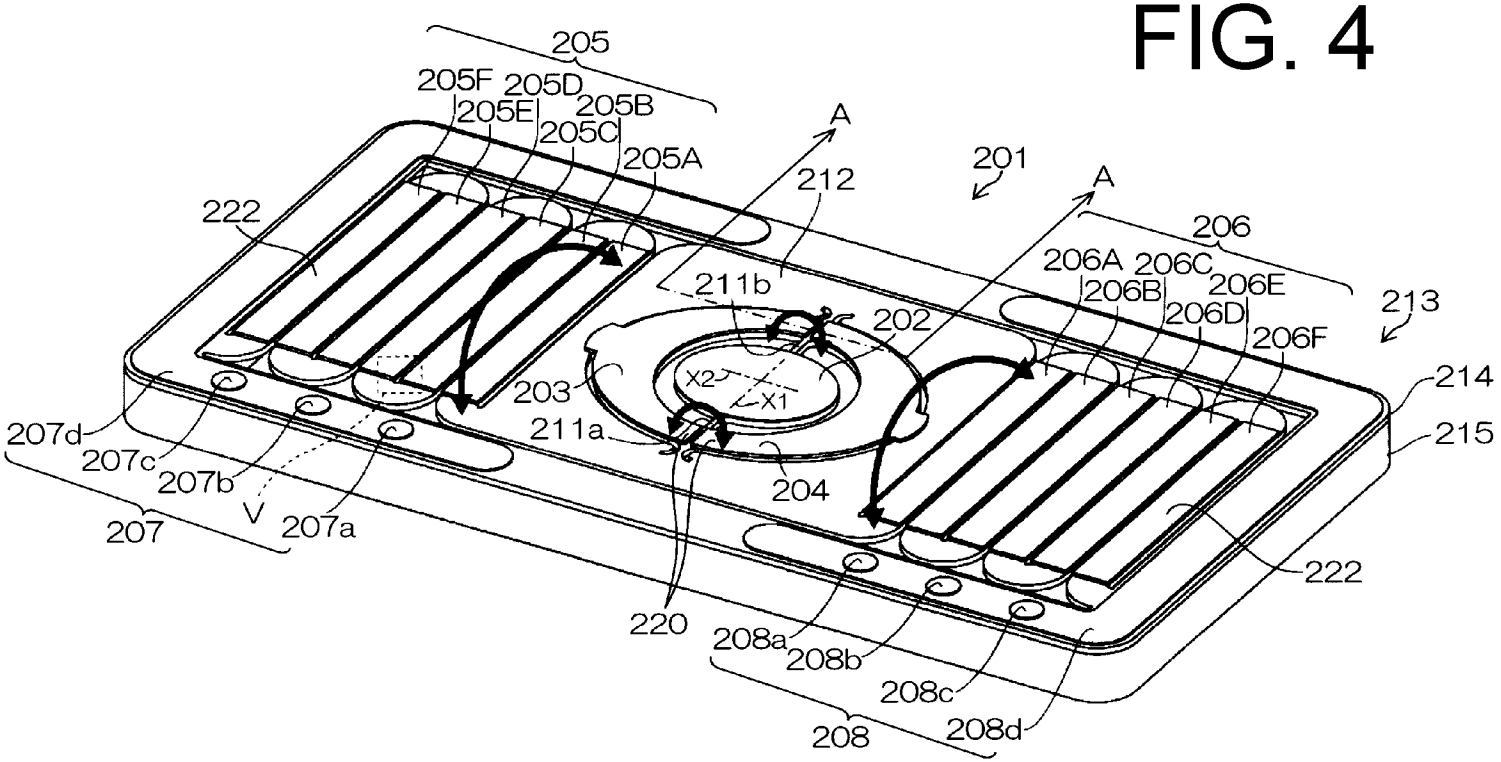
FIG. 4 is a perspective view illustrating an optical deflector 201 of a 2-D optical scanner (fast resonant and slow static combination) (of a one-dimensional nonresonance/one-dimensional resonance type)

FIG. 4 is a perspective view illustrating the optical deflector 201 utilizing a 2-D optical scanner (fast resonant and slow static combination).

As illustrated in FIG. 4, the optical deflector 201 can include the mirror part 202 (also called as MEMS mirror), the first piezoelectric actuators 203 and 204, a movable frame 212, second piezoelectric actuators 205 and 206, and a base 215. The first piezoelectric actuators 203 and 204 can drive the mirror part 202 via torsion bars 211*a* and 211*b*. The movable frame 212 can support the first piezoelectric actuators 203 and 204. The second piezoelectric actuators 205 and 206 can drive the movable frame 212. The base 215 can support the second piezoelectric actuators 205 and 206.

The mirror part 202 can be formed in a circle shape and the torsion bars 211*a* and 211*b* can be connected to the mirror part 202 so as to extend outward from both ends of the mirror part 202. The first piezoelectric actuators 203 and 204 can be formed in a semi-circle shape so as to surround the mirror part 202 while disposed with a gap between them. Furthermore, the first piezoelectric actuators 203 and 204 can be coupled to each other with the torsion bars 211*a* and 211*b* interposed therebetween at their respective ends. The movable frame 212 can be disposed to surround the mirror part 202 and the first piezoelectric actuators 203 and 204. The first piezoelectric actuators 203 and 204 can be coupled to and supported by the movable frame 212 at respective outer central portions of the semi-circle (arc) shape.

The movable frame 212 can have a rectangular shape and include a pair of sides disposed in a direction perpendicular to the directions of the torsion bars 211*a* and 211*b*, at which the movable frame 212 can be coupled to the respective tip ends of the second piezoelectric actuators 205 and 206 opposite to each other with the movable frame 212 interposed therebetween. The base 215 can include a supporting base part 214 formed thereon so as to surround the movable frame 212 and the second piezoelectric actuators 205 and 206. In this configuration, the second piezoelectric actuators 205 and 206 can be coupled to and supported at respective base ends thereof by the supporting base part 214.

Figure 5A:
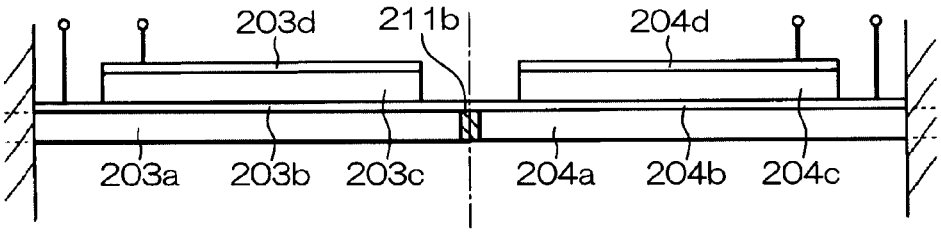
FIG. 5A is a schematic diagram illustrating a state in which first piezoelectric actuators 203 and 204 are not applied with a voltage.

The first piezoelectric actuators 203 and 204 each can include a single piezoelectric cantilever composed of a support 203*a*, 204*a*, a lower electrode 203*b*, 204*b*, a piezoelectric body 203*c*, 204*c*, and an upper electrode 203*d*, 204*d*, as illustrated in FIG. 5A.

Further, as illustrated in FIG. 4, the second piezoelectric actuators 205 and 206 each can include six piezoelectric cantilevers 205A to 205F, 206A to 206F, which are coupled to adjacent ones thereof so as to be folded back at its end. As a result, the second piezoelectric actuators 205 and 206 can be formed in an accordion shape as a whole. Each of the piezoelectric cantilevers 205A to 205F and 206A to 206F can have the same configuration as those of the piezoelectric cantilevers of the first piezoelectric actuators 203 and 204.

A description will now be given of the action of the mirror part 202 (swing motion around the first axis X1).

Figure 5B:
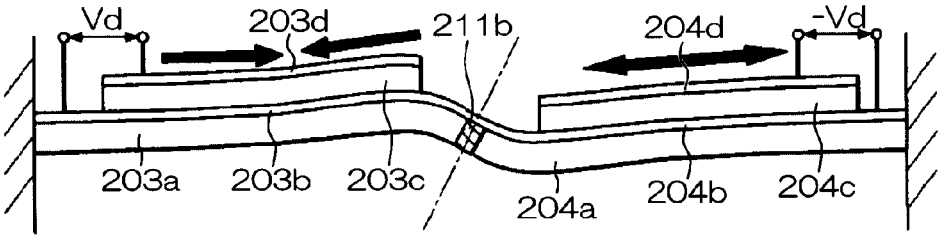
FIG. 5B is a schematic diagram illustrating a state in which they are applied with a voltage.

FIGS. 5A and 5B each show the cross-sectional view of the part where the first piezoelectric actuators 203 and 204 are provided, while taken along line A-A in FIG. 4. Specifically, FIG. 5A is a schematic diagram illustrating a state in which the first piezoelectric actuators 203 and 204 are not applied with a voltage, and FIG. 5B is a schematic diagram illustrating a state in which they are applied with a voltage.

As illustrated in FIG. 5B, voltages of +Vd and −Vd, which have respective reversed polarity, can be applied to between the upper electrode 203*d* and the lower electrode 203*b* of the first piezoelectric actuator 203 and between the upper electrode 204*d* and the lower electrode 204*b* of the first piezoelectric actuator 204, respectively. As a result, they can be deformed while being bent in respective opposite directions. This bent deformation can rotate the torsion bar 211*b* in such the state as illustrated in FIG. 5B. The torsion bar 211*a* can receive the same rotation. Upon rotation of the torsion bars 211*a* and 211*b*, the mirror part 202 can be swung around the first axis X1 with respect to the movable frame 212.

A description will now be given of the action of the mirror part 202 (swing motion around a second axis X2). Note that the second axis X2 is perpendicular to the first axis X1 at the center (center of gravity) of the mirror part 202.

Figure 6A:
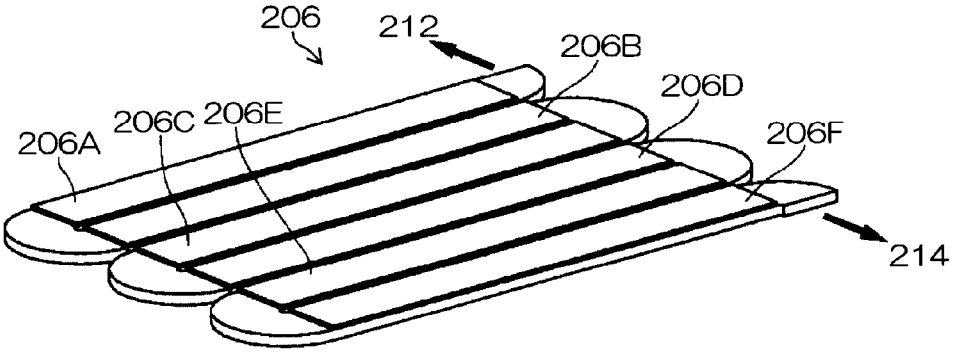
FIG. 6A is a schematic diagram illustrating a state in which second piezoelectric actuators 205 and 206 are not applied with a voltage.
Figure 6B:
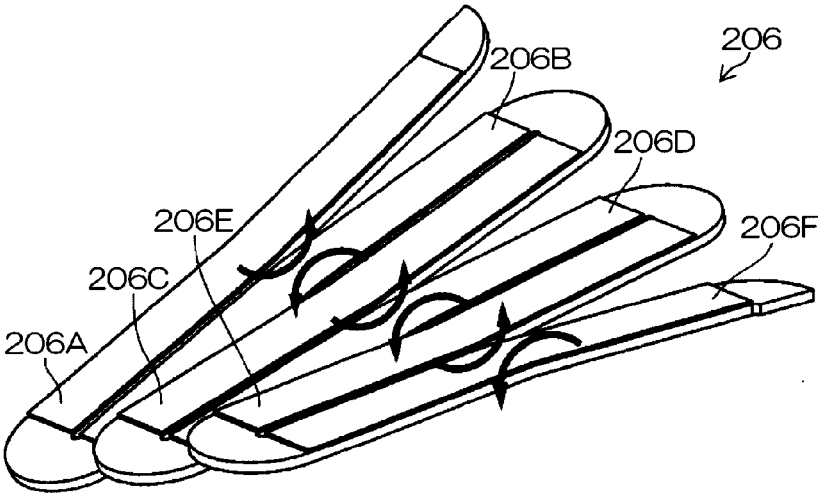
FIG. 6B is a schematic diagram illustrating a state in which they are applied with a voltage.

FIG. 6A is a schematic diagram illustrating a state in which the second piezoelectric actuators 205 and 206 are not applied with a voltage, and FIG. 6B is a schematic diagram illustrating a state in which they are applied with a voltage.

As illustrated in FIG. 6B, when the second piezoelectric actuator 206 is applied with a voltage, the odd-numbered piezoelectric cantilevers 206A, 206C, and 206E from the movable frame 212 side can be deformed and bent upward while the even-numbered piezoelectric cantilevers 206B, 206D, and 206F can be deformed and bent downward. As a result, the piezoelectric actuator 206 as a whole can be deformed with a larger angle (angular variation) accumulated by the magnitudes of the respective bent deformation of the piezoelectric cantilevers 206A to 206F. The second piezoelectric actuator 205 can also be driven in the same manner. This angular variation of the second piezoelectric actuators 205 and 206 can cause the movable frame 212 (and the mirror part 202 supported by the movable frame 212) to rotate with respect to the base 215 around the second axis X2 perpendicular to the first axis X1.

A single support formed by processing a silicon substrate can constitute a mirror part support for the mirror part 202, the torsion bars 211*a* and 211*b*, supports for the first piezoelectric actuators 203 and 204, the movable frame 212, supports for the second piezoelectric actuators 205 and 206, and the supporting base part 214 on the base 215. Furthermore, the base 215 can be formed from a silicon substrate, and therefore, it can be integrally formed from the above single support by processing a silicon substrate. The technique of processing such a silicon substrate can employ those described in, for example, Japanese Patent Application Laid-Open No. 2008-040240, which is hereby incorporated in its entirety by reference. There can be provided a gap between the mirror part 202 and the movable frame 212, so that the mirror part 202 can be swung around the first axis X1 with respect to the movable frame 212 within a predetermined angle range. Furthermore, there can be provided a gap between the movable frame 212 and the base 215, so that the movable frame 212 (and together with the mirror part 202 supported by the movable frame 212) can be swung around the second axis X2 with respect to the base 215 within a predetermined angle range.

The optical deflector 201 can include electrode sets 207 and 208 to apply a drive voltage to the respective piezoelectric actuators 203 to 206.

The electrode set 207 can include an upper electrode pad 207*a*, a first upper electrode pad 207*b*, a second upper electrode pad 207*c*, and a common lower electrode 207*d*. The upper electrode pad 207*a* can be configured to apply a drive voltage to the first piezoelectric actuator 203. The first upper electrode pad 207*b* can be configured to apply a drive voltage to the odd-numbered piezoelectric cantilevers 205A, 205C, and 205E of the second piezoelectric actuator 205 counted from its tip end side. The second upper electrode pad 207*c* can be configured to apply a drive voltage to the even-numbered piezoelectric cantilevers 205B, 205D, and 205F of the second piezoelectric actuator 205 counted from its tip end side. The common lower electrode 207*d* can be used as a lower electrode common to the upper electrode pads 207*a* to 207*c*.

Similarly thereto, the other electrode set 208 can include an upper electrode pad 208*a*, a first upper electrode pad 208*b*, a second upper electrode pad 208*c*, and a common lower electrode 208*d*. The upper electrode pad 208*a* can be configured to apply a drive voltage to the first piezoelectric actuator 204. The first upper electrode pad 208*b* can be configured to apply a drive voltage to the odd-numbered piezoelectric cantilevers 206A, 206C, and 206E of the second piezoelectric actuator 206 counted from its tip end side. The second upper electrode pad 208*c* can be configured to apply a drive voltage to the even-numbered piezoelectric cantilevers 206B, 206D, and 206F of the second piezoelectric actuator 206 counted from its tip end side. The common lower electrode 208*d* can be used as a lower electrode common to the upper electrode pads 208*a* to 208*c*.

In this reference example, the first piezoelectric actuator 203 can be applied with a first AC voltage as a drive voltage, while the first piezoelectric actuator 204 can be applied with a second AC voltage as a drive voltage, wherein the first AC voltage and the second AC voltage can be different from each other in phase, such as a sinusoidal wave with an opposite phase or shifted phase. In this case, an AC voltage with a frequency close to a mechanical resonance frequency (first resonance point) of the mirror part 202 including the torsion bars 211*a* and 211*b* can be applied to resonantly drive the first piezoelectric actuators 203 and 204. This can cause the mirror part 202 to be reciprocately swung around the first axis X1 with respect to the movable frame 212, so that the laser light rays as excitation light rays from the excitation light source 12 and incident on the mirror part 202 can scan in a first direction (for example, horizontal direction).

A third AC voltage can be applied to each of the second piezoelectric actuators 205 and 206 as a drive voltage. In this case, an AC voltage with a frequency equal to or lower than a predetermined value that is smaller than a mechanical resonance frequency (first resonance point) of the movable frame 212 including the mirror part 202, the torsion bars 211*a* and 211*b*, and the first piezoelectric actuators 203 and 204 can be applied to nonresonantly drive the second piezoelectric actuators 205 and 206. This can cause the mirror part 202 to be reciprocately swung around the second axis X2 with respect to the base 215, so that the laser light rays as excitation light rays from the excitation light source 12 and incident on the mirror part 202 can scan in a second direction (for example, vertical direction).

The optical deflector 201 utilizing a 2-D optical scanner (fast resonant and slow static combination) can be arranged so that the first axis X1 is contained in a vertical plane and the second axis X2 is contained in a horizontal plane. With this arrangement, a predetermined light distribution pattern (two-dimensional image corresponding to the required predetermined light distribution pattern) being wide in the horizontal direction and narrow in the vertical direction for use in a vehicular headlamp can be easily formed (drawn).

Figure 7A:
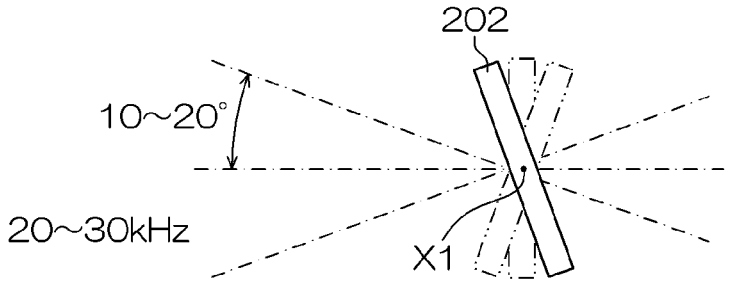
FIG. 7A is a diagram illustrating the maximum swing angle of a mirror part 202 around a first axis X1.
Figure 7B:
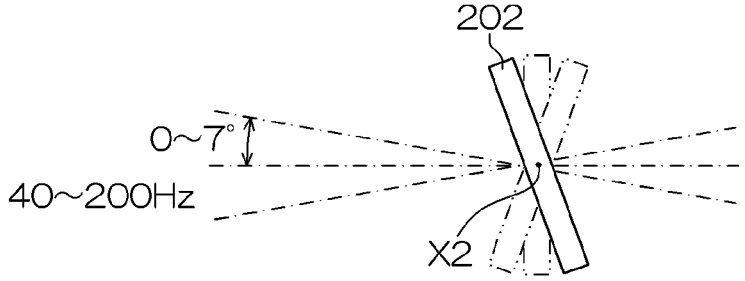
FIG. 7B is a diagram illustrating the maximum swing angle of the mirror part 202 around a second axis X2.

Specifically, the optical deflector 201 utilizing a 2-D optical scanner (fast resonant and slow static combination) can be configured such that the maximum swing angle of the mirror part 202 around the first axis X1 is larger than the maximum swing angle of the mirror part 202 around the second axis X2. For example, since the reciprocal swing of the mirror part 202 around the first axis X1 is caused due to the resonance driving, the maximum swing angle of the mirror part 202 around the first axis X1 ranges from 10 degrees to 20 degrees as illustrated in FIG. 7A. On the contrary, since the reciprocal swing of the mirror part 202 around the second axis X2 is caused due to the nonresonance driving, the maximum swing angle of the mirror part 202 around the second axis X2 becomes about 7 degrees as illustrated in FIG. 7B. As a result, the above-described arrangement of the optical deflector 201 utilizing a 2-D optical scanner (fast resonant and slow static combination) can easily form (draw) a predetermined light distribution pattern (two-dimensional image corresponding to the required predetermined light distribution pattern) being wide in the horizontal direction and narrow in the vertical direction for use in a vehicular headlight.

As described above, by driving the respective piezoelectric actuators 203 to 206, the laser light rays as the excitation light rays from the excitation light source 12 can scan in a two dimensional manner (for example, in the horizontal and vertical directions).

As illustrated in FIG. 4, the optical deflector 201 can include an H sensor 220 and a V sensor 222. The H sensor 220 can be disposed at the tip end of the torsion bar 211*a* on the mirror part 202 side. The V sensor 222 can be disposed to the base end sides of the second piezoelectric actuators 205 and 206, for example, at the piezoelectric cantilevers 205F and 206F.

The H sensor 220 can be formed from a piezoelectric element (PZT) similar to the piezoelectric cantilever in the first piezoelectric actuators 203 and 204 and can be configured to general a voltage in accordance with the bent deformation (amount of displacement) of the first piezoelectric actuators 203 and 204. The V sensor 222 can be formed from a piezoelectric element (PZT) similar to the piezoelectric cantilever in the second piezoelectric actuators 205 and 206 and can be configured to general a voltage in accordance with the bent deformation (amount of displacement) of the second piezoelectric actuators 205 and 206.

Figure 20:
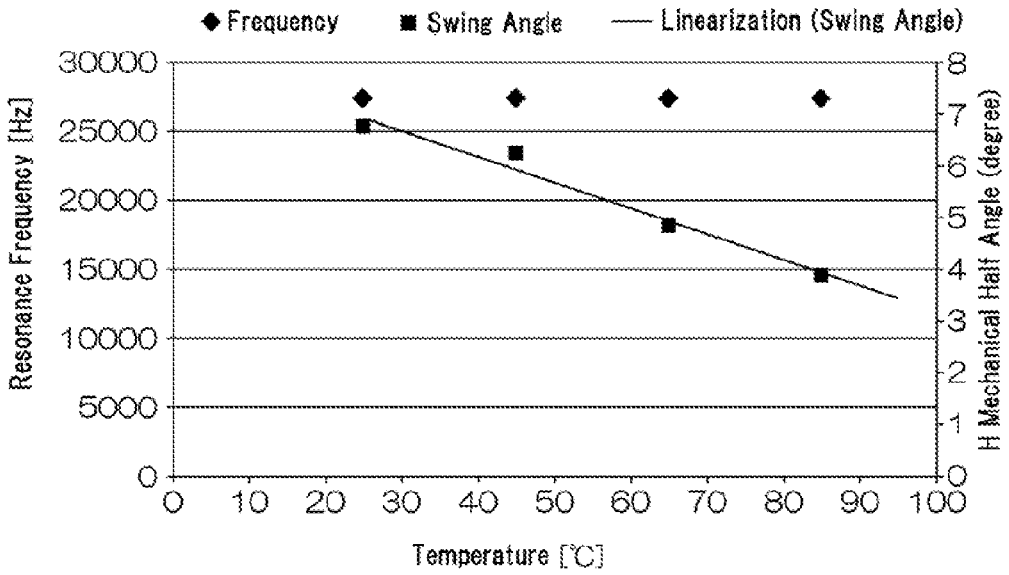
FIG. 20 is a graph showing a relationship among the temperature change, the resonance frequency, and the mechanical swing angle (half angle) of a mirror part 202 around the first axis X1 as a center.

In the optical deflector 201, the mechanical swing angle (half angle) of the mirror 202 around the first axis X1 is varied, as illustrated in FIG. 20, due to the change in natural vibration frequency of a material constituting the optical deflector 201 by temperature change. This can be suppressed by the following method. Specifically, on the basis of the drive signal (the first AC voltage and the second AC voltage to be applied to the first piezoelectric actuators 203 and 204) and the sensor signal (output of the H sensor 220), the frequencies of the first AC voltage and the second AC voltage to be applied to the first piezoelectric actuators 203 and 204 (or alternatively, the first AC voltage and the second AC voltage themselves) can be feed-back controlled so that the mechanical swing angle (half angle) of the mirror part 202 around the first axis becomes a target value. As a result, the fluctuation can be suppressed.

A description will next be give of the desired frequencies of the first AC voltage and the second AC voltage to be applied to the first piezoelectric actuators 203 and 204 and the desired frequency of the third AC voltage to be applied to the second piezoelectric actuators 205 and 206.

The inventors of the subject application have conducted experiments and examined the test results thereof to find out that the frequencies (hereinafter, referred to as a horizontal scanning frequency $f_H$) of the first AC voltage and the second AC voltage to be applied to the first piezoelectric actuators 203 and 204 in the optical deflector 201 utilizing a 2-D optical scanner (fast resonant and slow static combination) with the above configuration can be desirably about 4 to 30 kHz (sinusoidal wave), and more desirably 27 kHz±3 kHz (sinusoidal wave).

Furthermore, the inventors of the subject application have found out that the horizontal resolution (number of pixels) is desirably set to 300 (or more) in consideration of the high-beam light distribution pattern so that the turning ON/OFF (lit or not lit) can be controlled at an interval of 0.1 degrees (or less) within the angular range of −15 degrees (left) to +15 degrees with respect to the vertical axis V.

The inventors of the subject application have further conducted experiments and examined the test results thereof to find out that the frequency (hereinafter, referred to as a vertical scanning frequency $f_V$) of the third AC voltage to be applied to the second piezoelectric actuators 205 and 206 in the optical deflector 201 utilizing a 2-D optical scanner (fast resonant and slow static combination) with the above configuration can be desirably 55 Hz or higher (sawtooth wave), more desirably 55 Hz to 120 Hz (sawtooth wave), still more desirably 55 Hz to 100 Hz (sawtooth wave), and particularly desirably 70 Hz±10 Hz (sawtooth wave).

Furthermore, the inventors of the subject application have found out that the frequency (the vertical scanning frequency $f_V$) of the third AC voltage to be applied to the second piezoelectric actuators 205 and 206 is set to desirably 50 Hz or higher (sawtooth wave), more desirably 50 Hz to 120 Hz (sawtooth wave), still more desirably 50 Hz to 100 Hz (sawtooth wave), and particularly desirably 70 Hz±10 Hz (sawtooth wave) in consideration of normal travelling speeds (for example, 0 km/h to 150 km/h). Since the frame rate depends on the vertical scanning frequency $f_V$, when the vertical scanning frequency $f_V$ is 70 Hz, the frame rate is 70 fps.

When the vertical scanning frequency $f_V$ is 55 Hz or higher, the predetermined light distribution pattern can be formed on the virtual vertical screen as an image (considered as a moving picture or movie) with a frame rate of 55 fps or more. Similarly, when the vertical scanning frequency $f_V$ is 55 Hz to 120 Hz, the predetermined light distribution pattern can be formed on the virtual vertical screen as an image (considered as a moving picture or movie) with a frame rate of 55 fps or more and 120 fps or less. Similarly, when the vertical scanning frequency $f_V$ is 55 Hz to 100 Hz, the predetermined light distribution pattern can be formed on the virtual vertical screen as an image (considered as a moving picture or movie) with a frame rate of 55 fps or more and 100 fps or less. Similarly, when the vertical scanning frequency $f_V$ is 70 Hz±10 Hz, the predetermined light distribution pattern can be formed on the virtual vertical screen as an image (considered as a moving picture or movie) with a frame rate of 70 fps±10 fps. The same correspondence as above can be applied to the cases when the vertical scanning frequency $f_V$ is 50 Hz or more, 50 Hz to 120 Hz, 50 Hz to 100 Hz, and 70 Hz±10 Hz.

The resolution (the number of vertical scanning lines) in the vertical direction can be determined by the following formula.

The resolution in the vertical direction(the number of vertical scanning lines)=2×(Utility time coefficient of vertical scanning: $K_V$)×$f_H/f_V$ On the basis of this formula, if the horizontal scanning frequency $f_H$=25 kHz, the vertical scanning frequency $f_V$=70 Hz, and the utility time coefficient Kv=0.9 to 0.8, then the number of vertical scanning lines is about 600 (lines)=2×25 kHz/70 Hz×(0.9 to 0.85).

The above-described desirable vertical scanning frequency $f_V$ have never been used in vehicle lighting fixtures such as vehicular headlamps, and the inventors of the present application have found it as a result of various experiments conducted by the inventors. Specifically, in the conventional art, in order to suppress the flickering in the general illumination field (other than the vehicle lighting fixtures such as an automobile headlamp), it is a technical common knowledge to use a frequency of 100 Hz or higher. Furthermore, in order to suppress the flickering in the technical field of vehicle lighting fixtures, it is a technical common knowledge to use a frequency of 220 Hz or higher. Therefore, the above-described desirable vertical scanning frequency $f_V$ have never been used in vehicle lighting fixtures such as vehicular headlamps.

Next, a description will now be given of why the technical common knowledge is to use a frequency of 100 Hz or higher in order to suppress the flickering in the general illumination field (other than the vehicle lighting fixtures such as an automobile headlamp).

For example, the Ordinance Concerning Technical Requirements for Electrical Appliances and Materials (Ordinance of the Ministry of International Trade and Industry No. 85 of 37$^{th}$ year of Showa) describes that "the light output should be no flickering," and "it is interpreted as to be no flickering when the light output has a repeated frequency of 100 Hz or higher without missing parts or has a repeated frequency of 500 Hz or higher." It should be noted that the Ordinance is not intended to vehicle lighting fixtures such as automobile headlamps.

Furthermore, the report in Nihon Keizai Shimbun (The Nikkei dated Aug. 26, 2010) also said that "the alternating current has a frequency of 50 Hz. The voltage having passed through a rectifier is repeatedly changed between ON and OFF at a frequency of 100 times per second. The fluctuation in voltage may affect the fluctuation in luminance of fluorescent lamps. An LED illumination has no afterglow time like the fluorescent lamps, but instantaneously changes in its luminance, whereby flickering is more noticeable," meaning that the flickering is more noticeable when the frequency is 100 Hz or higher.

In general, the blinking frequency of fluorescent lamps that cannot cause flickering is said to be 100 Hz to 120 Hz (50 Hz to 60 Hz in terms of the power source phase).

Next, a description will be given of why the technical common knowledge is to use a frequency of 220 Hz or higher (or a frame rate of 220 fps or more) in order to suppress the flickering in vehicle lighting fixtures such as an automobile headlamp.

In general, an HID (metal halide lamp) used for an automobile headlamp can be lit under a condition of applying a voltage with a frequency of 350 to 500 Hz (rectangular wave). This is because a frequency of 800 Hz or more may cause an acoustic noise while a lower frequency may deteriorate the light emission efficiency of HIDs. When a frequency of 150 Hz or lower is employed, the HID life may be lowered due to the adverse effect to heating wearing of electrodes. Furthermore, a frequency of 250 Hz or higher is said to be preferable.

The report of "Glare-free High Beam with Beam-scanning," ISAL 2013, pp. 340 to 347 says that the frequency for use in a vehicle lighting fixture such as an automobile headlamp is 220 Hz or higher, and the recommended frequency is 300 to 400 Hz or higher. Similarly, the report of "Flickering effects of vehicle exterior light systems and consequences," ISAL 2013, pp. 262 to 266 says that the frequency for use in a vehicle lighting fixture such as an automobile headlamp is approximately 400 Hz.

Therefore, it has never been known in the conventional art that the use of frequency of 55 Hz or higher (desirably 55 Hz to 120 Hz) as a vertical scanning frequency $f_V$ in a vehicle lighting fixture such as an automobile headlamp can suppress flickering.

A description will now be given of experiments conducted by the inventors of the present application in order to study the above-described desirable vertical scanning frequency $f_V$.

Experiment

The inventors of the present application conducted experiments using a test system simulating a vehicular headlamp during driving to evaluate the degree of flickering sensed by test subjects.

Figure 8:
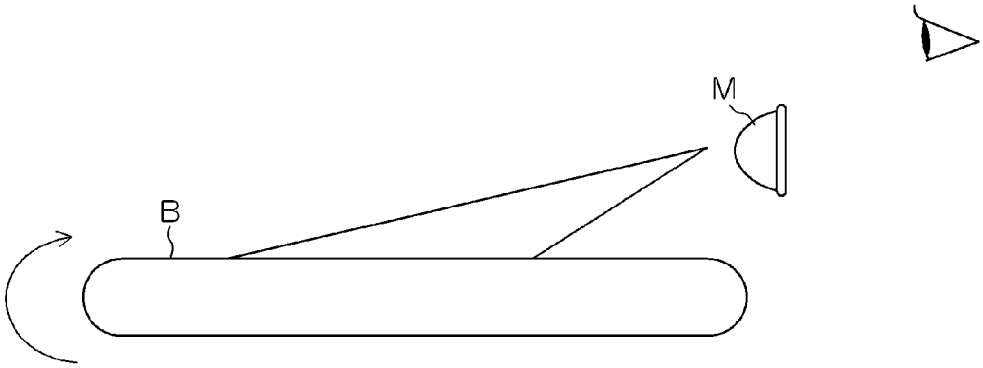
FIG. 8 is a schematic diagram of a test system.

FIG. 8 is a schematic diagram of the test system used.

As illustrated in FIG. 8, the test system can include a movable road model using a rotary belt B that can be varied in rotational speed and a lighting fixture model M similar to those used in the vehicle lighting fixture 10. The movable road model is made with a scale size of ⅕, and white lines and the like simulating an actual road surface are drawn on the surface of the rotary belt B. The lighting fixture model M can change the output (scanning illuminance) of an excitation light source similar to the excitation light source 12.

First, experiments were performed to confirm whether the flickering sensed by a test subject is different between a case where the lighting fixture model M having an LED excitation light source is used for illuminating the surface of the rotary belt B and a case where the lighting fixture model M having an LD excitation light source is used for illuminating the surface of the rotary belt B. As a result, it has been confirmed that if the vertical scanning frequency $f_V$ is the same, the degree of flickering sensed by test subjects is not different between the case where the lighting fixture model M having an LED excitation light source is used for illuminating the surface of the rotary belt B and the case where the lighting fixture model M having an LD excitation light source is used for illuminating the surface of the rotary belt B.

Figure 9:
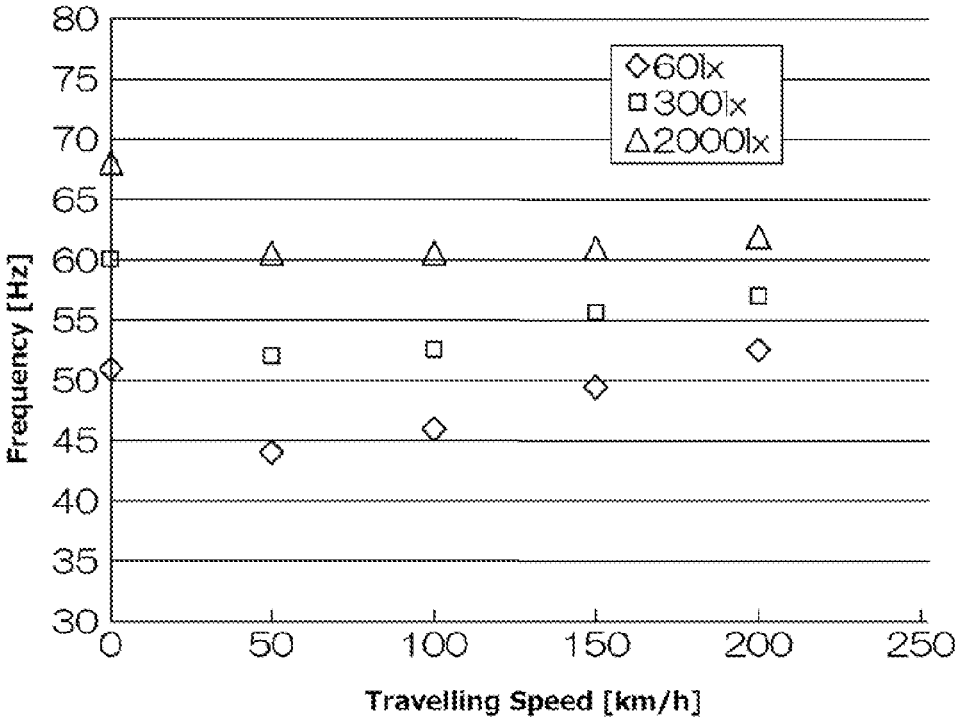
FIG. 9 is a graph obtained by plotting test results (measurement results)

Next, the vertical scanning frequency $f_V$ was measured at the time when a test subject did not sense the flickering while the rotary belt B was rotated at different rotational speed corresponding to each of actual travelling speeds, 0 km/h, 50 km/h, 100 km/h, 150 km/h, and 200 km/h. In particular, the test experiment was performed in such a manner that a test subject changed the vertical scanning frequency $f_V$ by dial operation and stopped the dial operation when he/she did not sense the flickering. The vertical scanning frequency measured at that time was regarded as the vertical scanning frequency $f_V$. The measurement was performed at some levels of illuminance. They are: illuminance of 60 lx being the comparable level of road illumination in front of a vehicle body 30 to 40 meters away from the vehicle body (at a region which a driver watches during driving); illuminance of 300 lx being the comparable level of road illumination in front of the vehicle body approximately 10 meters away from the vehicle body (at a region just in front of the vehicle body); and illuminance of 2000 lx being the comparable level of reflection light from a leading vehicle or a guard rail close to the vehicle body. FIG. 9 is a graph obtained by plotting test results (measurement results), showing the relationship between the travelling speed and the flickering, where the vertical axis represents the vertical scanning frequency $f_V$ and the horizontal axis represents the travelling speed (per hour).

With reference to FIG. 9, the following facts can be found.

Firstly, when the road illuminance is 60 lx and the travelling speed is 0 km/h to 200 km/h, the vertical scanning frequency $f_V$ at which a test subject does not sense flickering is 55 kHz or higher. In consideration of the road illuminance of 60 lx at a region which a driver watches during driving, it is desirable to set the vertical scanning frequency $f_V$ at 55 kHz or higher in order to suppress the flickering occurring in a vehicle lighting fixture such as an automobile headlamp.

Secondly, when the road illuminance is 60 lx and the travelling speed is 0 km/h to 150 km/h, the vertical scanning frequency $f_V$ at which a test subject does not sense flickering is 50 kHz or higher. In consideration of the road illuminance of 60 lx at a region which a driver watches during driving, it is desirable to set the vertical scanning frequency $f_V$ at 50 kHz or higher in order to suppress the flickering occurring in a vehicle lighting fixture such as an automobile headlamp.

Thirdly, when the travelling speed is increased, the vertical scanning frequency $f_V$ at which a test subject does not sense flickering tends to increase. Taking it into consideration, it is desirable to make the vertical scanning frequency $f_V$ variable in order to suppress the occurrence of flickering in a vehicle lighting fixture such as an automobile headlamp. For example, it is desirable to increase the vertical scanning frequency $f_V$ as the travelling speed is increased.

Fourthly, when the illuminance is increased, the vertical scanning frequency $f_V$ at which a test subject does not sense flickering tends to increase. Taking it into consideration, it is desirable to make the vertical scanning frequency $f_V$ variable in order to suppress the occurrence of flickering in a vehicle lighting fixture such as an automobile headlamp. For example, it is desirable to increase the vertical scanning frequency $f_V$ as the travelling speed is increased.

Fifthly, the vertical scanning frequency $f_V$ at which a person does not sense flickering is higher at the time of stopping (0 km/h) than at the time of travelling (50 km/h to 150 km/h). Taking it into consideration, it is desirable to make the vertical scanning frequency $f_V$ variable in order to suppress the occurrence of flickering in a vehicle lighting fixture such as an automobile headlamp. For example, it is desirable to make the relationship between the vertical scanning frequency $f_V\mathbf{1}$ at the time of stopping and the vertical scanning frequency $f_V\mathbf{2}$ at the time of travelling satisfy $f_V\mathbf{1}>f_V\mathbf{2}$.

Sixthly, the vertical scanning frequency $f_V$ at which a person does not sense flickering is not higher than 70 kHz at illuminance of 60 lx, 300 lx, or 2000 lx and at the time of travelling (0 km/h to 200 km/h). Taking it into consideration, it is desirable to set the vertical scanning frequency $f_V$ to 70 kHz or higher or 70 Hz±10 Hz in order to suppress the occurrence of flickering in a vehicle lighting fixture such as an automobile headlamp.

Furthermore, the inventors of the present application has found that the frequency (the vertical scanning frequency $f_V$) of the third AC voltage to be applied to the second piezoelectric actuator 205 and 206 is set to desirably 120 Hz or lower (sawtooth wave), and more desirably 100 Hz or lower (sawtooth wave), when taking the mechanical resonance point (hereinafter referred to as V-side resonance point) of the movable frame 212 including the mirror part 202, the torsion bars 211*a* and 211*b*, and the first piezoelectric actuators 203 and 204 into consideration. The reason is as follows.

Figure 10:
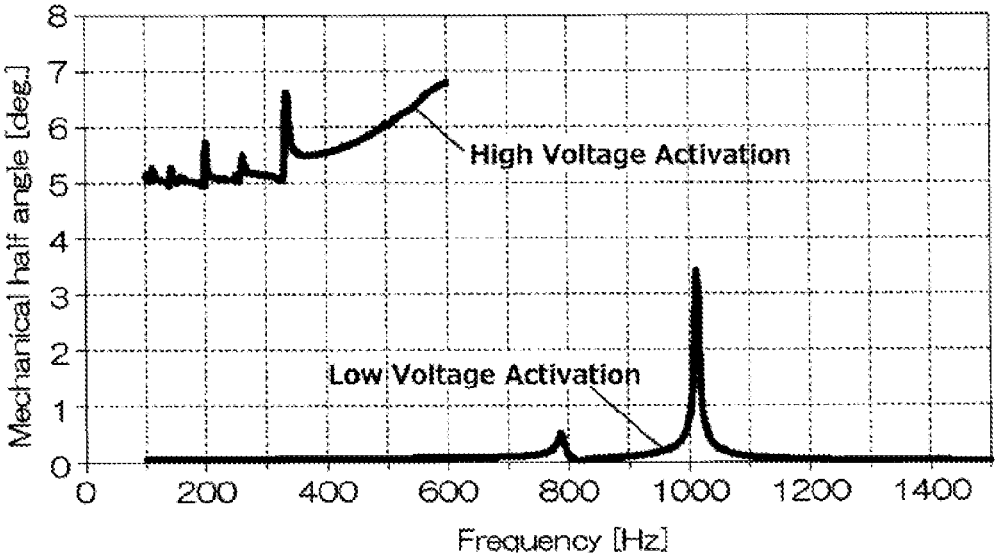
FIG. 10 is a graph showing a relationship between the swing angle and frequency of the mirror part 202.

FIG. 10 is a graph showing the relationship between the swing angle and frequency of the mirror part 202, and the vertical axis represents the swing angle and the horizontal axis represents the frequency of the applied voltage (for example, sinusoidal wave or triangle wave).

For example, when a voltage of about 2 V is applied to the second piezoelectric actuators 205 and 206 (low voltage activation), as illustrated in FIG. 10, the V-side resonance point exists near 1000 Hz and 800 Hz. On the other hand, when a high voltage of about 45 V is applied to the second piezoelectric actuators 205 and 206 (high voltage activation), the V-side resonance point exists near 350 Hz and 200 Hz at the maximum swing angle. In order to achieve the stable angular control while it periodically vibrates (swings), it is necessary to set the vertical scanning frequency $f_V$ at points other than the V-side resonance point. In view of this, the frequency of the third AC voltage to be applied to the second piezoelectric actuators 205 and 206 (the vertical scanning frequency $f_V$) is desirably 120 Hz or lower (sawtooth wave), and more desirably 100 Hz or lower (sawtooth wave). Further, when the frequency of the third AC voltage to be applied to the second piezoelectric actuators 205 and 206 (the vertical scanning frequency $f_V$) exceeds 120 Hz, the reliability, durability, life time, etc. of the optical deflector 201 deteriorate. Also in terms of this point, the frequency of the third AC voltage to be applied to the second piezoelectric actuators 205 and 206 (the vertical scanning frequency $f_V$) is desirably 120 Hz or lower (sawtooth wave), and more desirably 100 Hz or lower (sawtooth wave).

The above-described desirable vertical scanning frequencies $f_V$ have been derived for the first time by the inventors on the basis of the aforementioned findings.

Figure 11:
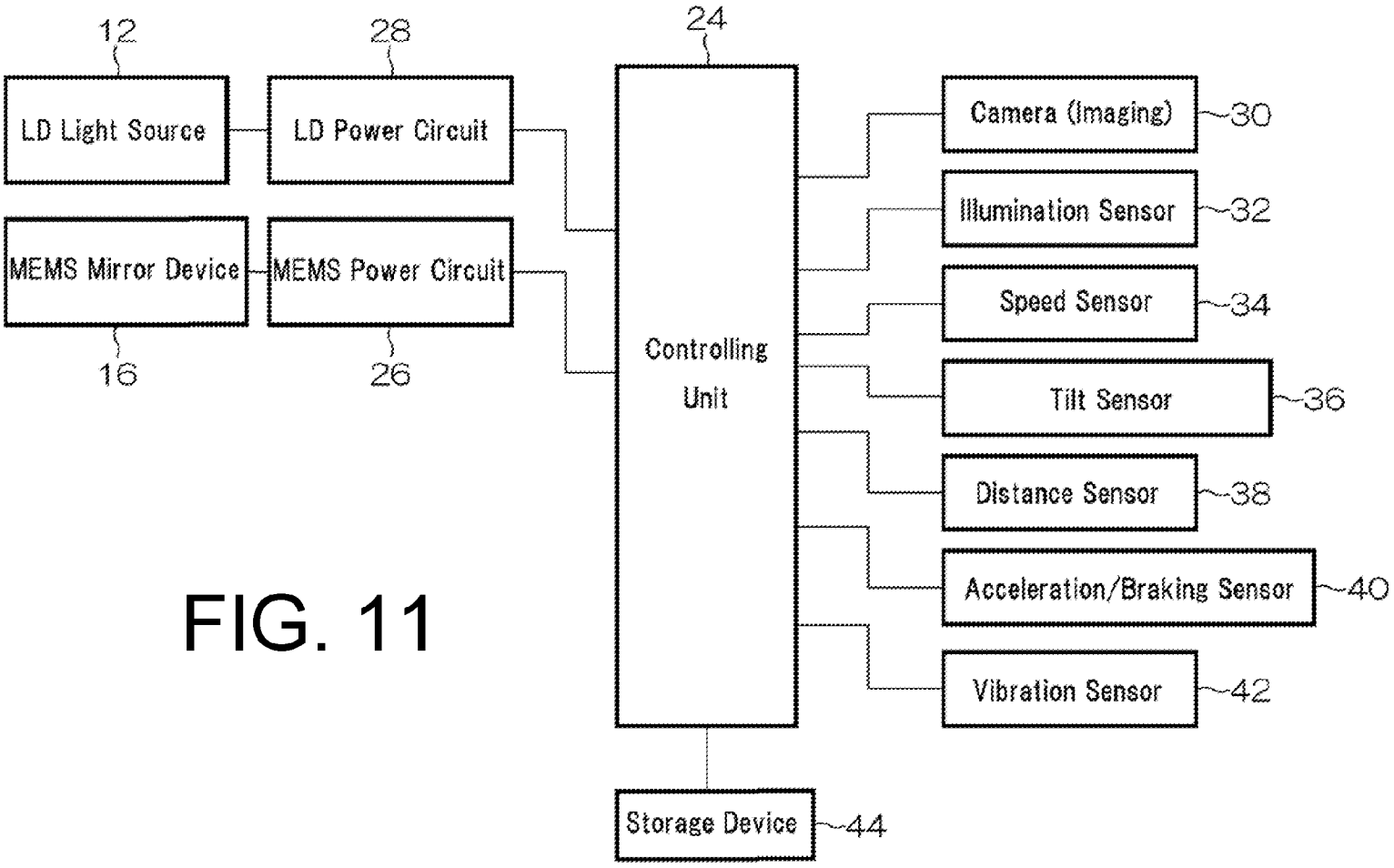
FIG. 11 is a block diagram illustrating an example of a configuration of a control system configured to control an excitation light source 12 and an optical deflector 201.

A description will next be given of the configuration example of a controlling system configured to control the excitation light source 12 and the optical deflector 201, which is illustrated in FIG. 11.

As illustrated in FIG. 11, the control system can be configured to include a controlling unit 24, and a MEMS power circuit 26, an LD power circuit 28, an imaging device 30, an illuminance sensor 32, a speed sensor 34, a tilt sensor 36, a distance sensor 38, an acceleration/braking sensor 40, a vibration sensor 42, a storage device 44, etc., which are electrically connected to the controlling unit 24.

The MEMS power circuit 26 can function as a piezoelectric actuator controlling unit (or mirror part controlling unit) in accordance with the control from the controlling unit 24. The MEMS power circuit 26 can be configured to apply the first and second AC voltages (for example, sinusoidal wave of 25 MHz) to the first piezoelectric actuators 203 and 204 to resonantly drive the first piezoelectric actuators 203 and 204, so that the mirror part 202 can be reciprocally swung around the first axis X1. The MEMS power circuit 26 can be further configured to apply the third AC voltage (for example, sawtooth wave of 55 Hz) to the second piezoelectric actuators 205 and 206 to none-resonantly drive the second piezoelectric actuators 205 and 206, so that the mirror part 202 can be reciprocally swung around the second axis X2.

Figure 12:
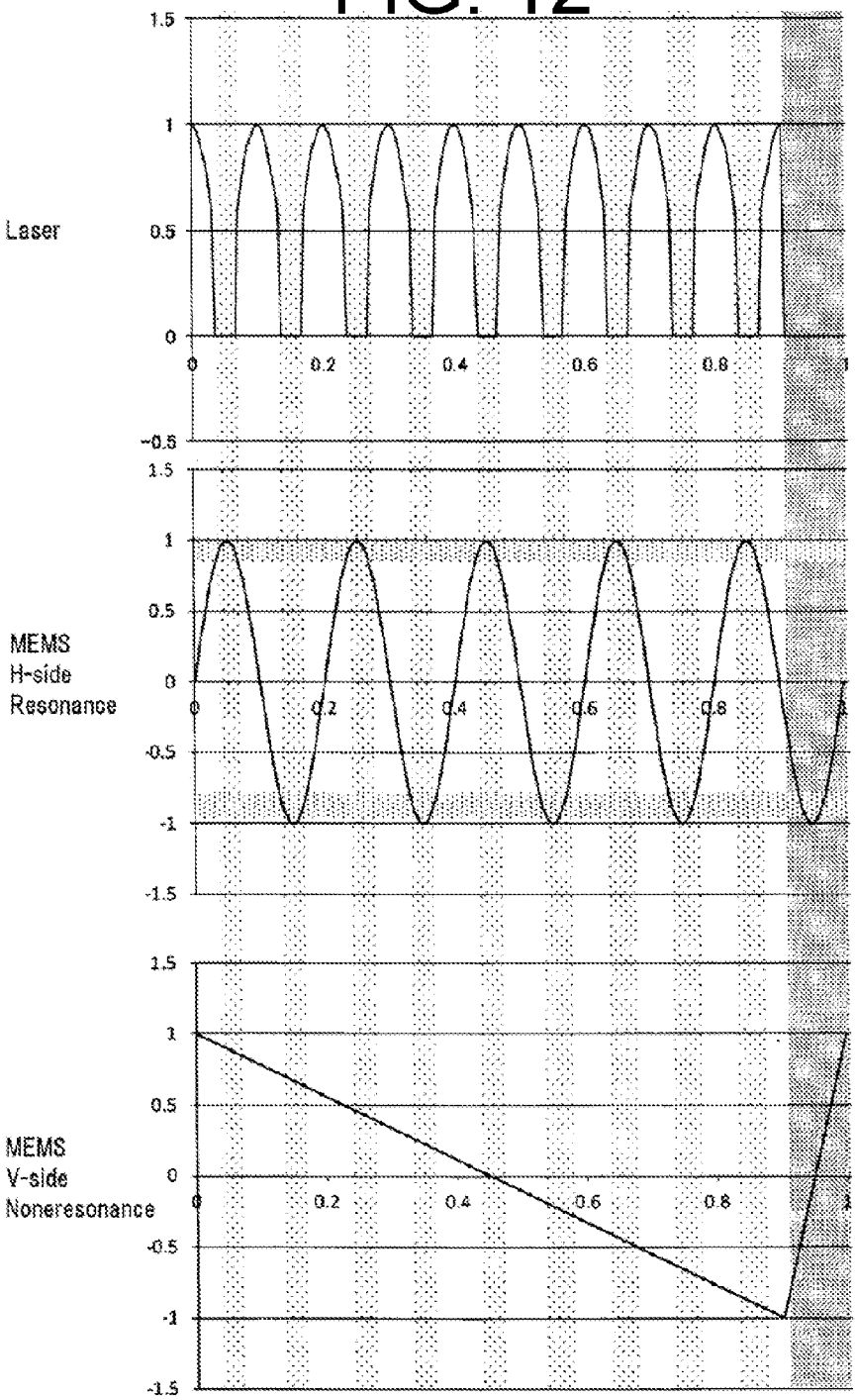
FIG. 12 includes graphs showing a state in which the excitation light source 12 (laser light) is modulated at a modulation frequency $f_L$ (25 MHz) in synchronization with the reciprocal swing of the mirror part 202 (upper graph), showing a state in which the first piezoelectric actuators 203 and 204 are applied with first and second alternating voltages (for example, sinusoidal wave of 25 MHz) (middle graph), and showing a state in which the second piezoelectric actuators 205 and 206 are applied with a third alternating voltage (for example, sawtooth wave of 55 Hz) (lower graph)

In FIG. 12, the graph at the center represents a state where the first and second AC voltages (for example, sinusoidal wave of 25 MHz) are applied to the first piezoelectric actuators 203 and 204, while the graph at the bottom represents a state where the third AC voltage (for example, sawtooth wave of 55 Hz) is applied to the second piezoelectric actuators 205 and 206. Also, in FIG. 12, the graph at the top represents a state where the excitation light source 12 emitting laser light rays is modulated at the modulation frequency $f_L$ (25 MHz) in synchronization with the reciprocating swing of the mirror part 202. Note that the shaded areas in FIG. 12 show that the excitation light source 12 is not lit.

Figure 13A:
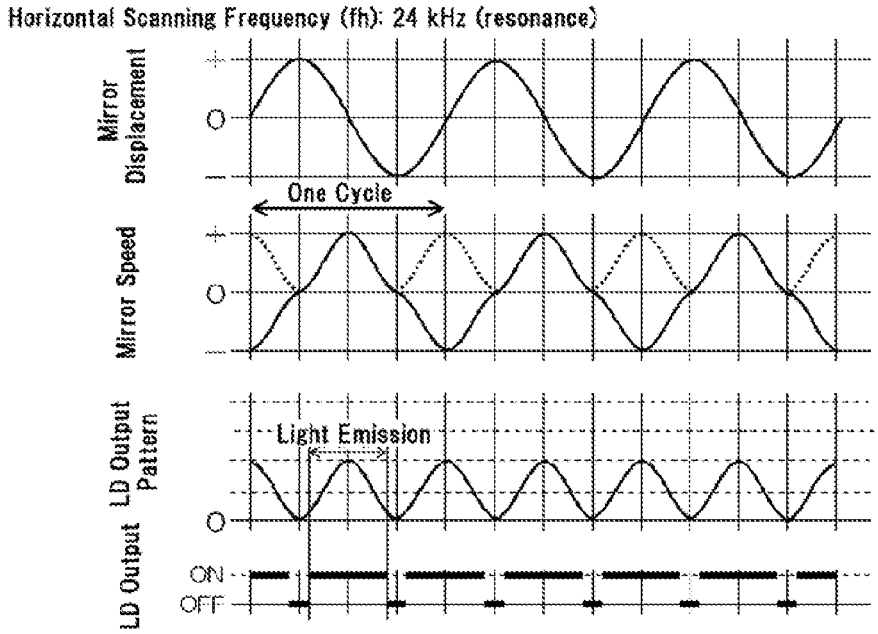
FIG. 13A includes graphs showing details of the first and second alternating voltages (for example, sinusoidal wave of 24 kHz) to be applied to the first piezoelectric actuator 203 and 204, an output pattern of the excitation light source 12 (laser light), etc., and FIG. 13B includes graphs showing details of the third alternating voltage (for example, sawtooth wave of 60 Hz) to be applied to the second piezoelectric actuator 205 and 206, an output pattern of the excitation light source 12 (laser light), etc.
Figure 13B:
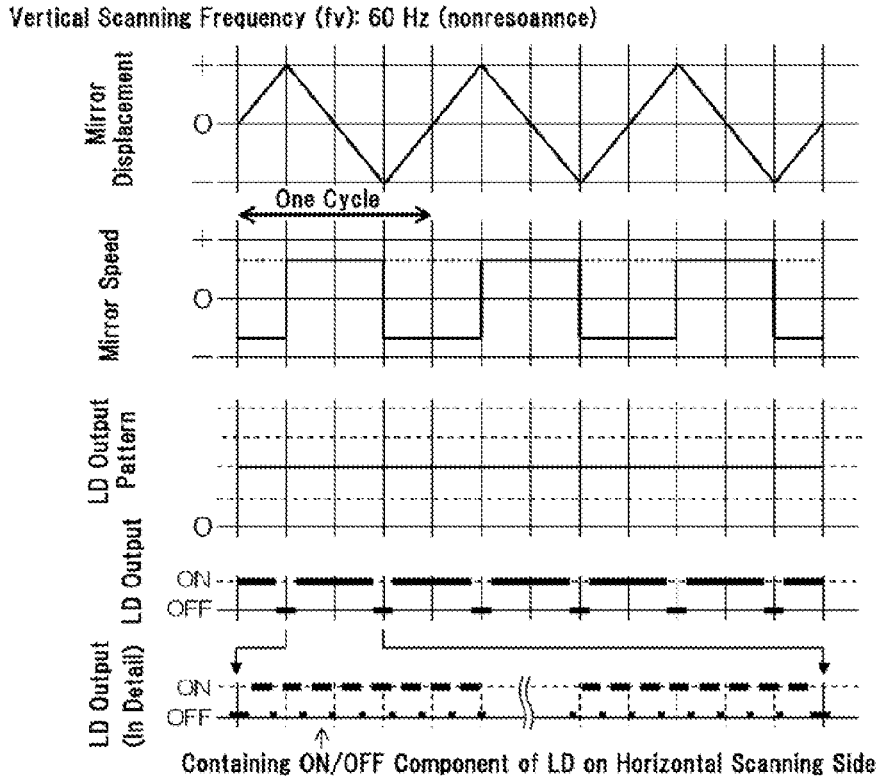

FIG. 13A includes graphs showing details of the first and second AC voltages (for example, sinusoidal wave of 24 kHz) to be applied to the first piezoelectric actuator 203 and 204, an output pattern of the excitation light source 12 (laser light), etc., and FIG. 13B includes graphs showing details of the third AC voltage (for example, sawtooth wave of 60 Hz) to be applied to the second piezoelectric actuator 205 and 206, an output pattern of the excitation light source 12 (laser light), etc.

The LD power circuit 28 can be function as a modulation unit configured to modulate the excitation light source 12 (laser light rays) in synchronization with the reciprocating swing of the mirror part 202 in accordance with the control from the controlling unit 24.

The modulation frequency (modulation rate) of the excitation light source 12 (laser light rays) can be determined by the following formula.

$$\text{Modulation Frequency } f_L = (\text{number of pixels})(\text{frame rate}; f_V)/(\text{ratio of blanking time: } Br)$$

On the basis of this formula, if the number of pixels is 300×600, $f_V$=70, and Br=0.5, then the modulation frequency $f_L$ is approximately 25 MHz=300×600×70/0.5. If the modulation frequency $f_L$ is approximately 25 MHz, the output of the excitation light source 12 can be controlled to turn ON/OFF the light source or emit light rays with various intensities in plural stepped degrees per 1/25 MHz seconds (for example, zero is minimum and a plurality of stepwisely increased intensities).

The LD power circuit 28 can modulate the excitation light source 12 (laser light rays) on the basis of a predetermined light distribution pattern (digital data) stored in the storage device 44 so that a two-dimensional image corresponding to the predetermined light distribution pattern is drawn on the wavelength conversion member 18 by means of laser light rays as excitation light with which the optical deflector 201 two-dimensionally scan (in the horizontal and vertical directions).

Examples of the predetermined light distribution pattern (digital data) may include a low-beam light distribution pattern (digital data), a high-beam distribution pattern (digital data), a highway driving light distribution pattern (digital data), and a town-area driving light distribution pattern (digital data). The predetermined light distribution patterns (digital data) can include the outer shapes of respective light distribution patterns, light intensity distributions (luminance distribution), and the like. As a result, the two-dimensional image drawn on the wavelength conversion member 18 by means of laser light rays as excitation light with which the optical deflector 201 two-dimensionally scan (in the horizontal and vertical directions) can have the outer shape corresponding to the defined light distribution pattern (for example, high-beam light distribution pattern) and the light intensity distribution (for example, the light intensity distribution with a maximum value at its center required for such a high-beam light distribution pattern). Note that the switching between various predetermined light distribution patterns (digital data) can be performed by operating a selector switch to be provided within a vehicle interior.

Figure 14A:
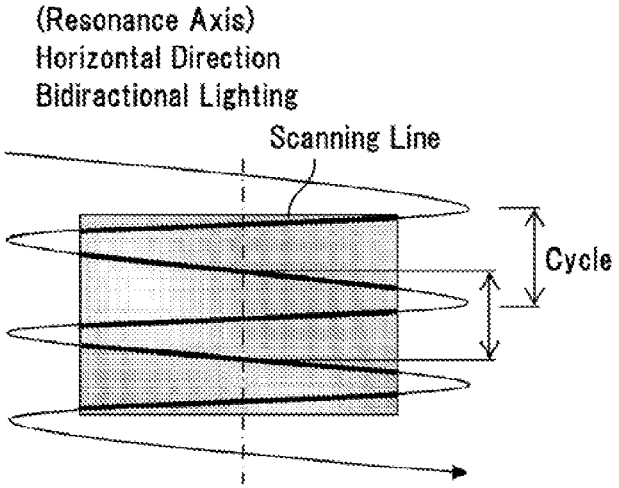
FIGS. 14A, 14B, and 14C illustrate examples of scanning patterns of laser light (spot-shaped laser light) with which the optical deflector 201 can two-dimensionally scan (in the horizontal direction and the vertical direction)
Figure 14B:
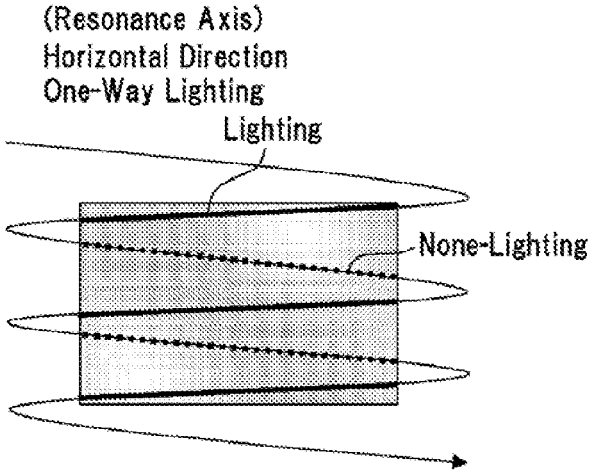
Figure 14C:
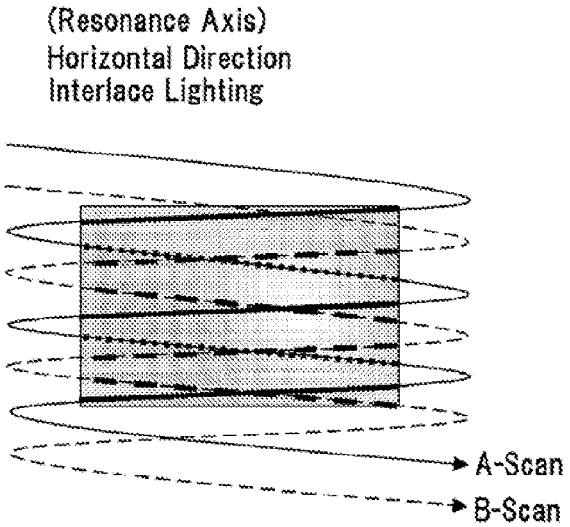

FIGS. 14A, 14B, and 14C illustrate examples of scanning patterns of laser light (spot-shaped laser light) with which the optical deflector 201 two-dimensionally scans (in the horizontal direction and the vertical direction).

Examples of the scanning patterns in the horizontal direction of laser light (spot-shaped laser light) scanning by the optical deflector 201 in a two-dimensional manner (in the horizontal direction and the vertical direction) may include the pattern with bidirectional scanning (reciprocating scanning) as illustrated in FIG. 14A and the pattern with one-way scanning (forward scanning or return scanning only) as illustrated in FIG. 14B.

Furthermore, examples of the scanning patterns in the vertical direction of laser light (spot-shaped laser light) scanning by the optical deflector 201 in a two-dimensional manner (in the horizontal direction and the vertical direction) may include the pattern densely scanned one line by one line, and the pattern scanned every other line similar to the interlace scheme as illustrated in FIG. 14C.

Figure 15A:
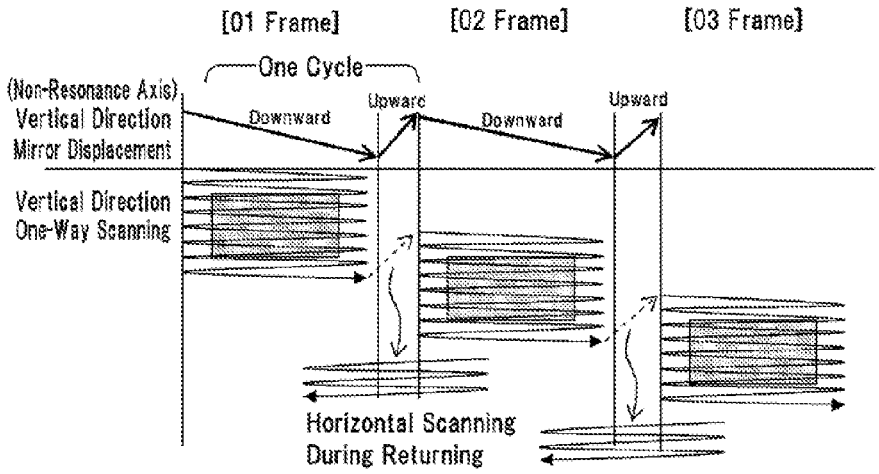
FIGS. 15A and 15B illustrate examples of scanning patterns of laser light (spot-shaped laser light) two-dimensionally scanning (in the horizontal direction and the vertical direction) by the optical deflector 201.
Figure 15B:
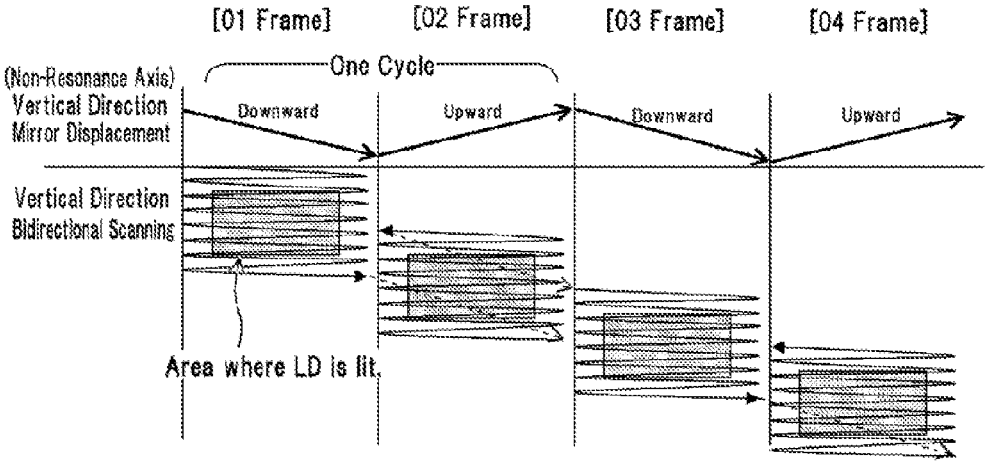

Furthermore, examples of the scanning patterns in the vertical direction of laser light (spot-shaped laser light) scanning by the optical deflector 201 in a two-dimensional manner (in the horizontal direction and the vertical direction) may include the pattern in which the optical deflector scan from the upper end to the lower end repeatedly, as illustrated in FIG. 15A, and the pattern in which the optical deflector scan from the upper end to the lower end and then from the lower end to the upper end repeatedly, as illustrated in FIG. 15B.

Incidentally, when the scanning reaches the left, right, upper, or lower end of the wavelength conversion member 18 (screen), the scanning light should be returned to the original starting point. This time period is called as blanking, during which the excitation light source 12 is not lit.

A description will next be given of other examples of control by the control system illustrated in FIG. 11.

The control system illustrated in FIG. 11 can perform various types of control other than the above-described exemplary control. For example, the control system can achieve a variable light-distribution vehicle headlamp (ADB: Adaptive Driving Beam). For example, the controlling unit 28 can determine whether an object which is prohibited from being irradiated with light (such as pedestrians and oncoming vehicles) exists within a predetermined light distribution pattern formed on a virtual vertical screen on the basis of detection results of the imaging device 30 functioning as a detector for detecting an object present in front of its vehicle body. If it is determined that the object exists within the pattern, the controlling unit 28 can control the excitation light source 12 in such a manner that the output of the excitation light source 12 is stopped or lowered during the time when a region on the wavelength conversion member 18 corresponding to a region of the light distribution pattern where the object exists is being scanned with the laser light rays as the excitation light.

Furthermore, on the basis of the finding by the inventors of the present application, i.e., on the basis of the fact where when the travelling speed is increased, the vertical scanning frequency $f_V$ at which a person does not sense flickering tends to increase, the driving frequency (vertical scanning frequency $f_V$) for nonresonantly driving the second piezoelectric actuators 205 and 206 can be changed on the basis of the travelling speed as a result of detection by the speed sensor 34 provided to the vehicle body. For example, it is possible to increase the vertical scanning frequency $f_V$ as the traveling speed increases. When doing so, the correspondence between the vertical scanning frequencies $f_V$ and the traveling speeds (or ranges of traveling speed) is stored in the storage device 44 in advance (meaning that the relationship of the increased vertical scanning frequency $f_V$ corresponding to the increased travelling speed or range is confirmed in advance). Then, the vertical scanning frequency $f_V$ is read out from the storage device 44 on the basis of the detected vehicle traveling speed detected by the speed sensor 34. After that, the MEMS power circuit 26 can apply the third AC voltage (with the read-out vertical scanning frequency) to the second piezoelectric actuators 205 and 206 to thereby nonresonantly drive the second piezoelectric actuators 205 and 206.

Furthermore, on the basis of the finding by the inventors of the present application, i.e. on the basis of the fact where the vertical scanning frequency $f_V$ at which a person does not sense flickering is higher at the time of stopping (0 km/h) than at the time of travelling (50 km/h to 150 km/h), the vertical scanning frequency $f_V$ at the time of stopping (0 km/h) can be increased as compared with that at the time of travelling (50 km/h to 150 km/h). This can be achieved by the following method. That is, for example, the vertical scanning frequency $f_V$1 at the time of stopping and the vertical scanning frequency $f_V$2 at the time of traveling are stored in the storage device 44 in advance ($f_V$1>$f_V$2), and it is determined that the vehicle body is stopped or not on the basis of the detection results from the speed sensor 34. When it is determined that the vehicle body is traveling, the vertical scanning frequency $f_V$2 at the time of traveling is read out from the storage device 44. After that, the MEMS power circuit 26 can apply the third AC voltage (with the read-out vertical scanning frequency $f_V$2 at the time of traveling) to the second piezoelectric actuators 205 and 206 to thereby nonresonantly drive the second piezoelectric actuators 205 and 206.

On the other hand, when it is determined that the vehicle body is stopped, the vertical scanning frequency $f_V$1 at the time of stopping is read out from the storage device 44. After that, the MEMS power circuit 26 can apply the third AC voltage (with the read-out vertical scanning frequency $f_V$1 at the time of stopping) to the second piezoelectric actuators 205 and 206 to thereby nonresonantly drive the second piezoelectric actuators 205 and 206.

Furthermore, on the basis of the finding by the inventors of the present application, i.e. on the basis of the fact where when the illuminance is increased, the vertical scanning frequency $f_V$ at which a person does not sense flickering tends to increase, the driving frequency (vertical scanning frequency $f_V$) for nonresonantly driving the second piezoelectric actuators 205 and 206 can be changed on the basis of the illuminance detected by the illumination sensor 32 provided to the vehicle body (for example, the illuminance sensed by a driver). For example, it is possible to increase the vertical scanning frequency $f_V$ as the illuminance increases. When doing so, the correspondence between the vertical scanning frequencies $f_V$ and the illuminances (or ranges of illuminance) is stored in the storage device 44 in advance (meaning that the relationship of the increased vertical scanning frequency $f_V$ corresponding to the increased illuminance or range is confirmed in advance). Then, the vertical scanning frequency $f_V$ is read out from the storage device 44 on the basis of the detected illuminance value detected by the illuminance sensor 32. After that, the MEMS power circuit 26 can apply the third AC voltage (with the read-out vertical scanning frequency) to the second piezoelectric actuators 205 and 206 to thereby nonresonantly drive the second piezoelectric actuators 205 and 206.

In the same manner, the driving frequency (vertical scanning frequency $f_V$) for nonresonantly driving the second piezoelectric actuators 205 and 206 can be changed on the basis of the distance between the vehicle body and an object to be irradiated with light detected by the distance sensor 38 provided to the vehicle body.

In the same manner, the driving frequency (vertical scanning frequency $f_V$) for nonresonantly driving the second piezoelectric actuators 205 and 206 can be changed on the basis of the detection results by the vibration sensor 42 provided to the vehicle body.

In the same manner, the driving frequency (vertical scanning frequency $f_V$) for nonresonantly driving the second piezoelectric actuators 205 and 206 can be changed according to a predetermined light distribution pattern. For example, the driving frequency (vertical scanning frequency $f_V$) for nonresonantly driving the second piezoelectric actuators 205 and 206 can be changed between the highway driving light distribution pattern and the town-area driving light distribution pattern.

By making the vertical scanning frequency $f_V$ variable as described above, the optical deflector 201 can be improved in terms of the reliability, durability, life time, etc. when compared with the case where the driving frequency for nonresonantly driving the second piezoelectric actuators 205 and 206 is made constant.

In place of the one-dimensional nonresonance/one-dimensional resonance type (2-D optical scanner (fast resonant and slow static combination)) of optical deflector 201 with the above-described configuration, a two-dimensional nonresonance type optical deflector 161 can be utilized.

<Two-Dimensional Nonresonance Type>

Figure 16:
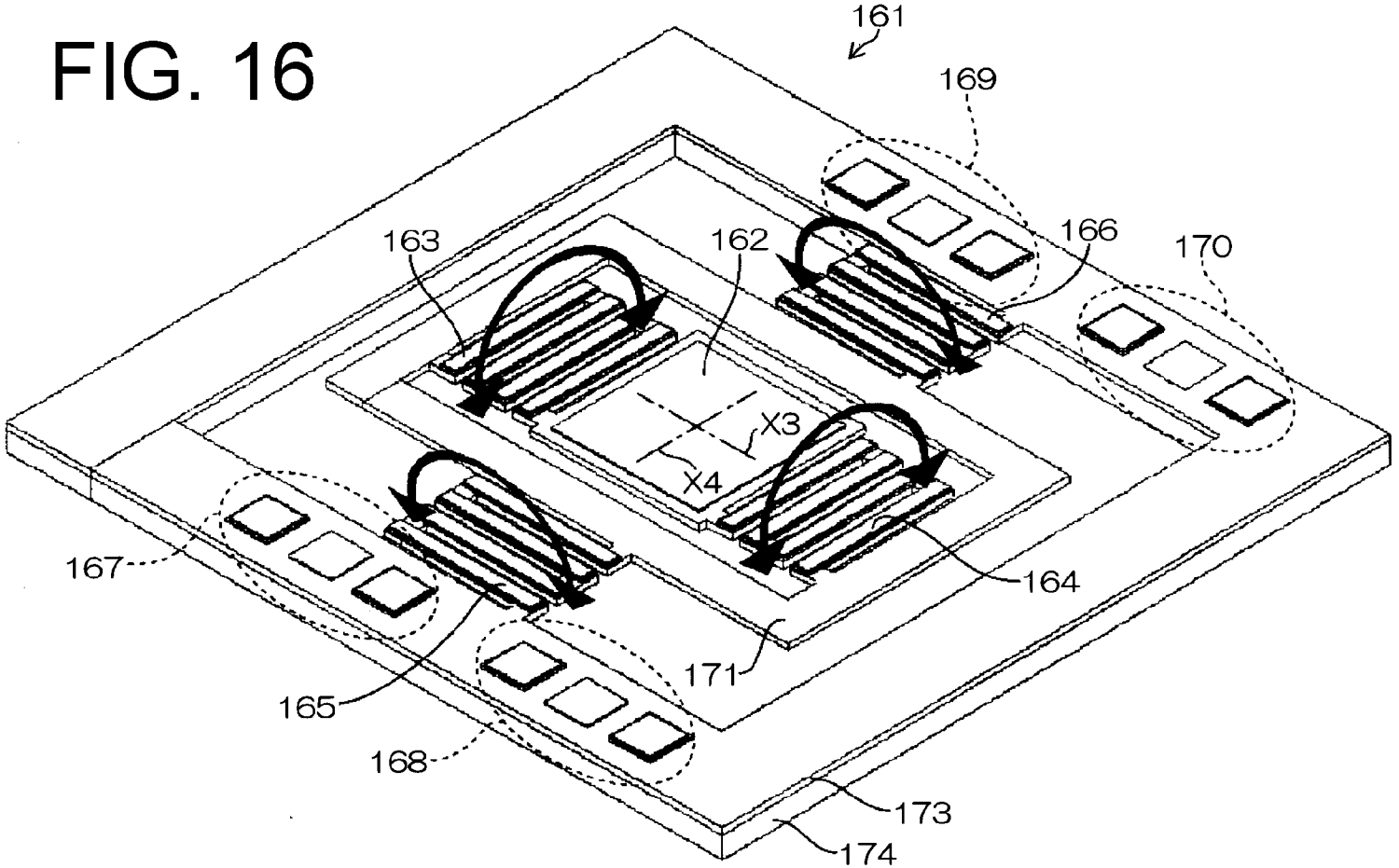
FIG. 16 is a perspective view of an optical deflector 161 of a two-dimensional nonresonance type.

FIG. 16 is a perspective view of an optical deflector 161 of a two-dimensional nonresonance type.

As illustrated in FIG. 16, the optical deflector 161 of the two-dimensional nonresonance type can be configured to include a mirror part 162 (referred to as a MEMS mirror), piezoelectric actuators 163 to 166 configured to drive the mirror part 162, a movable frame 171 configured to support the piezoelectric actuators 163 to 166, and a base 174.

The configuration and action of the piezoelectric actuators 163 to 166 can be the same as those of the second piezoelectric actuators 205 and 206 of the optical deflector 201 of the one-dimensional nonresonance/one-dimensional resonance type.

In the present reference example, each of first piezoelectric actuators 163 and 164 out of the piezoelectric actuators 163 to 166 can be applied with a first AC voltage as its driving voltage. At this time, the applied voltage can be an alternating voltage with a frequency equal to or lower than a predetermined value that is smaller than the mechanical resonance frequency (first resonance point) of the mirror part 162 to thereby nonresonantly drive the first piezoelectric actuators 163 and 164. This can cause the mirror part 162 to be reciprocately swung around the third axis X3 with respect to the movable frame 171, so that the excitation light rays that are emitted from the excitation light source 12 and incident on the mirror part 162 can scan in a first direction (for example, horizontal direction).

Furthermore, a second AC voltage can be applied to each of the second piezoelectric actuators 165 and 166 as a drive voltage. At this time, the applied voltage can be an alternating voltage with a frequency equal to or lower than a predetermined value that is smaller than the mechanical resonance frequency (first resonance point) of the movable frame 171 including the mirror part 162 and the first piezoelectric actuators 165 and 166 to thereby nonresonantly drive the second piezoelectric actuators 165 and 166. This can cause the mirror part 162 to be reciprocately swung around the fourth axis X4 with respect to the base 174, so that the excitation light rays that are emitted from the excitation light source 12 and incident on the mirror part 162 can scan in a second direction (for example, vertical direction).

Figure 17A:
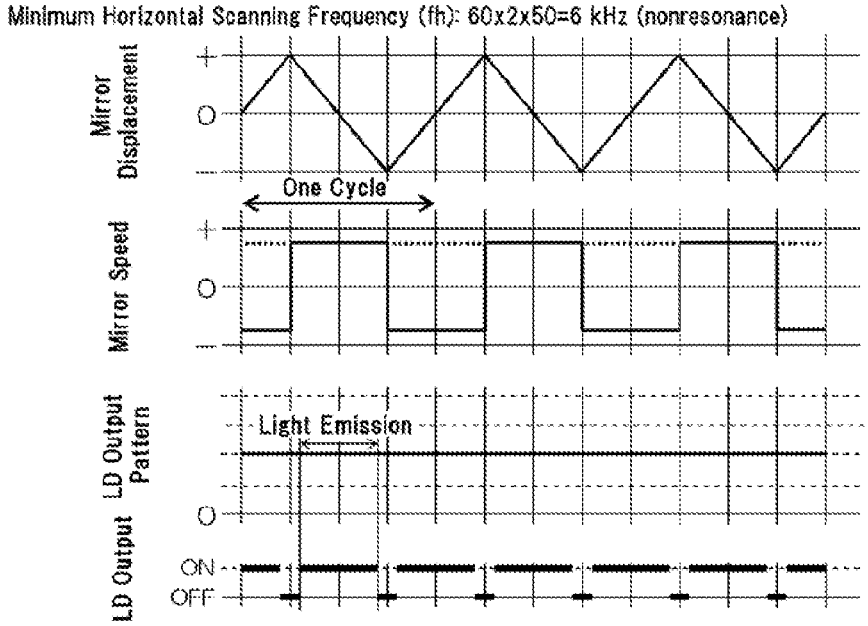
FIG. 17A includes graphs showing details of the first alternating voltage (for example, sawtooth wave of 6 kHz) to be applied to first piezoelectric actuators 163 and 164, an output pattern of the excitation light source 12 (laser light), etc., and FIG. 17B includes graphs showing details of the third alternating voltage (for example, sawtooth wave of 60 Hz) to be applied to second piezoelectric actuators 165 and 166, an output pattern of the excitation light source 12 (laser light), etc.
Figure 17B:
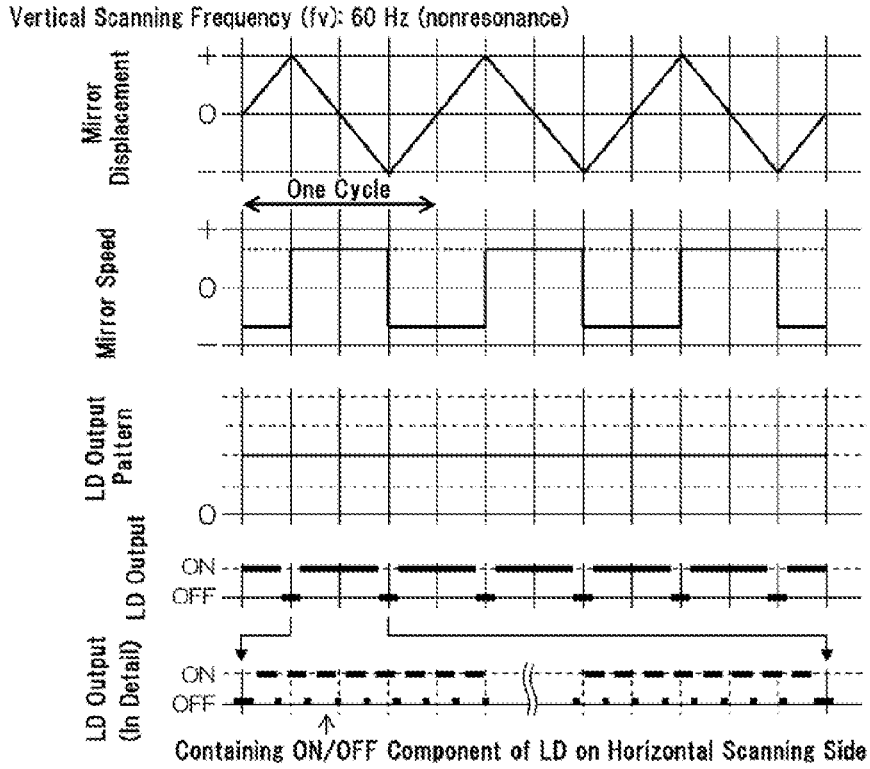

FIG. 17A includes graphs showing details of the first alternating voltage (for example, sawtooth wave of 6 kHz) to be applied to the first piezoelectric actuator 163 and 164, an output pattern of the excitation light source 12 (laser light), etc., and FIG. 17B includes graphs showing details of the third alternating voltage (for example, sawtooth wave of 60 Hz) to be applied to the second piezoelectric actuator 165 and 166, an output pattern of the excitation light source 12 (laser light), etc.

The respective piezoelectric actuators 163 to 166 can be driven in the manner described above, so that the laser light as the excitation light rays from the excitation light source 12 can scan two-dimensionally (in the horizontal and vertical directions).

In place of the one-dimensional nonresonance/one-dimensional resonance type (2-D optical scanner (fast resonant and slow static combination)) of optical deflector 201 with the above-described configuration, a two-dimensional resonance type optical deflector 201A can be utilized.

<Two-Dimensional Resonance Type>

Figure 18:
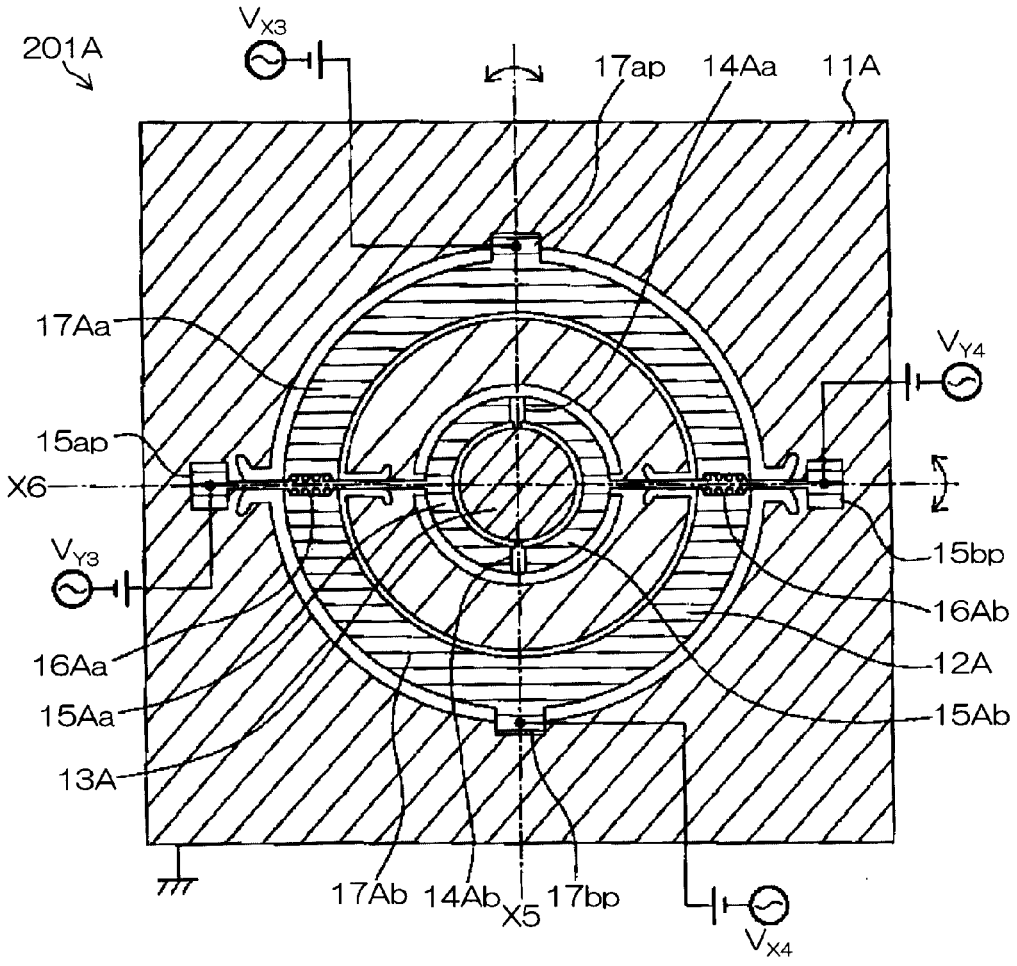
FIG. 18 is a plan view illustrating an optical deflector 201A of a two-dimensional resonance type.

FIG. 18 is a perspective view of an optical deflector 201A of a two-dimensional resonance type.

As illustrated in FIG. 18, the optical deflector 201A of the two-dimensional resonance type can be configured to include a mirror part 13A (referred to as a MEMS mirror), first piezoelectric actuators 15Aa and 15Ab configured to drive the mirror part 13A via torsion bars 14Aa and 14Ab, a movable frame 12A configured to support the first piezoelectric actuators 15Aa and 15Ab, second piezoelectric actuators 17Aa and 17Ab configured to drive the movable frame 12A, and a base 11A configured to support the second piezoelectric actuators 17Aa and 17Ab.

The configuration and action of the piezoelectric actuators 15Aa, 15Ab, 17Aa, and 17Ab can be the same as those of the first piezoelectric actuators 203 and 204 of the optical deflector 201 of the one-dimensional nonresonance/one-dimensional resonance type.

In the present reference example, the first piezoelectric actuator 15Aa can be applied with a first AC voltage as its driving voltage while the other first piezoelectric actuator 15Ab can be applied with a second AC voltage as its driving voltage. Here, the first AC voltage and the second AC voltage can be different from each other in phase, such as a sinusoidal wave with an opposite phase or shifted phase. In this case, an AC voltage with a frequency close to a mechanical resonance frequency (first resonance point) of the mirror part 13A including the torsion bars 14Aa and 14Ab can be applied to resonantly drive the first piezoelectric actuators 15Aa and 15Ab. This can cause the mirror part 13A to be reciprocately swung around the fifth axis X5 with respect to the movable frame 12A, so that the laser light rays that are emitted from the excitation light source 12 and incident on the mirror part 13A can scan in a first direction (for example, horizontal direction).

A third AC voltage can be applied to the second piezoelectric actuator 17Aa as a drive voltage while a fourth AC voltage can be applied to the other second piezoelectric actuator 17Ab as a drive voltage. Here, the third AC voltage and the fourth AC voltage can be different from each other in phase, such as a sinusoidal wave with an opposite phase or shifted phase. In this case, an AC voltage with a frequency near the mechanical resonance frequency (first resonance point) of the movable frame 12A including the mirror part 13A and the first piezoelectric actuators 15Aa and 15Ab can be applied to resonantly drive the first piezoelectric actuators 17Aa and 17Ab. This can cause the mirror part 13A to be reciprocately swung around the sixth axis X6 with respect to the base 11A, so that the laser light rays that are emitted from the excitation light source 12 as excitation light rays and incident on the mirror part 13A can scan in a second direction (for example, vertical direction).

Figure 19A:
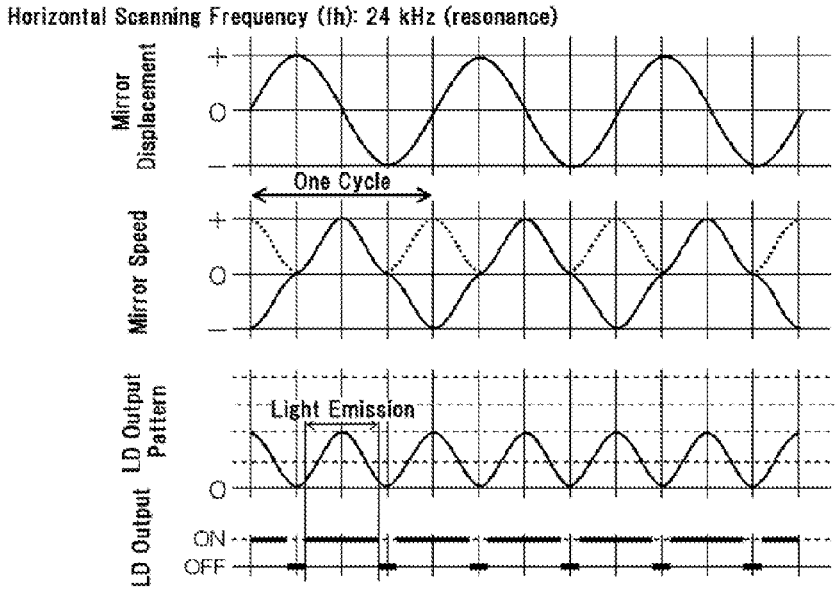
FIG. 19A includes graphs showing details of the first alternating voltage (for example, sinusoidal wave of 24 kHz) to be applied to first piezoelectric actuators 15Aa and 15Ab, an output pattern of the excitation light source 12 (laser light), etc., and FIG. 19B includes graphs showing details of the third alternating voltage (for example, sinusoidal wave of 12 Hz) to be applied to second piezoelectric actuators 17Aa and 17Ab, an output pattern of the excitation light source 12 (laser light), etc.
Figure 19B:
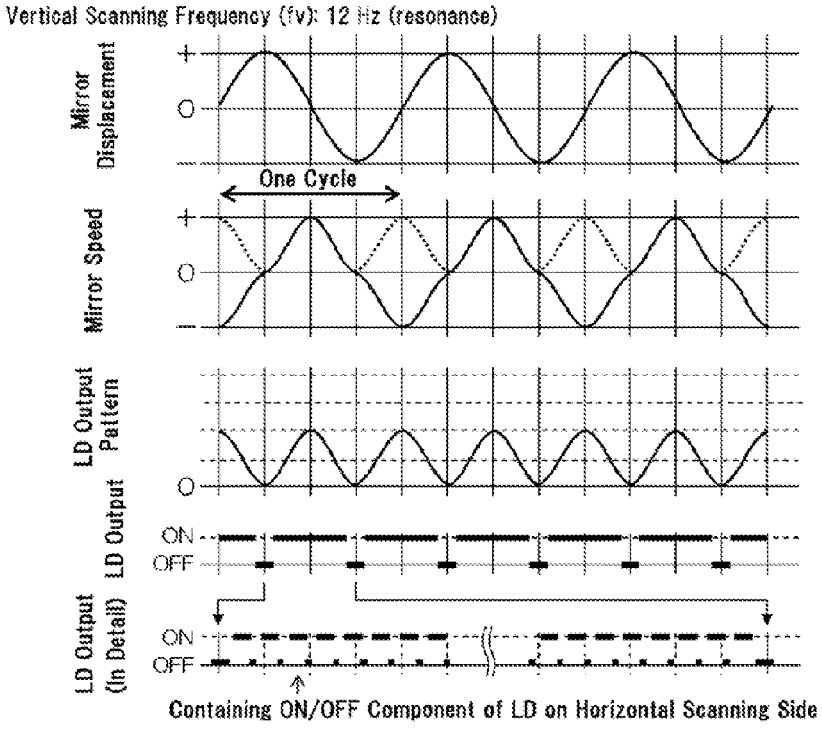

FIG. 19A includes graphs showing details of the first AC voltage (for example, sinusoidal wave of 24 kHz) to be applied to the first piezoelectric actuators 15Aa and 15Ab, an output pattern of the excitation light source 12 (laser light), etc., and FIG. 19B includes graphs showing details of the third AC voltage (for example, sinusoidal wave of 12 Hz) to be applied to the second piezoelectric actuators 17Aa and 17Ab, an output pattern of the excitation light source 12 (laser light), etc.

The respective piezoelectric actuators 15Aa, 15Ab, 17Aa, and 17Ab can be driven in the manner described above, so that the laser light from the excitation light source 12 as the excitation light rays can scan two-dimensionally (in the horizontal and vertical directions).

As described above, according to the present reference example, even when frequencies remarkably lower than 220 Hz that is considered to cause the occurrence of flickering in vehicle lighting fixtures such as an automobile headlamp are utilized, or frame rates remarkably lower than 220 fps, i.e., "55 fps or more," "55 fps to 120 fps," "55 fps to 100 fps," or "70 fps±10 fps" are utilized, the occurrence of flickering can be suppressed.

Furthermore, according to the present reference example, frequencies remarkably lower than 220 Hz are utilized (or frame rates remarkably lower than 220 fps), i.e., "55 fps or more," "55 fps to 120 fps," "55 fps to 100 fps," or "70 fps±10 fps" are utilized, it is possible to improve the reliability, durability, and life time of the optical deflector 201 and the like when compared with the case where the frequency of 220 Hz or higher or frame rates of 220 fps or more are used.

Furthermore, according to the present reference example, the drive frequency used for nonresonantly driving the second piezoelectric actuators 205 and 206 can be made variable, and therefore, the reliability, durability, and life time of the optical deflector 201 and the like can be improved when compared with the case where the drive frequency used for nonresonantly driving the second piezoelectric actuators 205 and 206 are constant.

A description will now be given of a vehicle lighting unit using three optical deflectors 201 of one-dimensional nonresonance/one-dimensional resonance type (2-D optical scanner (fast resonant and slow static combination)) with reference to the associated drawings as a second reference example. It is appreciated that the aforementioned various types of optical deflectors discussed in the above reference example can be used in place of the one-dimensional nonresonance/one-dimensional resonance type optical deflector 201.

Figure 21:
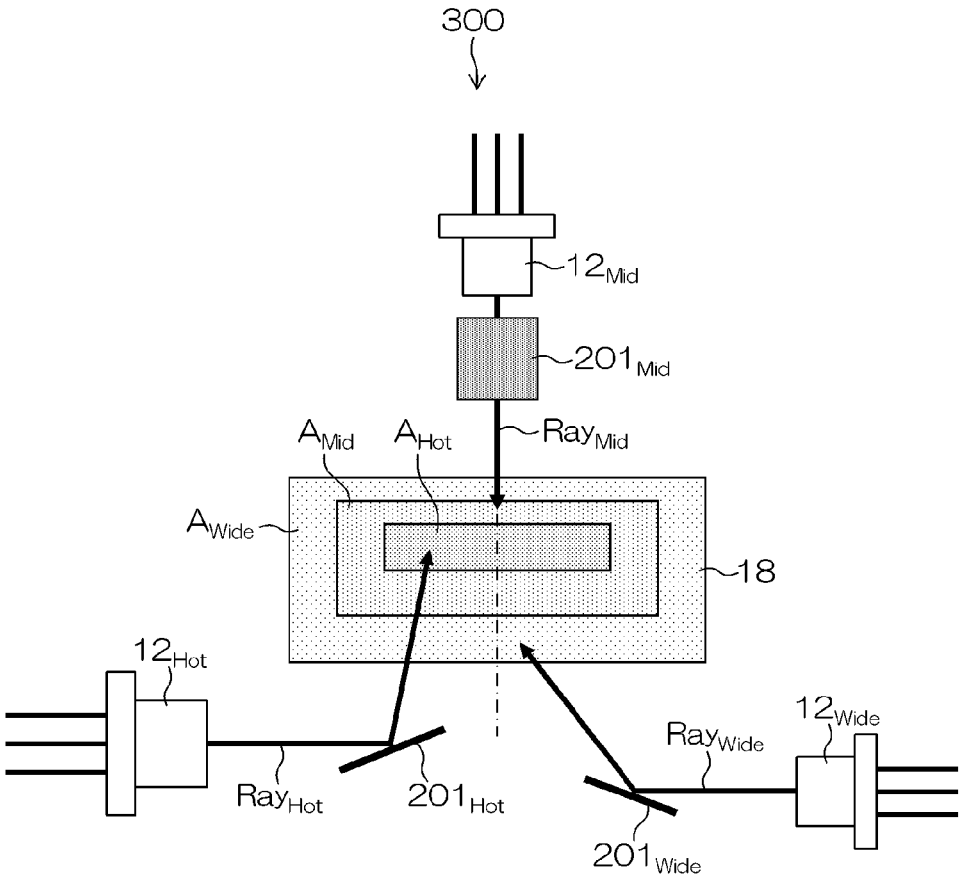
FIG. 21 is a schematic diagram illustrating a vehicle lighting fixture 300 according to a second reference example.
Figure 22:
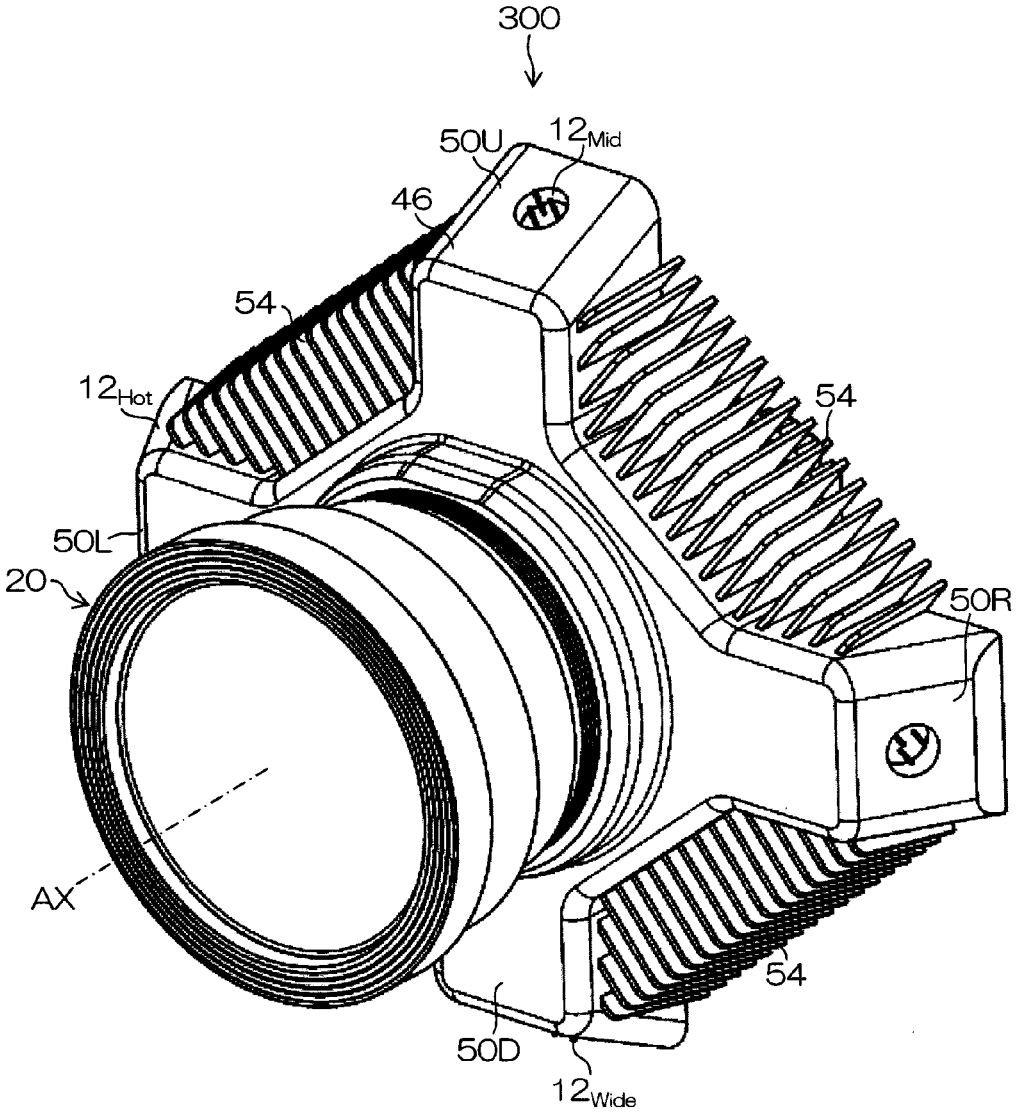
FIG. 22 is a perspective view illustrating the vehicle lighting fixture 300.
Figure 23:
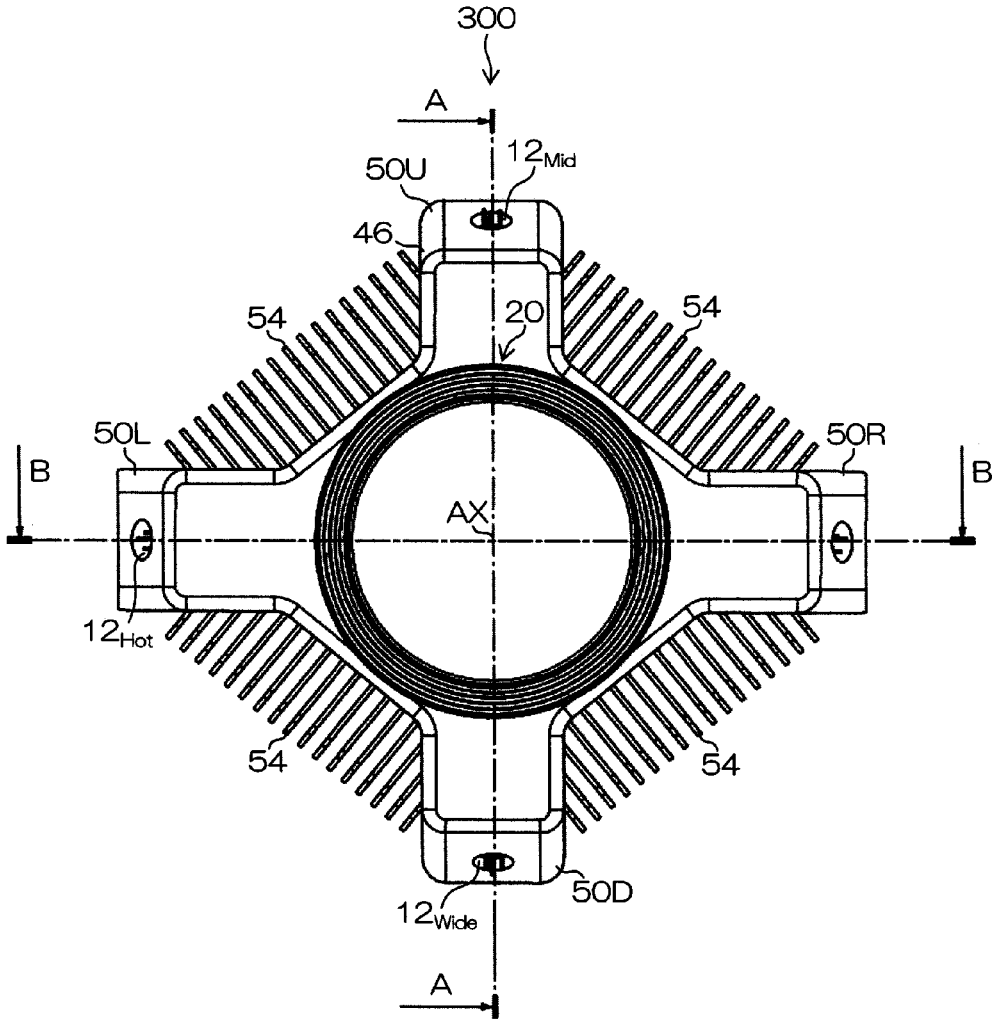
FIG. 23 is a front view illustrating the vehicle lighting fixture 300.
Figure 24:
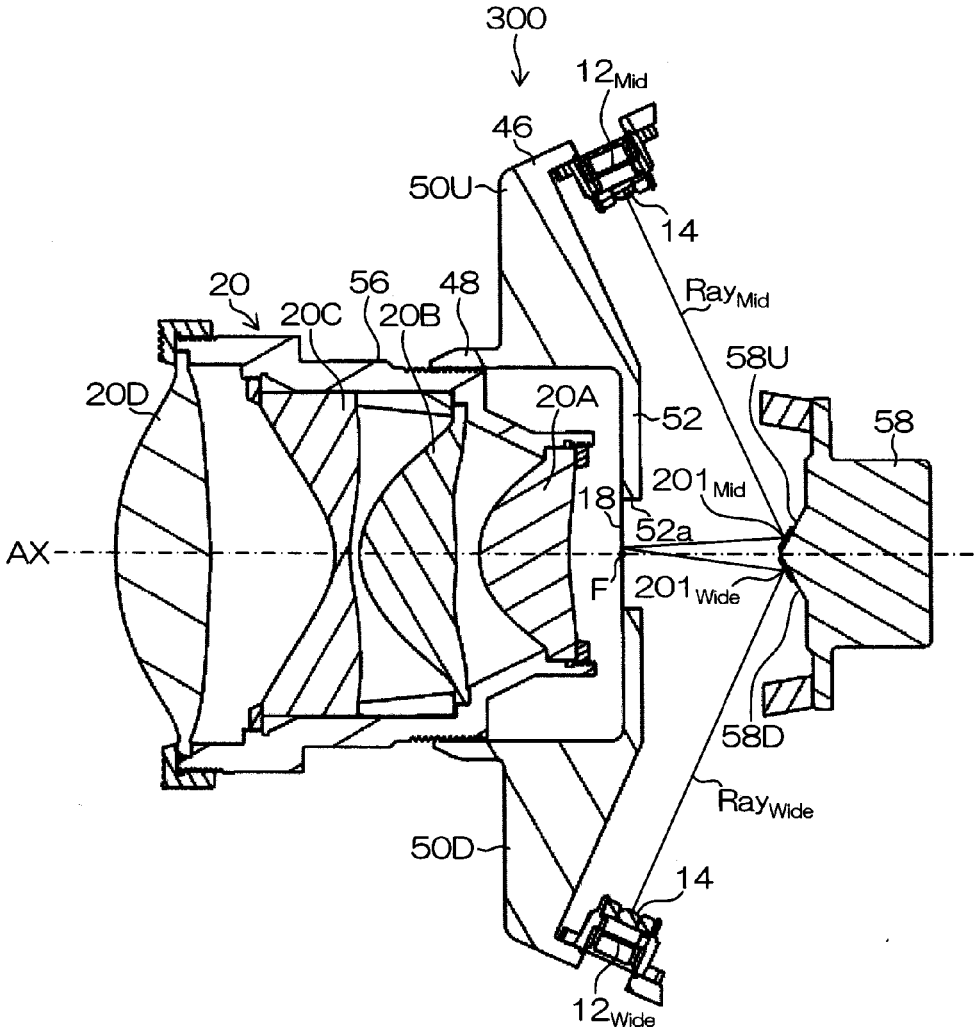
FIG. 24 is a cross-sectional view of the vehicle lighting fixture 300 of FIG. 23 taken along line A-A.
Figure 25:
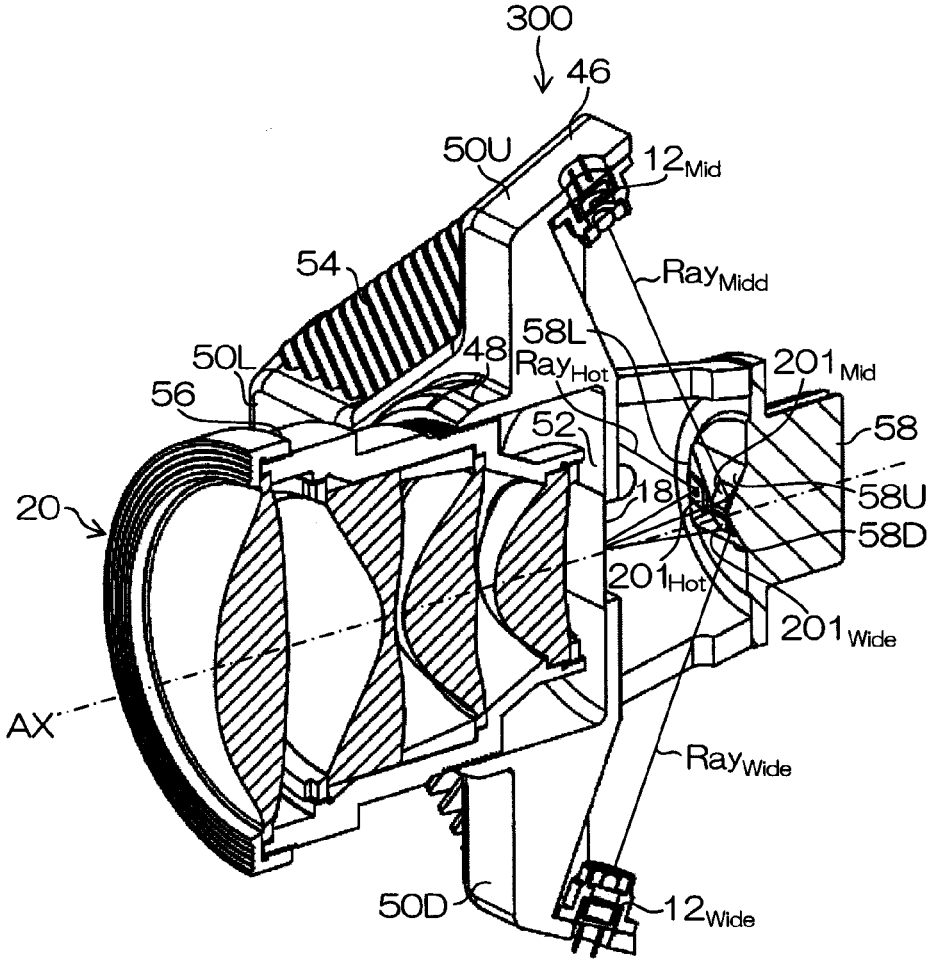
FIG. 25 is a perspective view including the cross-sectional view of FIG. 24 illustrating the vehicle lighting fixture 300 of FIG. 23 taken along line A-A.
Figure 26:
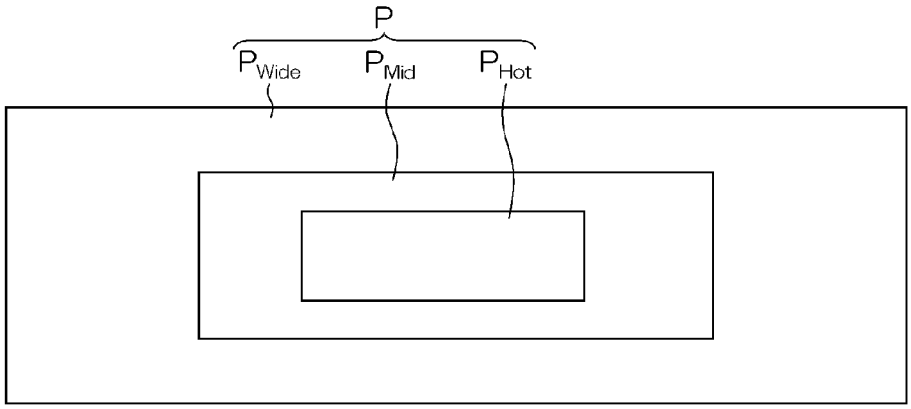
FIG. 26 is a diagram illustrating a predetermined light distribution pattern P formed on a virtual vertical screen (assumed to be disposed in front of a vehicle body approximately 25 m away from the vehicle front face) by the vehicle lighting fixture 300 of the present reference example.

FIG. 21 is a schematic diagram illustrating a vehicle lighting fixture 300 according to the second reference example. FIG. 22 is a perspective view illustrating the vehicle lighting fixture 300. FIG. 23 is a front view illustrating the vehicle lighting fixture 300. FIG. 24 is a cross-sectional view of the vehicle lighting fixture 300 of FIG. 23 taken along line A-A. FIG. 25 is a perspective view including the cross-sectional view of FIG. 24 illustrating the vehicle lighting fixture 300 of FIG. 23 taken along line A-A. FIG. 26 is a diagram illustrating a predetermined light distribution pattern P formed on a virtual vertical screen (assumed to be disposed in front of a vehicle body approximately 25 m away from the vehicle front face) by the vehicle lighting fixture 300 of the present reference example.

As illustrated in FIG. 26, the vehicle lighting fixture 300 of the present reference example can be configured to form a predetermined light distribution pattern P (for example, high-beam light distribution pattern) excellent in far-distance visibility and sense of light distribution. The predetermined light distribution pattern P can be configured such that the center light intensity ($P_{Hot}$) is relatively high and the light intensity is gradually lowered from the center to the periphery ($P_{Hot} \rightarrow P_{Mid} \rightarrow P_{Wide}$).

Next, the vehicle lighting fixture 300 of the present reference example will be compared with the vehicle lighting fixture 10 of the above-described reference example. In the above-described reference example as illustrated in FIG. 2, the vehicle lighting fixture 10 can include a single excitation light source 12 and a single optical deflector 201. In the present reference example as illustrated in FIG. 21, the vehicle lighting fixture 300 can include three excitation light source (wide-zone excitation light source $\mathbf{12}_{Wide}$, middle-zone excitation light source $\mathbf{12}_{Mid}$, and hot-zone excitation light source $\mathbf{12}_{Hot}$), and three optical deflectors (wide-zone optical deflector $\mathbf{201}_{Wide}$, middle-zone optical deflector $\mathbf{201}_{Mid}$, and hot-zone optical deflector $\mathbf{201}_{Hot}$), which is the different feature from the above-described reference example.

The configuration of the vehicle lighting fixture 300 of the present reference example can have the same configuration as that of the vehicle lighting fixture 10 of the above-described reference example except for the above different point. Hereinbelow, a description will be give of the different point of the present reference example from the above-described reference example, and the same or similar components of the present reference example as those in the above-described reference example will be denoted by the same reference numerals and a description thereof will be omitted as appropriate.

In the specification, the term "hot-zone" member/part means a member/part for use in forming a hot-zone partial light distribution pattern (with highest intensity), the term "middle-zone" member/part means a member/part for use in forming a middle-zone partial light distribution pattern (diffused more than the hot-zone partial light distribution pattern), and the term "wide-zone" member/part means a member/part for use in forming a wide-zone partial light distribution pattern (diffused more than the middle-zone partial light distribution pattern), unless otherwise specified.

The vehicle lighting fixture 300 can be configured, as illustrated in FIGS. 21 to 25, as a vehicle headlamp. The vehicle lighting fixture 300 can include three excitation light sources $\mathbf{12}_{Wide}$, $\mathbf{12}_{Mid}$, and $\mathbf{12}_{Hot}$, three optical deflectors $\mathbf{201}_{Wide}$, $\mathbf{201}_{Mid}$, and $\mathbf{201}_{Hot}$ each including a mirror part 202, a wavelength conversion member 18, a projector lens assembly 20, etc. The three optical deflectors $\mathbf{201}_{Wide}$, $\mathbf{201}_{Mid}$, and $\mathbf{201}_{Hot}$ can be provided corresponding to the three excitation light sources $\mathbf{12}_{Wide}$, $\mathbf{12}_{Mid}$, and $\mathbf{12}_{Hot}$. The wavelength conversion member 18 can include three scanning regions $A_{Wide}$, $A_{Mid}$, and $A_{Hot}$ (see FIG. 21) provided corresponding to the three optical deflectors $\mathbf{201}_{Wide}$, $\mathbf{201}_{Mid}$, and $\mathbf{201}_{Hot}$. Partial light intensity distributions can be formed within the respective scanning regions $A_{Wide}$, $A_{Mid}$, and $A_{Hot}$, and can be projected through the projector lens assembly 20 serving as an optical system for forming the predetermined light distribution pattern P. Note that the number of the excitation light sources 12, the optical deflectors 201, and the scanning regions A is not limited to three, and may be two or four or more.

As illustrated in FIG. 24, the projector lens assembly 20, the wavelength conversion member 18, and the optical deflectors $\mathbf{201}_{Wide}$, $\mathbf{201}_{Mid}$, and $\mathbf{201}_{Hot}$ can be disposed in this order along a reference axis AX (or referred to as an optical axis) extending in the front-rear direction of a vehicle body.

The vehicle lighting fixture 300 can further include a laser holder 46. The laser holder 46 can be disposed to surround the reference axis AX and can hold the excitation light sources $\mathbf{12}_{Wide}$, $\mathbf{12}_{Mid}$, and $\mathbf{12}_{Hot}$ with a posture tilted in such a manner that excitation light rays $Ray_{Wide}$, $Ray_{Mid}$, and $Ray_{Hot}$ emitted from the respective excitation light sources $\mathbf{12}_{Wide}$, $\mathbf{12}_{Mid}$, and $\mathbf{12}_{Hot}$ are directed rearward and toward the reference axis AX.

Specifically, the excitation light sources $\mathbf{12}_{Wide}$, $\mathbf{12}_{Mid}$, and $\mathbf{12}_{Hot}$ can be disposed by being fixed to the laser holder 46 in the following manner.

As illustrated in FIG. 23, the laser holder 46 can be configured to include a tubular part 48 extending in the reference axis AX, and extension parts 50U, 50D, 50L, and 50R each radially extending from the outer peripheral face of the tubular part 48 at its upper, lower, left, or right part in an upper, lower, left, or right direction perpendicular to the reference axis AX. Specifically, the respective extension parts 50U, 50D, 50L, and 50R can be inclined rearward to the tip ends thereof, as illustrated in FIG. 24. Between the adjacent extension parts 50U, 50D, 50L, and 50R, there can be formed a heat dissipation part 54 (heat dissipation fins), as illustrated in FIG. 23.

As illustrated in FIG. 24, the wide-zone excitation light source $\mathbf{12}_{Wide}$ can be fixed to the tip end of the extension part 50D with a posture tilted so that the excitation light rays $Ray_{Wide}$ are directed to a rearward and obliquely upward direction. Similarly, the middle-zone excitation light source $\mathbf{12}_{Mid}$ can be fixed to the tip end of the extension part 50U with a posture tilted so that the excitation light rays $Ray_{Mid}$ are directed to a rearward and obliquely downward direction. Similarly, the hot-zone excitation light source $\mathbf{12}_{Hot}$ can be fixed to the tip end of the extension part 50L with a posture tilted so that the excitation light rays $Ray_{Hot}$ are directed to a rearward and obliquely rightward direction when viewed from its front side.

The vehicle lighting fixture 300 can further include a lens holder 56 to which the projector lens assembly 20 (lenses 20A to 20D) is fixed. The lens holder 56 can be screwed at its rear end to the opening of the tubular part 48 so as to be fixed to the tubular part 48.

A condenser lens 14 can be disposed in front of each of the excitation light sources $\mathbf{12}_{Wide}$, $\mathbf{12}_{Mid}$, and $\mathbf{12}_{Hot}$. The excitation light rays $Ray_{Wide}$, $Ray_{Mid}$, and $Ray_{Hot}$ can be emitted from the excitation light sources $\mathbf{12}_{Wide}$, $\mathbf{12}_{Mid}$, and $\mathbf{12}_{Hot}$ and condensed by the respective condenser lenses 14 (for example, collimated) to be incident on the respective mirror parts 202 of the optical deflectors $\mathbf{201}_{Wide}$, $\mathbf{201}_{Mid}$, and $\mathbf{201}_{Hot}$.

As illustrated in FIG. 25, the optical deflectors $\mathbf{201}_{Wide}$, $\mathbf{201}_{Mid}$, and $\mathbf{201}_{Hot}$ with the above-described configuration can be disposed to surround the reference axis AX and be closer to the reference axis AX than the excitation light sources $\mathbf{12}_{Wide}$, $\mathbf{12}_{Mid}$, and $\mathbf{12}_{Hot}$ so that the excitation light rays emitted from the excitation light sources $\mathbf{12}_{Wide}$, $\mathbf{12}_{Mid}$, and $\mathbf{12}_{Hot}$ can be incident on the corresponding mirror parts 202 of the optical deflectors $\mathbf{201}_{Wide}$, $\mathbf{201}_{Mid}$, and $\mathbf{201}_{Hot}$ and reflected by the same to be directed to the corresponding scanning regions $A_{Wide}$, $A_{Mid}$, and $A_{Hot}$, respectively.

Specifically, the optical deflectors $\mathbf{201}_{Wide}$, $\mathbf{201}_{Mid}$, and $\mathbf{201}_{Hot}$ can be secured to an optical deflector holder 58 as follows.

The optical deflector holder 58 can have a square pyramid shape projected forward, and its front face can be composed of an upper face 58U, a lower face 58D, a left face 58L, and a right face 58R (not shown in the drawings), as illustrated in FIG. 25.

The wide-zone optical deflector $\mathbf{201}_{Wide}$ (corresponding to the first optical deflector) can be secured to the lower face 58D of the square pyramid face while being tilted so that the mirror part 202 thereof is positioned in an optical path of the excitation light rays $Ray_{Wide}$ emitted from the wide-zone excitation light source $\mathbf{12}_{Wide}$. Similarly thereto, the middle-zone optical deflector $\mathbf{201}_{Mid}$ (corresponding to the second optical deflector) can be secured to the upper face 58U of the square pyramid face while being tilted so that the mirror part 202 thereof is positioned in an optical path of the excitation light rays $Ray_{Mid}$ emitted from the middle-zone excitation light source $\mathbf{12}_{Mid}$. Similarly thereto, the hot-zone optical deflector $\mathbf{201}_{Hot}$ (corresponding to the third optical deflector) can be secured to the left face 58L (when viewed from front) of the square pyramid face while being tilted so that the mirror part 202 thereof is positioned in an optical path of the excitation light rays $Ray_{Hot}$ emitted from the hot-zone excitation light source $\mathbf{12}_{Hot}$.

The optical deflectors $\mathbf{201}_{Wide}$, $\mathbf{201}_{Mid}$, and $\mathbf{201}_{Hot}$ each can be arranged so that the first axis X1 is contained in a vertical plane and the second axis X2 is contained in a horizontal plane. As a result, the above-described arrangement of the optical deflectors $\mathbf{201}_{Wide}$, $\mathbf{201}_{Mid}$, and $\mathbf{201}_{Hot}$ can easily form (draw) a predetermined light distribution pattern (two-dimensional image corresponding to the required predetermined light distribution pattern) being wide in the horizontal direction and narrow in the vertical direction required for a vehicular headlight.

The wide-zone optical deflector $\mathbf{201}_{Wide}$ can draw a first two-dimensional image on the wide-zone scanning region $A_{Wide}$ (corresponding to the first scanning region) with the excitation light rays $Ray_{Wide}$ two-dimensionally scanning in the horizontal and vertical directions by the mirror part 202 thereof, to thereby form a first light intensity distribution on the wide-zone scanning region $A_{Wide}$.

The middle-zone optical deflector $\mathbf{201}_{Mid}$ can draw a second two-dimensional image on the middle-zone scanning region $A_{Mid}$ (corresponding to the second scanning region) with the excitation light rays $Ray_{Mid}$ two-dimensionally scanning in the horizontal and vertical directions by the mirror part 202 thereof in such a manner that the second two-dimensional image overlaps the first two-dimensional image in part, to thereby form a second light intensity distribution on the middle-zone scanning region $A_{Mid}$ with a higher light intensity than that of the first light intensity distribution.

As illustrated in FIG. 21, the middle-zone scanning region $A_{Mid}$ can be smaller than the wide-zone scanning region $A_{Wide}$ in size and overlap part of the wide-zone scanning region $A_{Wide}$. As a result of the overlapping, the overlapped middle-zone scanning region $A_{Mid}$ can have the relatively higher light intensity distribution.

The hot-zone optical deflector $\mathbf{201}_{Hot}$ can draw a third two-dimensional image on the hot-zone scanning region $A_{Hot}$ (corresponding to the third scanning region) with the excitation light rays $Ray_{Hot}$ two-dimensionally scanning in the horizontal and vertical directions by the mirror part 202 thereof in such a manner that the third two-dimensional image overlaps the first and second two-dimensional images in part, to thereby form a third light intensity distribution on the hot-zone scanning region $A_{Hot}$ with a higher light intensity than that of the second light intensity distribution.

As illustrated in FIG. 21, the hot-zone scanning region $A_{Hot}$ can be smaller than the middle-zone scanning region $A_{Mid}$ in size and overlap part of the middle-zone scanning region $A_{Mid}$. As a result of the overlapping, the overlapped hot-zone scanning region $A_{Hot}$ can have the relatively higher light intensity distribution.

The shape of each of the illustrated scanning regions $A_{Wide}$, $A_{Mid}$, and $A_{Hot}$ in FIG. 21 is a rectangular outer shape, but it is not limitative. The outer shape thereof can be a circle, an oval, or other shapes.

Figure 27A:
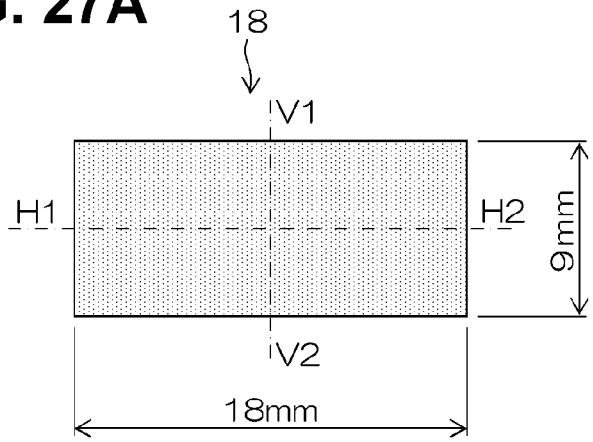
FIGS. 27A, 27B, and 27C are a front view, a top plan view, and a side view of a wavelength conversion member 18, respectively.
Figure 27C:
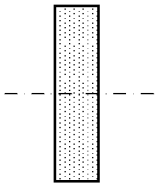
Figure 27B:
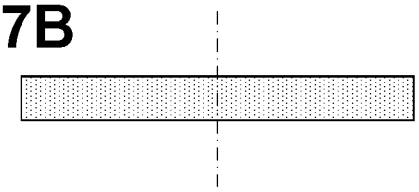

FIGS. 27A, 27B, and 27C are a front view, a top plan view, and a side view of the wavelength conversion member 18, respectively.

The illustrated wavelength conversion member 18 can be configured to be a rectangular plate with a horizontal length of 18 mm and a vertical length of 9 mm. The wavelength conversion member 18 can also be referred to as a phosphor panel.

As illustrated in FIGS. 24 and 25, the vehicle lighting fixture 300 can include a phosphor holder 52 which can close the rear end opening of the tubular part 48. The wavelength conversion member 18 can be secured to the phosphor holder 52. Specifically, the phosphor holder 52 can have an opening 52*a* formed therein and the wavelength conversion member 18 can be secured to the periphery of the opening 52*a* of the phosphor holder 52 at its outer periphery of the rear surface 18*a* thereof. The wavelength conversion member 18 can cover the opening 52*a*.

Figure 30A:
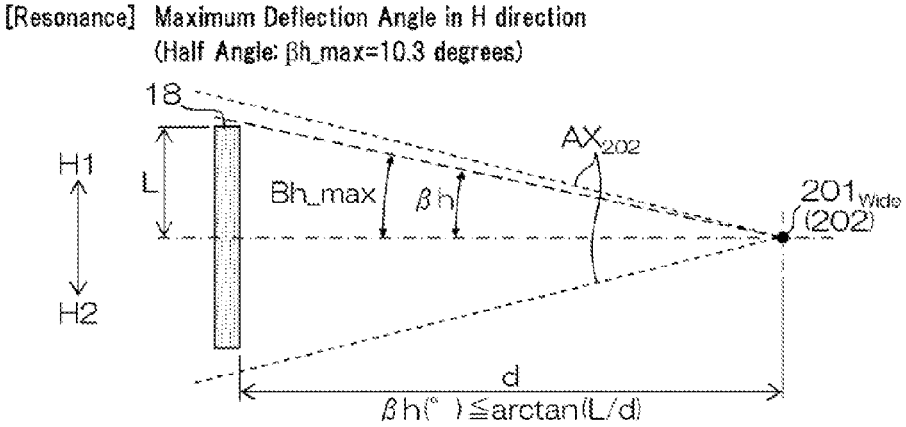
FIG. 30A is a diagram for illustrating the "L" and "βh_max" illustrated in (a) of FIG. 29.
Figure 30B:
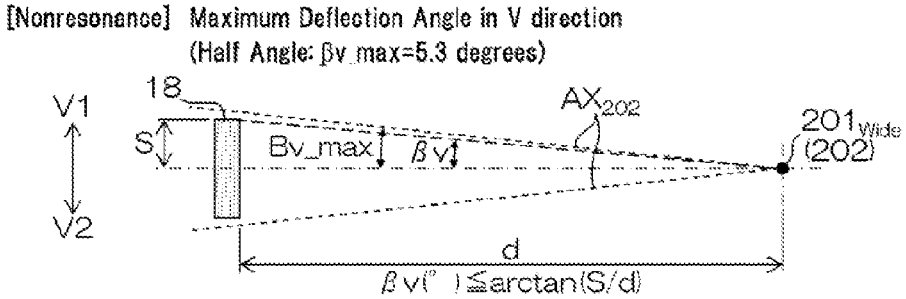
FIG. 30B is a diagram for illustrating the "S," "βv_max," and L illustrated in (b) of FIG. 29.

The wavelength conversion member 18 can be disposed to be confined between the center line $AX_{202}$ of the mirror part 202 of the wide-zone optical deflector $\mathbf{201}_{Wide}$ at the maximum deflection angle βh_max (see FIG. 30A) and the center line $AX_{202}$ of the mirror part 202 of the wide-zone optical deflector $\mathbf{201}_{Wide}$ at the maximum deflection angle βv_max (see FIG. 30B). Specifically, the wavelength conversion member 18 should be disposed to satisfy the following two formulas 1 and 2:

$$\tan(\beta h_\max) \geq L/d \quad \text{(Formula 1), and}$$

$$\tan(\beta v_\max) \geq S/d \quad \text{(Formula 2),}$$

wherein L is ½ of a horizontal length of the wavelength conversion member 18, S is ½ of a vertical length of the wavelength conversion member 18, and d is the distance from the wavelength conversion member 18 and the optical deflector 201 (mirror part 202).

A description will next be given of how to adjust the sizes (horizontal length and vertical length) of the scanning regions $A_{Wide}$, $A_{Mid}$, and $A_{Hot}$.

The sizes (horizontal length and vertical length) of the scanning regions $A_{Wide}$, $A_{Mid}$, and $A_{Hot}$ can be adjusted by changing the swinging ranges of the mirror parts 202 of the optical deflectors $\mathbf{201}_{Wide}$, $\mathbf{201}_{Mid}$, and $\mathbf{201}_{Hot}$ around the first axis X1 and the swinging ranges of the mirror parts 202 of the optical deflectors $\mathbf{201}_{Wide}$, $\mathbf{201}_{Mid}$, and $\mathbf{201}_{Hot}$ around the second axis X2. This can be done by changing the first and second AC voltages to be applied to the first piezoelectric actuators 203 and 204 and the third AC voltage to be applied to the second piezoelectric actuators 205 and 206 when the distances between each of the optical deflectors $\mathbf{201}_{Wide}$, $\mathbf{201}_{Mid}$, and $\mathbf{201}_{Hot}$ (the center of the mirror part 202 thereof) and the wavelength conversion member 18 are the same (or substantially the same) as each other. (See FIGS. 23 and 24.) The reasons therefore are as follows.

Figure 28A:
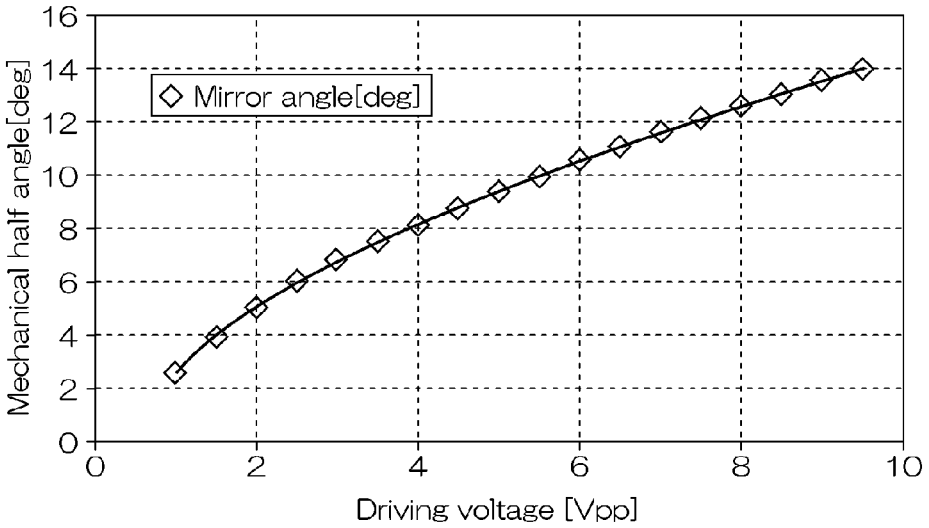
FIG. 28A is a graph showing the relationship between a mechanical swing angle (half angle) of the mirror part 202 around the first axis X1 and the drive voltage to be applied to the first piezoelectric actuators 203 and 204.
Figure 28B:
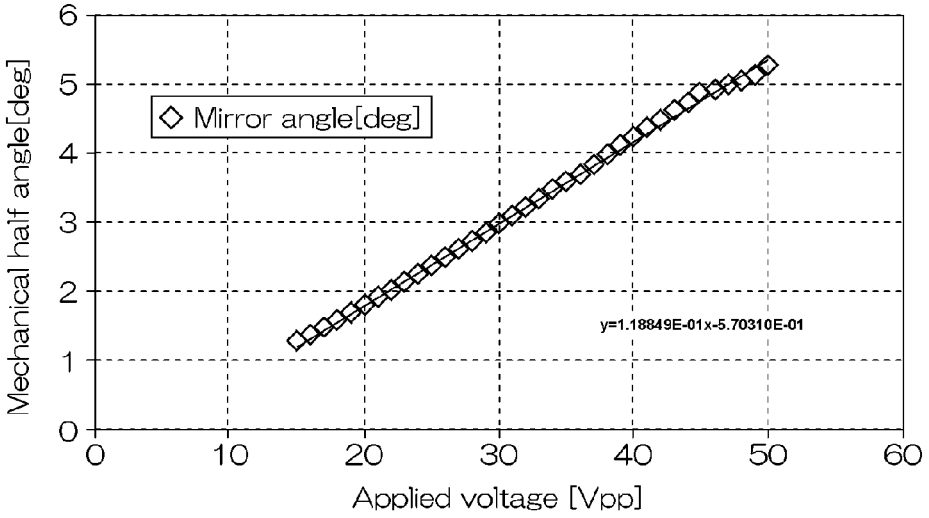
FIG. 28B is a graph showing the relationship between a mechanical swing angle (half angle) of the mirror part 202 around the second axis X2 and the drive voltage to be applied to the second piezoelectric actuators 205 and 206.

Specifically, as illustrated in FIG. 28A, in the optical deflectors $\mathbf{201}_{Wide}$, $\mathbf{201}_{Mid}$, and $\mathbf{201}_{Hot}$, the mechanical swing angle (half angle, see the vertical axis) of the mirror part 202 around the first axis X1 is increased as the drive voltage (see the horizontal axis) to be applied to the first piezoelectric actuators 203 and 204 is increased. Furthermore, as illustrated in FIG. 28B, the mechanical swing angle (half angle, see the vertical axis) of the mirror part 202 around the second axis X2 is also increased as the drive voltage (see the horizontal axis) to be applied to the second piezoelectric actuators 205 and 206 is increased.

Thus, when the distances between each of the optical deflectors $\mathbf{201}_{Wide}$, $\mathbf{201}_{Mid}$, and $\mathbf{201}_{Hot}$ (the center of the mirror part 202 thereof) and the wavelength conversion member 18 are the same (or substantially the same) as each other (see FIGS. 24 and 25), the sizes (horizontal length and vertical length) of the scanning regions $A_{Wide}$, $A_{Mid}$, and $A_{Hot}$ can be adjusted by changing the first and second AC voltages to be applied to the first piezoelectric actuators 203 and 204 and the third AC voltage to be applied to the second piezoelectric actuators 205 and 206, and thereby changing the swinging ranges of the mirror parts 202 of the respective optical deflectors $\mathbf{201}_{Wide}$, $\mathbf{201}_{Mid}$, and $\mathbf{201}_{Hot}$ around the first axis X1 and the swinging ranges of the mirror parts 202 of the respective optical deflectors $\mathbf{201}_{Wide}$, $\mathbf{201}_{Mid}$, and $\mathbf{201}_{Hot}$ around the second axis X2.

Next, a description will be given of a concrete adjustment example. In the following description, it is assumed that the distances between each of the optical deflectors $\mathbf{201}_{Wide}$, $\mathbf{201}_{Mid}$, and $\mathbf{201}_{Hot}$ (the center of the mirror part 202 thereof) and the wavelength conversion member 18 are the same (or substantially the same) as each other and d=24.0 mm as illustrated in FIGS. 30A and 30B and the focal distance of the projector lens assembly 20 is 32 mm.

As shown in the row "WIDE" of the table of FIG. 29A, when 5.41 $V_{pp}$ as a drive voltage is applied to the first piezoelectric actuators 203 and 204 of the wide-zone optical deflector $\mathbf{201}_{Wide}$, the mechanical swing angle (half angle: γh_max) around the first axis X1 and the maximum deflection angle (half angle: βh_max) are ±9.8 degrees and ±19.7 degrees, respectively. In this case, the size (horizontal length) of the wide-zone scanning region $A_{Wide}$ in the horizontal direction is adjusted to be ±8.57 mm.

The "L" and "βh_max" described in FIG. 29A represent the distance and the angle shown in FIG. 30A. The "mirror mechanical half angle" (also referred to as "mechanical half angle") described in FIG. 29A means the angle at which the mirror part 202 actually moves, and represents an angle of the mirror part 202 with respect to the normal direction with the sign "+" or "−." The "mirror deflection angle" (also referred to as "optical half angle") described in FIG. 29A means the angle formed between the excitation light (light rays) reflected by the mirror part and the normal direction of the mirror part 202, and also represents an angle of the mirror part 202 with respect to the normal direction with the sign "+" or "−." According to the Fresnel's law, the optical half angle is twice the mechanical half angle.

As shown in the row "WIDE" of the table of FIG. 29B, when 41.2 $V_{pp}$ as a drive voltage is applied to the second piezoelectric actuators 205 and 206 of the wide-zone optical deflector $\mathbf{201}_{Wide}$, the mechanical swing angle (half angle: γv_max) around the first axis X1 and the maximum deflection angle (half angle: βv_max) are ±4.3 degrees and ±8.6 degrees, respectively. In this case, the size (vertical length) of the wide-zone scanning region $A_{Wide}$ in the vertical direction is adjusted to be ±3.65 mm.

The "S" and "βv_max" described in FIG. 29B represent the distance and the angle shown in FIG. 30B, respectively.

As described above, by applying 5.41 $V_{pp}$ as a drive voltage (the first and second AC voltages) to the first piezoelectric actuators 203 and 204 of the wide-zone optical deflector $\mathbf{201}_{Wide}$, and also by applying 41.2 $V_{pp}$ as a drive voltage (the third AC voltage) to the second piezoelectric actuators 205 and 206 of the wide-zone optical deflector $\mathbf{201}_{Wide}$, thereby changing the swinging range of the mirror part 202 of the wide-zone optical deflector $\mathbf{201}_{Wide}$ around the first axis X1 and the swinging range of the mirror part 202 of the wide-zone optical deflector $\mathbf{201}_{Wide}$ around the second axis X2, the size (horizontal length) of the wide-zone scanning region $A_{Wide}$ can be adjusted to be ±8.57 mm and the size (vertical length) of the wide-zone scanning region $A_{Wide}$ can be adjusted to be ±3.65 mm to form a rectangular shape with the horizontal length of ±8.57 mm and the vertical length of ±3.65 mm.

The light intensity distribution formed in the wide-zone scanning region $A_{Wide}$ with the above-described dimensions can be projected forward through the projector lens assembly 20 to thereby form the wide-zone light distribution pattern $P_{Wide}$ with a rectangle of the width of ±15 degrees in the horizontal direction and the width of ±6.5 degrees in the vertical direction on the virtual vertical screen (see FIG. 26).

As shown in the row "MID" of the table of FIG. 29A, when 2.31 $V_{pp}$ as a drive voltage is applied to the first piezoelectric actuators 203 and 204 of the middle-zone optical deflector $\mathbf{201}_{Mid}$, the mechanical swing angle (half angle: γh_max) around the first axis X1 and the maximum deflection angle (half angle: βh_max) are ±5.3 degrees and ±11.3 degrees, respectively. In this case, the size (horizontal length) of the middle-zone scanning region $A_{Mid}$ in the horizontal direction is adjusted to be ±4.78 mm.

As shown in the row "MID" of the table of FIG. 29B, when 24.4 $V_{pp}$ as a drive voltage is applied to the second piezoelectric actuators 205 and 206 of the middle-zone optical deflector $\mathbf{201}_{Mid}$, the mechanical swing angle (half angle: γv_max) around the first axis X1 and the maximum deflection angle (half angle: βv_max) are ±2.3 degrees and ±4.7 degrees, respectively. In this case, the size (vertical length) of the middle-zone scanning region $A_{Mid}$ in the vertical direction is adjusted to be ±1.96 mm.

As described above, by applying 2.31 $V_{pp}$ as a drive voltage (the first and second AC voltages) to the first piezoelectric actuators 203 and 204 of the middle-zone optical deflector $\mathbf{201}_{Mid}$, and by applying 24.4 $V_{pp}$ as a drive voltage (the third AC voltage) to the second piezoelectric actuators 205 and 206 of the middle-zone optical deflector $\mathbf{201}_{Mid}$, thereby changing the swinging range of the mirror part 202 of the middle-zone optical deflector $\mathbf{201}_{Mid}$ around the first axis X1 and the swinging range of the mirror part 202 of the middle-zone optical deflector $\mathbf{201}_{Mid}$ around the second axis X2, the size (horizontal length) of the middle-zone scanning region $A_{Mid}$ can be adjusted to be ±4.78 mm and the size (vertical length) of the middle-zone scanning region $A_{Mid}$ can be adjusted to be ±1.96 mm to form a rectangular shape with the horizontal length of ±4.78 mm and the vertical length of ±1.96 mm.

The light intensity distribution formed in the middle-zone scanning region $A_{Mid}$ with the above-described dimensions can be projected forward through the projector lens assembly 20 to thereby form the middle-zone light distribution pattern $P_{Mid}$ (see FIG. 26) with a rectangle of the width of ±8.5 degrees in the horizontal direction and the width of ±3.5 degrees in the vertical direction on the virtual vertical screen.

As shown in the row "HOT" of the table of FIG. 29A, when 0.93 $V_{pp}$ as a drive voltage is applied to the first piezoelectric actuators 203 and 204 of the hot-zone optical deflector $\mathbf{201}_{Hot}$, the mechanical swing angle (half angle: γh_max) around the first axis X1 and the maximum deflection angle (half angle: βh_max) are ±2.3 degrees and ±4.7 degrees, respectively. In this case, the size (horizontal length) of the hot-zone scanning region $A_{Hot}$ in the horizontal direction is adjusted to be ±1.96 mm.

As shown in the row "HOT" of the table of FIG. 29B, when 13.3 $V_{pp}$ as a drive voltage is applied to the second piezoelectric actuators 205 and 206 of the hot-zone optical deflector $\mathbf{201}_{Hot}$, the mechanical swing angle (half angle: γv_max) around the first axis X1 and the maximum deflection angle (half angle: βv_max) are ±1.0 degrees and ±2.0 degrees, respectively. In this case, the size (vertical length) of the hot-zone scanning region $A_{Hot}$ in the vertical direction is adjusted to be ±0.84 mm.

As described above, by applying 0.93 $V_{pp}$ as a drive voltage (the first and second AC voltages) to the first piezoelectric actuators 203 and 204 of the hot-zone optical deflector $\mathbf{201}_{Hot}$, and also by applying 13.3 $V_{pp}$ as a drive voltage (the third AC voltage) to the second piezoelectric actuators 205 and 206 of the hot-zone optical deflector $\mathbf{201}_{Hot}$, thereby changing the swinging range of the mirror part 202 of the hot-zone optical deflector $\mathbf{201}_{Hot}$ around the first axis X1 and the swinging range of the mirror part 202 of the hot-zone optical deflector $\mathbf{201}_{Hot}$ around the second axis X2, the size (horizontal length) of the hot-zone scanning region $A_{Hot}$ can be adjusted to be ±1.96 mm and the size (vertical length) of the hot-zone scanning region $A_{Hot}$ can be adjusted to be ±0.84 mm to form a rectangular shape with the horizontal length of ±1.96 mm and the vertical length of ±0.84 mm.

The light intensity distribution formed in the hot-zone scanning region $A_{Hot}$ with the above-described dimensions can be projected forward through the projector lens assembly 20 to thereby form the hot-zone light distribution pattern $P_{Hot}$ with a rectangle of the width of ±3.5 degrees in the horizontal direction and the width of ±1.5 degrees in the vertical direction on the virtual vertical screen (see FIG. 26).

Thus, when the distances between each of the optical deflectors $\mathbf{201}_{Wide}$, $\mathbf{201}_{Mid}$, and $\mathbf{201}_{Hot}$ (the center of the mirror part 202 thereof) and the wavelength conversion member 18 are the same (or substantially the same) as each other (see FIGS. 24 and 25), the sizes (horizontal length and vertical length) of the scanning regions $A_{Wide}$, $A_{Mid}$, and $A_{Hot}$ can be adjusted by changing the first and second AC voltages to be applied to the first piezoelectric actuators 203 and 204 and the third AC voltage to be applied to the second piezoelectric actuators 205 and 206, and thereby changing the swinging ranges of the mirror parts 202 of the optical deflectors $\mathbf{201}_{Wide}$, $\mathbf{201}_{Mid}$, and $\mathbf{201}_{Hot}$ around the first axis X1 and the swinging ranges of the mirror parts 202 of the optical deflectors $\mathbf{201}_{Wide}$, $\mathbf{201}_{Mid}$, and $\mathbf{201}_{Hot}$ around the second axis X2.

A description will next be given of another technique of adjusting the sizes (horizontal length and vertical length) of the scanning regions $A_{Wide}$, $A_{Mid}$, and $A_{Hot}$.

Figure 31:
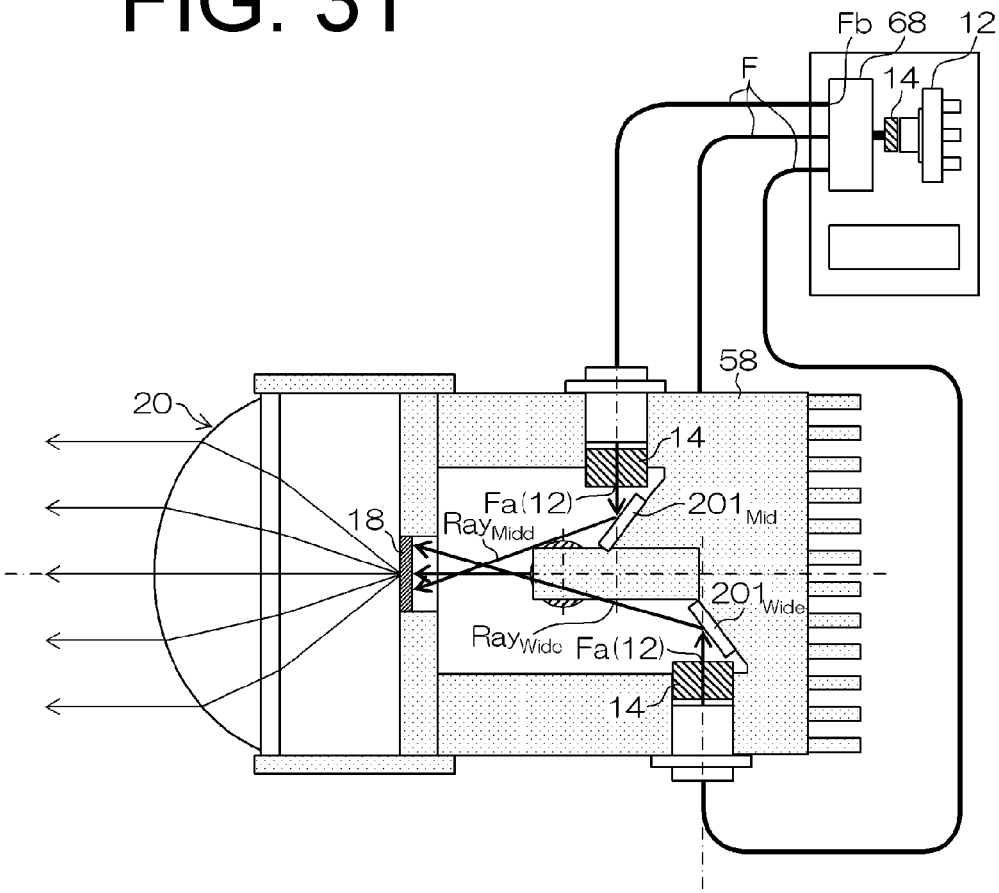
FIG. 31 is a diagram for illustrating an example in which the distances between each of the optical deflectors $\mathbf{201}_{Wide}$, $\mathbf{201}_{Mid}$, and $\mathbf{201}_{Hot}$ (the center of the mirror part 202) and the wavelength conversion member 18 are changed.

When the drive voltages to be applied to the respective optical deflectors $\mathbf{201}_{Wide}$, $\mathbf{201}_{Mid}$, and $\mathbf{201}_{Hot}$ are the same (or substantially the same) as each other, the sizes (horizontal length and vertical length) of the scanning regions $A_{Wide}$, $A_{Mid}$, and $A_{Hot}$ can be adjusted by changing the distances between each of the optical deflectors $\mathbf{201}_{Wide}$, $\mathbf{201}_{Mid}$, and $\mathbf{201}_{Hot}$ (the center of the mirror part 202) and the wavelength conversion member 18 (for example, see FIG. 31).

Next, a description will be given of a concrete adjustment example. In the following description, it is assumed that the drive voltages to be applied to the respective optical deflectors $\mathbf{201}_{Wide}$, $\mathbf{201}_{Mid}$, and $\mathbf{201}_{Hot}$ are the same as each other and the focal distance of the projector lens assembly 20 is 32 mm.

For example, as shown in the row "WIDE" of the table of FIG. 32A, when the distance between the wide-zone optical deflector $\mathbf{201}_{Wide}$ (the center of the mirror part 202 thereof) and the wavelength conversion member 18 is set to 24.0 mm and 5.41 $V_{pp}$ as a drive voltage is applied to the first piezoelectric actuators 203 and 204 of the wide-zone optical deflector $\mathbf{201}_{Wide}$, the mechanical swing angle (half angle: γh_max) around the first axis X1 and the maximum deflection angle (half angle: βh_max) are ±9.8 degrees and ±19.7 degrees, respectively. In this case, the size (horizontal length) of the wide-zone scanning region $A_{Wide}$ in the horizontal direction is adjusted to be ±8.57 mm.

The "L" and "d," and "βh_max" described in FIG. 32A represent the distances and the angle shown in FIG. 30A, respectively.

Then, as shown in the row "WIDE" of the table of FIG. 32B, when the distance between the wide-zone optical deflector $\mathbf{201}_{Wide}$ (the center of the mirror part 202 thereof) and the wavelength conversion member 18 is set to 24.0 mm and 41.2 $V_{pp}$ as a drive voltage is applied to the second piezoelectric actuators 205 and 206 of the wide-zone optical deflector $\mathbf{201}_{Wide}$, the mechanical swing angle (half angle: γv_max) around the first axis X1 and the maximum deflection angle (half angle: βv_max) are ±4.3 degrees and ±8.6 degrees, respectively. In this case, the size (vertical length) of the wide-zone scanning region $A_{Wide}$ in the vertical direction is adjusted to be ±3.65 mm.

The "S" and "d," and "βv_max" described in FIG. 32B represent the distances and the angle shown in FIG. 30B, respectively.

As described above, by setting the distance between the wide-zone optical deflector $\mathbf{201}_{Wide}$ (the center of the mirror part 202 thereof) and the wavelength conversion member 18 to 24.0 mm, the size (horizontal length) of the wide-zone scanning region $A_{Wide}$ in the horizontal direction can be adjusted to be ±8.57 mm and the size (vertical length) of the wide-zone scanning region $A_{Wide}$ in the vertical direction can be adjusted to be ±3.65 mm to form a rectangular shape with the horizontal length of ±8.57 mm and the vertical length of ±3.65 mm.

The light intensity distribution formed in the wide-zone scanning region $A_{Wide}$ with the above-described dimensions can be projected forward through the projector lens assembly 20 to thereby form the wide-zone light distribution pattern $P_{Wide}$ with a rectangle of the width of ±15 degrees in the horizontal direction and the width of ±6.5 degrees in the vertical direction on the virtual vertical screen (see FIG. 26).

Next, as shown in the row "MID" of the table of FIG. 32A, when the distance between the middle-zone optical deflector $\mathbf{201}_{Mid}$ (the center of the mirror part 202 thereof) and the wavelength conversion member 18 is set to 13.4 mm and 5.41 $V_{pp}$ as a drive voltage is applied to the first piezoelectric actuators 203 and 204 of the middle-zone optical deflector $\mathbf{201}_{Mid}$ as in the wide-zone optical deflector $\mathbf{201}_{Wide}$, the mechanical swing angle (half angle: γh_max) around the first axis X1 and the maximum deflection angle (half angle: βh_max) are ±9.8 degrees and ±19.7 degrees, respectively, as in the wide-zone optical deflector $\mathbf{201}_{Wide}$. However, the distance (13.4 mm) between the middle-zone optical deflector $\mathbf{201}_{Mid}$ (the center of the mirror part 202 thereof) and the wavelength conversion member 18 is set to be shorter than the distance (24.0 mm) between the wide-zone optical deflector $\mathbf{201}_{Wide}$ (the center of the mirror part 202 thereof) and the wavelength conversion member 18. Thus, the size (horizontal length) of the middle-zone scanning region $A_{Mid}$ in the horizontal direction is adjusted to be ±4.78 mm.

Then, as shown in the row "MID" of the table of FIG. 32B, when the distance between the middle-zone optical deflector $\mathbf{201}_{Mid}$ (the center of the mirror part 202 thereof) and the wavelength conversion member 18 is set to 13.4 mm and 41.2 $V_{pp}$ as a drive voltage is applied to the second piezoelectric actuators 205 and 206 of the middle-zone optical deflector $\mathbf{201}_{Mid}$ as in the wide-zone optical deflector $\mathbf{201}_{Wide}$, the mechanical swing angle (half angle: γv_max) around the first axis X1 and the maximum deflection angle (half angle: βv_max) are ±4.3 degrees and ±8.6 degrees, respectively, as in the wide-zone optical deflector $\mathbf{201}_{Wide}$. However, the distance (13.4 mm) between the middle-zone optical deflector $\mathbf{201}_{Mid}$ (the center of the mirror part 202 thereof) and the wavelength conversion member 18 is set to be shorter than the distance (24.0 mm) between the wide-zone optical deflector $\mathbf{201}_{Wide}$ (the center of the mirror part 202 thereof) and the wavelength conversion member 18. Thus, the size (vertical length) of the middle-zone scanning region $A_{Mid}$ in the vertical direction is adjusted to be ±1.96 mm.

As described above, by setting the distance between the middle-zone optical deflector $\mathbf{201}_{Mid}$ (the center of the mirror part 202 thereof) and the wavelength conversion member 18 to 13.4 mm, the size (horizontal length) of the middle-zone scanning region $A_{Mid}$ in the horizontal direction can be adjusted to be ±4.78 mm and the size (vertical length) of the middle-zone scanning region $A_{Mid}$ in the vertical direction can be adjusted to be ±1.96 mm to form a rectangular shape with the horizontal length of ±4.78 mm and the vertical length of ±1.96 mm.

The light intensity distribution formed in the middle-zone scanning region $A_{Mid}$ with the above-described dimensions can be projected forward through the projector lens assembly 20 to thereby form the middle-zone light distribution pattern $P_{Mid}$ with a rectangle of the width of ±8.5 degrees in the horizontal direction and the width of ±3.6 degrees in the vertical direction on the virtual vertical screen (see FIG. 26).

Next, as shown in the row "HOT" of the table of FIG. 32A, when the distance between the hot-zone optical deflector $\mathbf{201}_{Hot}$ (the center of the mirror part 202 thereof) and the wavelength conversion member 18 is set to 5.5 mm and 5.41 $V_{pp}$ as a drive voltage is applied to the first piezoelectric actuators 203 and 204 of the hot-zone optical deflector $\mathbf{201}_{Hot}$ as in the wide-zone optical deflector $\mathbf{201}_{Wide}$, the mechanical swing angle (half angle: γh_max) around the first axis X1 and the maximum deflection angle (half angle: βh_max) are ±9.8 degrees and ±19.7 degrees, respectively, as in the wide-zone optical deflector $\mathbf{201}_{Wide}$. However, the distance (5.5 mm) between the hot-zone optical deflector $\mathbf{201}_{Hot}$ (the center of the mirror part 202 thereof) and the wavelength conversion member 18 is set to be shorter than the distance (13.4 mm) between the middle-zone optical deflector $\mathbf{201}_{Mid}$ (the center of the mirror part 202 thereof) and the wavelength conversion member 18. Thus, the size (horizontal length) of the hot-zone scanning region $A_{Hot}$ in the horizontal direction is adjusted to be ±1.96 mm.

Then, as shown in the row "HOT" of the table of FIG. 32B, when the distance between the hot-zone optical deflector $\mathbf{201}_{Hot}$ (the center of the mirror part 202 thereof) and the wavelength conversion member 18 is set to 5.5 mm and 41.2 $V_{pp}$ as a drive voltage is applied to the second piezoelectric actuators 205 and 206 of the hot-zone optical deflector $\mathbf{201}_{Hot}$ as in the wide-zone optical deflector $\mathbf{201}_{Wide}$, the mechanical swing angle (half angle: γv_max) around the first axis X1 and the maximum deflection angle (half angle: βv_max) are ±4.3 degrees and ±8.6 degrees, respectively, as in the wide-zone optical deflector $\mathbf{201}_{Wide}$. However, the distance (5.5 mm) between the hot-zone optical deflector $\mathbf{201}_{Hot}$ (the center of the mirror part 202 thereof) and the wavelength conversion member 18 is set to be shorter than the distance (13.4 mm) between the middle-zone optical deflector $\mathbf{201}_{Mid}$ (the center of the mirror part 202 thereof) and the wavelength conversion member 18. Thus, the size (vertical length) of the hot-zone scanning region $A_{Hot}$ in the vertical direction is adjusted to be ±0.84 mm.

As described above, by setting the distance between the hot-zone optical deflector $\mathbf{201}_{Hot}$ (the center of the mirror part 202 thereof) and the wavelength conversion member 18 to 5.5 mm, the size (horizontal length) of the hot-zone scanning region $A_{Hot}$ can be adjusted to be ±1.96 mm and the size (vertical length) of the hot-zone scanning region $A_{Hot}$ can be adjusted to be ±0.84 mm to form a rectangular shape with the horizontal length of ±1.96 mm and the vertical length of ±0.84 mm.

The light intensity distribution formed in the hot-zone scanning region $A_{Hot}$ with the above-described dimensions can be projected forward through the projector lens assembly 20 to thereby form the hot-zone light distribution pattern $P_{Hot}$ with a rectangle of the width of ±3.5 degrees in the horizontal direction and the width of ±1.5 degrees in the vertical direction on the virtual vertical screen (see FIG. 26).

As described above, when the drive voltages to be applied to the respective optical deflectors $\mathbf{201}_{Wide}$, $\mathbf{201}_{Mid}$, and $\mathbf{201}_{Hot}$ are the same (or substantially the same) as each other, the sizes (horizontal length and vertical length) of the scanning regions $A_{Wide}$, $A_{Mid}$, and $A_{Hot}$ can be adjusted by changing the distances between each of the optical deflectors $\mathbf{201}_{Wide}$, $\mathbf{201}_{Mid}$, and $\mathbf{201}_{Hot}$ (the center of the mirror part 202) and the wavelength conversion member 18.

When the first and second AC voltages to be applied to the respective optical deflectors $\mathbf{201}_{Wide}$, $\mathbf{201}_{Mid}$, and $\mathbf{201}_{Hot}$ are feedback-controlled, the drive voltages applied to the respective optical deflectors $\mathbf{201}_{Wide}$, $\mathbf{201}_{Mid}$, and $\mathbf{201}_{Hot}$ are not completely the same. Even in this case, the sizes (horizontal length and vertical length) of the scanning regions $A_{Wide}$, $A_{Mid}$, and $A_{Hot}$ can be adjusted by changing the distance between each of the optical deflectors $\mathbf{201}_{Wide}$, $\mathbf{201}_{Mid}$, and $\mathbf{201}_{Hot}$ (the center of each of the mirror parts 202) and the wavelength conversion member 18.

A description will next be given of still another technique of adjusting the sizes (horizontal length and vertical length) of the scanning regions $A_{Wide}$, $A_{Mid}$, and $A_{Hot}$.

Figure 33:
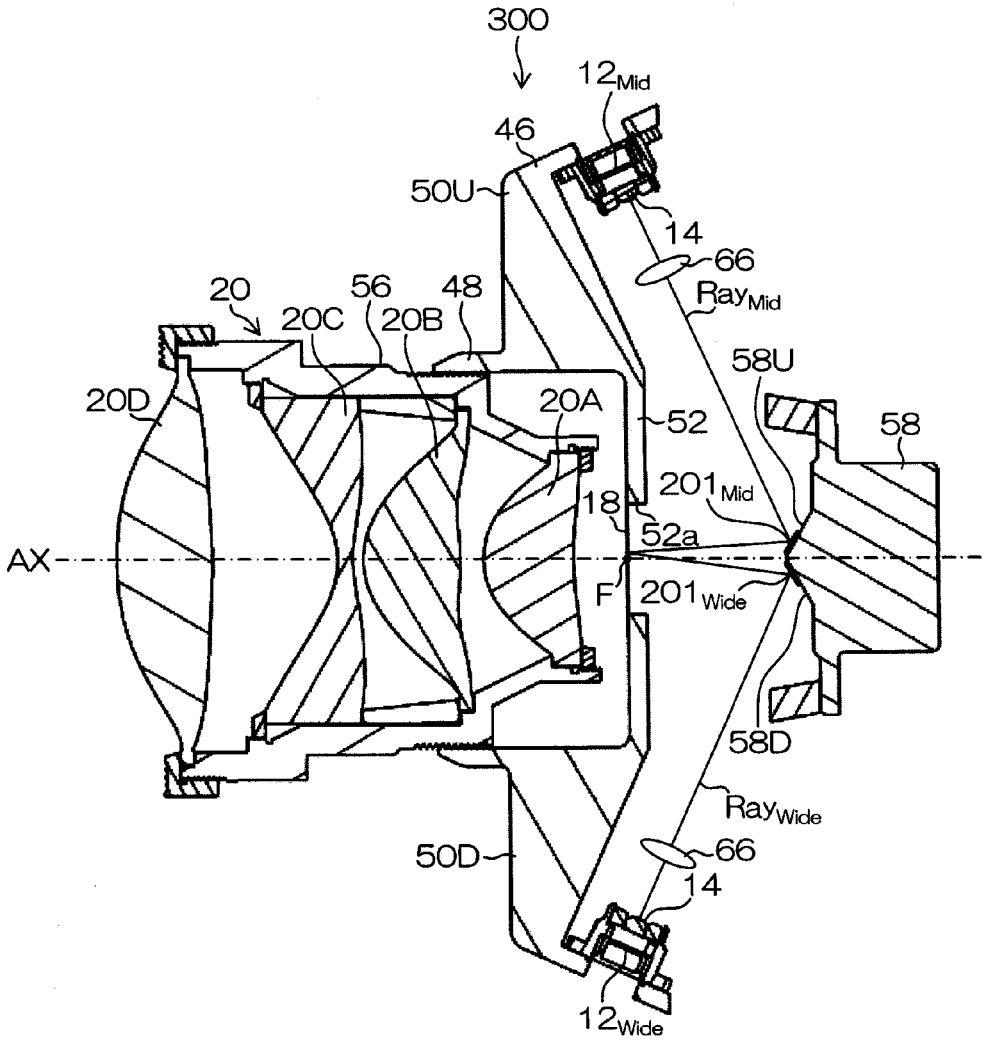
FIG. 33 is a vertical cross-sectional view of a modified example of the vehicle lighting fixture 300.

It is conceivable that the sizes (horizontal length and vertical length) of the scanning regions $A_{Wide}$, $A_{Mid}$, and $A_{Hot}$ can be adjusted by disposing a lens 66 between each of the excitation light sources $\mathbf{12}_{Wide}$, $\mathbf{12}_{Mid}$, and $\mathbf{12}_{Hot}$ and each of the optical deflectors $\mathbf{201}_{Wide}$, $\mathbf{201}_{Mid}$, and $\mathbf{201}_{Hot}$ (or alternatively between each of the optical deflectors $\mathbf{201}_{Wide}$, $\mathbf{201}_{Mid}$, and $\mathbf{201}_{Hot}$ and the wavelength conversion member 18), as illustrated in FIG. 33. The lens 66 may be a lens having a different focal distance.

With the vehicle lighting fixture having the above-described configuration in the present reference example, which utilizes a plurality of optical deflectors configured to scan with excitation light in a two-dimensional manner, it is possible to miniaturize its size and reduce the parts number, which has been a cause for cost increase. This is because the single wavelength conversion member 18 and the single optical system (projector lens assembly 20) are used with respect to the plurality of optical deflectors $\mathbf{201}_{Wide}$, $\mathbf{201}_{Mid}$, and $\mathbf{201}_{Hot}$ as compared with the conventional case wherein a vehicle lighting fixture uses a plurality of wavelength conversion members (phosphor parts) and a plurality of optical systems (projector lenses).

With the vehicle lighting fixture having the above-described configuration in the present reference example, which utilizes a plurality of optical deflectors configured to scan with excitation light in a two-dimensional manner, as illustrated in FIG. 26, a predetermined light distribution pattern P (for example, high-beam light distribution pattern) excellent in far-distance visibility and sense of light distribution can be formed. The predetermined light distribution pattern P of FIG. 26 can be configured such that the light intensity in part, for example, at the center ($P_{Hot}$), is relatively high and the light intensity is gradually lowered from that part, or the center, to the periphery ($P_{Hot} \rightarrow P_{Mid} \rightarrow P_{Wide}$).

This is because of the following reason. Specifically, as illustrated in FIG. 21, the middle-zone scanning region $A_{Mid}$ can be smaller than the wide-zone scanning region $A_{Wide}$ in size and overlap part of the wide-zone scanning region $A_{Wide}$, and the hot-zone scanning region $A_{Hot}$ can be smaller than the middle-zone scanning region $A_{Mid}$ in size and overlap part of the middle-zone scanning region $A_{Mid}$. As a result, the light intensity of the first light intensity distribution formed in the wide-zone scanning region $A_{Wide}$, that of the second light intensity distribution formed in the middle-zone scanning region $A_{Mid}$, and that of the third light intensity distribution formed in the hot-zone scanning region $A_{Hot}$ are increased more in this order while the respective sizes of the light intensity distributions are decreased more in this order. Then, the predetermined light distribution pattern P as illustrated in FIG. 26 can be formed by projecting the first, second, and third light intensity distributions respectively formed in the wide-zone scanning region $A_{Wide}$, the middle-zone scanning region $A_{Mid}$, and the hot-zone scanning region $A_{Hot}$. Thus, the resulting predetermined light distribution pattern P can be excellent in far-distance visibility and sense of light distribution.

Furthermore, according to the present reference example, the vehicle lighting fixture 300 (or the lighting unit) can be made thin in the reference axis AX direction as compared with a vehicle lighting fixture 400 (or a lighting unit) to be described later, although the size thereof may be large in the vertical and horizontal direction.

Next, a description will be given of another vehicle lighting fixture using three optical deflectors 201 of one-dimensional nonresonance/one-dimensional resonance type (2-D optical scanner (fast resonant and slow static combination)) as a third reference example. Note that the type of the optical deflector 201 is not limited to this, but may adopt any of the previously described various optical deflectors as exemplified in the above-described reference example.

Figure 34:
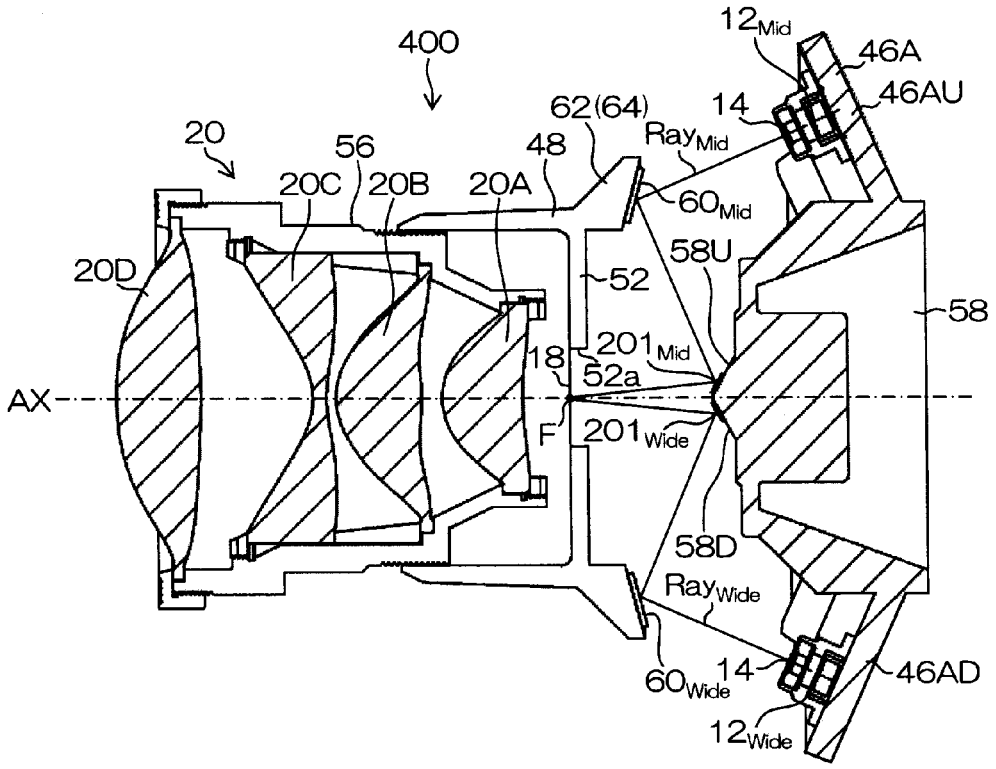
FIG. 34 is a vertical cross-sectional view of a vehicle lighting fixture 400 according to a third reference example.
Figure 35:
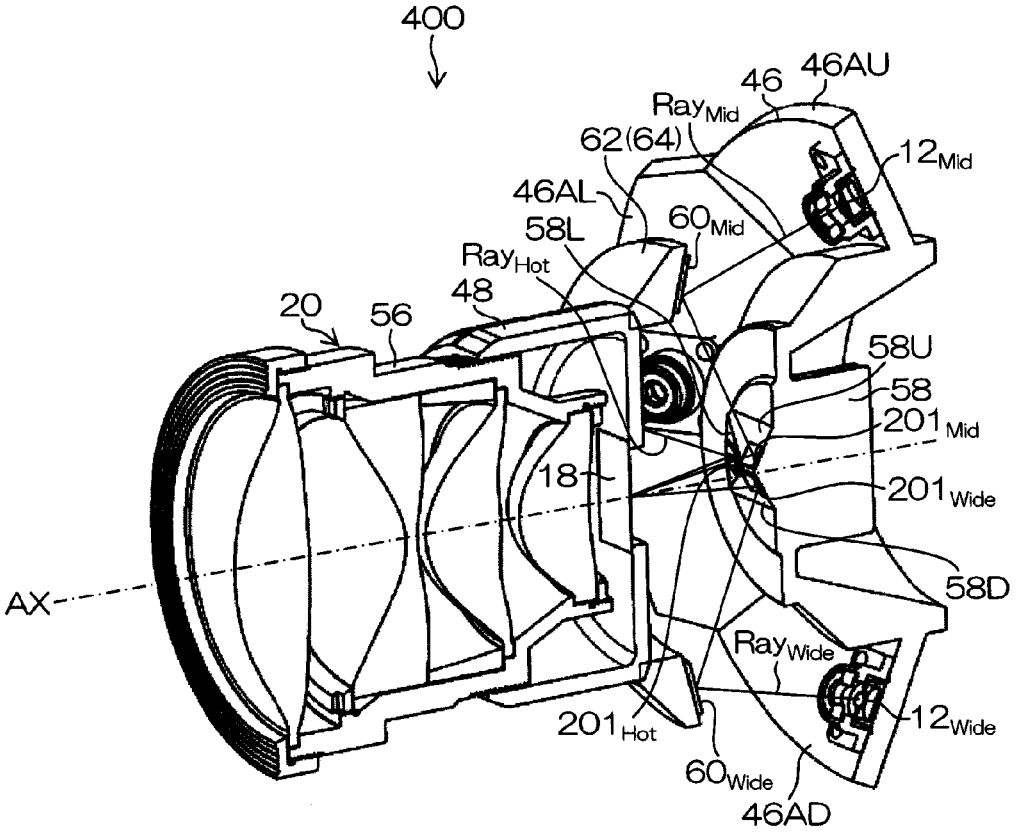
FIG. 35 is a perspective view of a cross section of the vehicle lighting fixture 400 of FIG. 34.

FIG. 34 is a vertical cross-sectional view of a vehicle lighting fixture 400 according to the third reference example, and FIG. 35 is a perspective view of a cross section of the vehicle lighting fixture 400 of FIG. 34.

The vehicle lighting fixture 400 of this reference example can be configured to form a predetermined light distribution pattern P (for example, high-beam light distribution pattern), as illustrated in FIG. 26, which can be excellent in far-distance visibility and sense of light distribution and be configured such that the light intensity in part, for example, at the center ($P_{Hot}$), is relatively high and the light intensity is gradually lowered from that part, or the center, to the periphery ($P_{Hot} \rightarrow P_{Mid} \rightarrow P_{Wide}$).

Next, the vehicle lighting fixture 400 of this reference example will be compared with the vehicle lighting fixture 300 of the second reference example. In this reference example, as illustrated in FIGS. 24 and 25, the vehicle lighting fixture 300 can be configured such that the laser light rays emitted from the respective excitation light sources $\mathbf{12}_{Wide}$, $\mathbf{12}_{Mid}$, and $\mathbf{12}_{Hot}$ as the excitation light rays can be directly incident on the corresponding optical deflectors $\mathbf{201}_{Wide}$, $\mathbf{201}_{Mid}$, and $\mathbf{201}_{Hot}$, respectively. The vehicle lighting fixture 400 of this reference example is different from the previous one in that, as illustrated in FIGS. 34 and 35, once the laser light rays emitted from the respective excitation light sources $\mathbf{12}_{Wide}$, $\mathbf{12}_{Mid}$, and $\mathbf{12}_{Hot}$ as the excitation light rays can be reflected by corresponding reflection surfaces $\mathbf{60}_{Wide}$, $\mathbf{60}_{Mid}$, and $\mathbf{60}_{Hot}$, respectively and then incident on the corresponding optical deflectors $\mathbf{201}_{Wide}$, $\mathbf{201}_{Mid}$, and $\mathbf{201}_{Hot}$, respectively.

The configuration of the vehicle lighting fixture 400 of the present reference example can have the same configuration as that of the vehicle lighting fixture 300 of the second reference example except for the above different point. Hereinbelow, a description will be given of the different point of the present reference example from the second reference example, and the same or similar components of the present reference example as those in the second reference example will be denoted by the same reference numerals and a description thereof will be omitted as appropriate.

The vehicle lighting fixture 400 can be configured, as illustrated in FIGS. 34 and 35, as a vehicle headlamp. The vehicle lighting fixture 400 can include three excitation light sources $\mathbf{12}_{Wide}$, $\mathbf{12}_{Mid}$, and $\mathbf{12}_{Hot}$; three reflection surfaces $\mathbf{60}_{Wide}$, $\mathbf{60}_{Mid}$, and $\mathbf{60}_{Hot}$ provided corresponding to the three excitation light sources $\mathbf{12}_{Wide}$, $\mathbf{12}_{Mid}$, and $\mathbf{12}_{Hot}$; three optical deflectors $\mathbf{201}_{Wide}$, $\mathbf{201}_{Mid}$, and $\mathbf{201}_{Hot}$ each including a mirror part 202, a wavelength conversion member 18, a projector lens assembly 20, etc. The three optical deflectors $\mathbf{201}_{Wide}$, $\mathbf{201}_{Mid}$, and $\mathbf{201}_{Hot}$ can be provided corresponding to the three reflection surfaces $\mathbf{60}_{Wide}$, $\mathbf{60}_{Mid}$, and $\mathbf{60}_{Hot}$. The wavelength conversion member 18 can include three scanning regions $A_{Wide}$, $A_{Mid}$, and $A_{Hot}$ (see FIG. 21) provided corresponding to the three optical deflectors $\mathbf{201}_{Wide}$, $\mathbf{201}_{Mid}$, and $\mathbf{201}_{Hot}$. Partial light intensity distributions can be formed within the respective scanning regions $A_{Wide}$, $A_{Mid}$, and $A_{Hot}$, and can be projected through the projector lens assembly 20 serving as an optical system to thereby form the predetermined light distribution pattern P. Note that the number of the excitation light sources 12, the reflection surfaces 60, the optical deflectors 201, and the scanning regions A is not limited to three, and may be two or four or more.

As illustrated in FIG. 34, the projector lens assembly 20, the wavelength conversion member 18, and the optical deflectors $\mathbf{201}_{Wide}$, $\mathbf{201}_{Mid}$, and $\mathbf{201}_{Hot}$ can be disposed in this order along a reference axis AX (or referred to as an optical axis) extending in the front-rear direction of a vehicle body.

The vehicle lighting fixture 400 can further include a laser holder 46A. The laser holder 46A can be disposed to surround the reference axis AX and can hold the excitation light sources $\mathbf{12}_{Wide}$, $\mathbf{12}_{Mid}$, and $\mathbf{12}_{Hot}$ with a posture tilted in such a manner that excitation light rays $Ray_{Wide}$, $Ray_{Mid}$, and $Ray_{Hot}$ are directed forward and toward the reference axis AX.

Specifically, the excitation light sources $\mathbf{12}_{Wide}$, $\mathbf{12}_{Mid}$, and $\mathbf{12}_{Hot}$ can be disposed by being fixed to the laser holder 46A in the following manner.

As illustrated in FIG. 34, the laser holder 46A can be configured to include extension parts 46AU, 46AD, 46AL, and 46AR each radially extending from the outer peripheral face of an optical deflector holder 58 at its upper, lower, left, or right part in a forward and obliquely upward, forward and obliquely downward, forward and obliquely leftward, or forward and obliquely rightward direction.

As illustrated in FIG. 34, the wide-zone excitation light source $\mathbf{12}_{Wide}$ can be fixed to the front face of the extension part 46AD with a posture tilted so that the excitation light rays $Ray_{Wide}$ is directed to a forward and obliquely upward direction. Similarly, the middle-zone excitation light source $\mathbf{12}_{Mid}$ can be fixed to the front face of the extension part 46AU with a posture tilted so that the excitation light rays $Ray_{Mid}$ is directed to a forward and obliquely downward direction. Similarly, the hot-zone excitation light source $\mathbf{12}_{Hot}$ can be fixed to the front face of the extension part 46AL with a posture tilted so that the excitation light rays $Ray_{Mid}$ is directed to a forward and obliquely leftward direction.

The vehicle lighting fixture 400 can further include a lens holder 56 to which the projector lens assembly 20 (lenses 20A to 20D) is fixed. The lens holder 56 can be screwed at its rear end to the opening of a tubular part 48 so as to be fixed to the tubular part 48.

A condenser lens 14 can be disposed in front of each of the excitation light sources $\mathbf{12}_{Wide}$, $\mathbf{12}_{Mid}$, and $\mathbf{12}_{Hot}$. The excitation light rays $Ray_{Wide}$, $Ray_{Mid}$, and $Ray_{Hot}$ can be emitted from the respective excitation light sources $\mathbf{12}_{Wide}$, $\mathbf{12}_{Mid}$, and $\mathbf{12}_{Hot}$ and condensed by the respective condenser lenses 14 (for example, collimated) to be incident on and reflected by the respective reflection surfaces $\mathbf{60}_{Wide}$, $\mathbf{60}_{Mid}$, and $\mathbf{60}_{Hot}$, and then be incident on the respective mirror parts 202 of the optical deflectors $\mathbf{201}_{Wide}$, $\mathbf{201}_{Mid}$, and $\mathbf{201}_{Hot}$.

As illustrated in FIG. 34, the reflection surfaces $\mathbf{60}_{Wide}$, $\mathbf{60}_{Mid}$, and $\mathbf{60}_{Hot}$ can be disposed to surround the reference axis AX and be closer to the reference axis AX than the excitation light sources $\mathbf{12}_{Wide}$, $\mathbf{12}_{Mid}$, and $\mathbf{12}_{Hot}$. The reflection surfaces $\mathbf{60}_{Wide}$, $\mathbf{60}_{Mid}$, and $\mathbf{60}_{Hot}$ can be fixed to a reflector holder 62 such that each posture is tilted to be closer to the reference axis AX and also the excitation light rays emitted from the excitation light sources $\mathbf{12}_{Wide}$, $\mathbf{12}_{Mid}$, and $\mathbf{12}_{Hot}$ can be incident on the corresponding reflection surfaces $\mathbf{60}_{Wide}$, $\mathbf{60}_{Mid}$, and $\mathbf{60}_{Hot}$, and reflected by the same to be directed rearward and toward the reference axis AX.

Specifically, the reflection surfaces $\mathbf{60}_{Wide}$, $\mathbf{60}_{Mid}$, and $\mathbf{60}_{Hot}$ can be secured to the reflector holder 62 as follows.

The reflector holder 62 can include a ring-shaped extension 64 extending from the rear end of the tubular part 48 that extend in the reference axis AX direction toward the rear and outer side. The ring-shaped extension 64 can have a rear surface tilted so that an inner rim thereof closer to the reference axis AX is positioned more forward than an outer rim thereof, as can be seen from FIG. 34.

The wide-zone reflection surface $\mathbf{60}_{Wide}$ can be secured to a lower portion of the rear surface of the ring-shaped extension 64 with a tilted posture such that the excitation light rays $Ray_{Wide}$ can be reflected thereby to a rearward and obliquely upward direction. Similarly, the middle-zone reflection surface $\mathbf{60}_{Mid}$ can be secured to an upper portion of the rear surface of the ring-shaped extension 64 with a tilted posture such that the excitation light rays $Ray_{Mid}$ can be reflected thereby to a rearward and obliquely downward direction. Similarly, the hot-zone reflection surface $\mathbf{60}_{Hot}$ (not illustrated) can be secured to a left portion of the rear surface of the ring-shaped extension 64 with a tilted posture such that the excitation light rays $Ray_{Hot}$ can be reflected thereby to a rearward and obliquely rightward direction.

As illustrated in FIG. 35, the optical deflectors $\mathbf{201}_{Wide}$, $\mathbf{201}_{Mid}$, and $\mathbf{201}_{Hot}$ with the above-described configuration can be disposed to surround the reference axis AX and be closer to the reference axis AX than the reflection surfaces $\mathbf{60}_{Wide}$, $\mathbf{60}_{Mid}$, and $\mathbf{60}_{Hot}$ so that the excitation light rays from the corresponding reflection surfaces $\mathbf{60}_{Wide}$, $\mathbf{60}_{Mid}$, and $\mathbf{60}_{Hot}$ as reflected light rays can be incident on the corresponding mirror parts 202 of the optical deflectors $\mathbf{201}_{Wide}$, $\mathbf{201}_{Mid}$, and $\mathbf{201}_{Hot}$ and reflected by the same to be directed to the corresponding scanning regions $A_{Wide}$, $A_{Mid}$, and $A_{Hot}$, respectively.

Specifically, the optical deflectors $\mathbf{201}_{Wide}$, $\mathbf{201}_{Mid}$, and $\mathbf{201}_{Hot}$ can be secured to an optical deflector holder 58 in the same manner as in the second reference example.

The wide-zone optical deflector $\mathbf{201}_{Wide}$ (corresponding to the first optical deflector) can be secured to the lower face 58D of the square pyramid face while being tilted so that the mirror part 202 thereof is positioned in an optical path of the excitation light rays $Ray_{Wide}$ reflected from the wide-zone reflection surface $\mathbf{60}_{Wide}$. Similarly thereto, the middle-zone optical deflector $\mathbf{201}_{Mid}$ (corresponding to the second optical deflector) can be secured to the upper face 58U of the square pyramid face while being tilted so that the mirror part 202 thereof is positioned in an optical path of the excitation light rays $Ray_{Mid}$ reflected from the middle-zone reflection surface $\mathbf{60}_{Mid}$. Similarly thereto, the hot-zone optical deflector $\mathbf{201}_{Hot}$ (corresponding to the third optical deflector) can be secured to the left face 58L (when viewed from front) of the square pyramid face while being tilted so that the mirror part 202 thereof is positioned in an optical path of the excitation light rays $Ray_{Hot}$ reflected from the hot-zone reflection surface $\mathbf{60}_{Hot}$.

The optical deflectors $\mathbf{201}_{Wide}$, $\mathbf{201}_{Mid}$, and $\mathbf{201}_{Hot}$ each can be arranged so that the first axis X1 is contained in a vertical plane and the second axis X2 is contained in a horizontal plane. As a result, the above-described arrangement of the optical deflectors $\mathbf{201}_{Wide}$, $\mathbf{201}_{Mid}$, and $\mathbf{201}_{Hot}$ can easily form (draw) a predetermined light distribution pattern (two-dimensional image corresponding to the required predetermined light distribution pattern) being wide in the horizontal direction and narrow in the vertical direction required for a vehicular headlight.

The wide-zone optical deflector $\mathbf{201}_{Wide}$ can draw a first two-dimensional image on the wide-zone scanning region $A_{Wide}$ (corresponding to the first scanning region) with the excitation light rays $Ray_{Wide}$ two-dimensionally scanning in the horizontal and vertical directions by the mirror part 202 thereof, to thereby form a first light intensity distribution on the wide-zone scanning region $A_{Wide}$.

The middle-zone optical deflector $\mathbf{201}_{Mid}$ can draw a second two-dimensional image on the middle-zone scanning region $A_{Mid}$ (corresponding to the second scanning region) with the excitation light rays $Ray_{Mid}$ two-dimensionally scanning in the horizontal and vertical directions by the mirror part 202 thereof in such a manner that the second two-dimensional image overlaps the first two-dimensional image in part, to thereby form a second light intensity distribution on the middle-zone scanning region $A_{Mid}$ with a higher light intensity than that of the first light intensity distribution.

As illustrated in FIG. 21, the middle-zone scanning region $A_{Mid}$ can be smaller than the wide-zone scanning region $A_{Wide}$ in size and overlap part of the wide-zone scanning region $A_{Wide}$. As a result of the overlapping, the overlapped middle-zone scanning region $A_{Mid}$ can have the relatively higher light intensity distribution.

The hot-zone optical deflector $\mathbf{201}_{Hot}$ can draw a third two-dimensional image on the hot-zone scanning region $A_{Hot}$ (corresponding to the third scanning region) with the excitation light rays $Ray_{Hot}$ two-dimensionally scanning in the horizontal and vertical directions by the mirror part 202 thereof in such a manner that the third two-dimensional image overlaps the first and second two-dimensional images in part, to thereby form a third light intensity distribution on the hot-zone scanning region $A_{Hot}$ with a higher light intensity than that of the second light intensity distribution.

As illustrated in FIG. 21, the hot-zone scanning region $A_{Hot}$ can be smaller than the middle-zone scanning region $A_{Mid}$ in size and overlap part of the middle-zone scanning region $A_{Mid}$. As a result of the overlapping, the overlapped hot-zone scanning region $A_{Hot}$ can have the relatively higher light intensity distribution.

The shape of each of the illustrated scanning regions $A_{Wide}$, $A_{Mid}$, and $A_{Hot}$ in FIG. 21 is a rectangular outer shape, but it is not limitative. The outer shape thereof can be a circle, an oval, or other shapes.

The vehicle lighting fixture 400 can include a phosphor holder 52 to which the wavelength conversion member 18 can be secured as in the second reference example.

In the present reference example, the sizes (horizontal length and vertical length) of the scanning regions $A_{Wide}$, $A_{Mid}$, and $A_{Hot}$ can be adjusted by the same technique as in the second reference example.

With the vehicle lighting fixture having the above-described configuration in the present reference example, which utilizes a plurality of optical deflectors configured to scan with excitation light in a two-dimensional manner, it is possible to miniaturize its size and reduce the parts number, which has been a cause for cost increase as in the second reference example.

With the vehicle lighting fixture having the above-described configuration in the present reference example, which utilizes a plurality of optical deflectors configured to scan with excitation light in a two-dimensional manner, as illustrated in FIG. 26, a predetermined light distribution pattern P (for example, high-beam light distribution pattern) excellent in far-distance visibility and sense of light distribution can be formed. The predetermined light distribution pattern P of FIG. 26 can be configured such that the light intensity in part, for example, at the center ($P_{Hot}$), is relatively high and the light intensity is gradually lowered from that part, or the center, to the periphery ($P_{Hot} \rightarrow P_{Mid} \rightarrow P_{Wide}$).

According to the present reference example, when compared with the above-described vehicle lighting fixture 300 (lighting unit), although the efficiency may be slightly lowered due to the additional reflection, the vehicle lighting fixture 400 can be miniaturized in the up-down and left-right directions (vertical and horizontal direction).

A description will now be given of a modified example.

The aforementioned reference examples have dealt with the cases where the semiconductor light emitting elements that can emit excitation light rays are used as the excitation light sources 12 ($\mathbf{12}_{Wide}$, $\mathbf{12}_{Mid}$, and $\mathbf{12}_{Hot}$), but it is not limitative.

Figure 36:
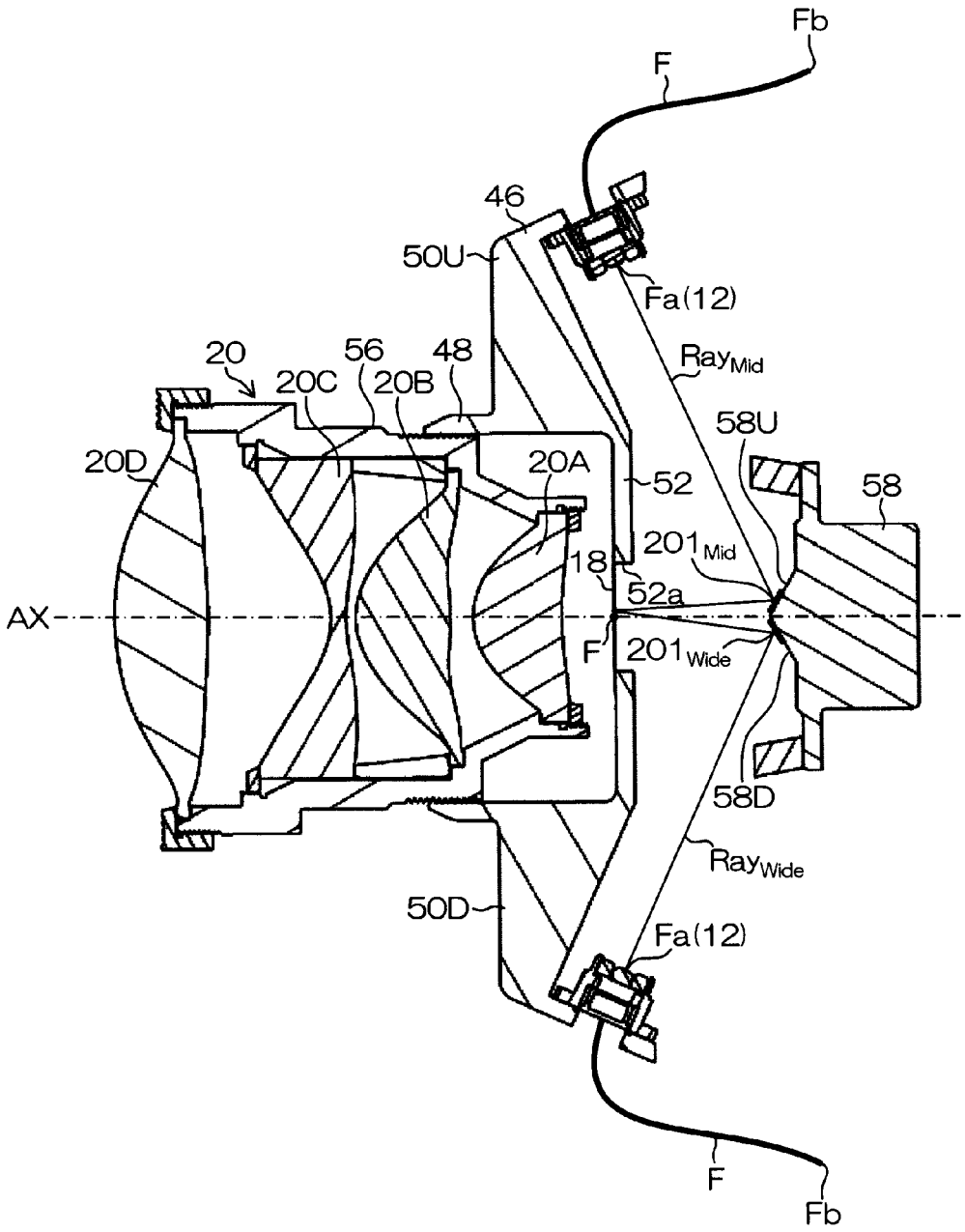
FIG. 36 is a vertical cross-sectional view of another modified example of the vehicle lighting fixture 300.

For example, as the excitation light sources 12 ($\mathbf{12}_{Wide}$, $\mathbf{12}_{Mid}$, and $\mathbf{12}_{Hot}$), output end faces Fa of optical fibers Fb that can output excitation light rays may be used as illustrated in FIGS. 31 and 36.

In particular, when the output end faces Fa of optical fibers F guiding and outputting excitation light rays are used as a plurality of excitation light sources 12 ($\mathbf{12}_{Hot}$, $\mathbf{12}_{Mid}$, and $\mathbf{12}_{Wide}$), the excitation light source, such as a semiconductor light emitting element (not illustrated), can be disposed at a position away from the main body of the vehicle lighting fixture 10. This configuration can make it possible to further miniaturize the vehicle lighting fixture and reduce its weight.

FIG. 36 shows an example in which three optical fibers F are combined with not-illustrated three excitation light sources disposed outside of the vehicle lighting fixture. Here, the optical fiber F can be configured to include a core having an input end face Fb for receiving excitation laser light and an output end face Fa for outputting the excitation laser light, and a clad configured to surround the core. Note that FIG. 36 does not show the hot-zone optical fiber F due to the cross-sectional view.

FIG. 31 shows an example in which the vehicle lighting fixture can include a single excitation light source 12 and an optical distributor 68 that can divide excitation laser light rays from the excitation light source 12 into a plurality of (for example, three) bundles of laser light rays and distribute the plurality of bundles of light rays. The vehicle lighting fixture can further include optical fibers F the number of which corresponds to the number of division of laser light rays. The optical fiber F can be configured to have a core with an input end face Fb and an output end face Fa and a clad surrounding the core. The distributed bundles of the light rays can be incident on the respective input end faces Fb, guided through the respective cores of the optical fibers F and output through the respective output end faces Fa.

Figure 37:
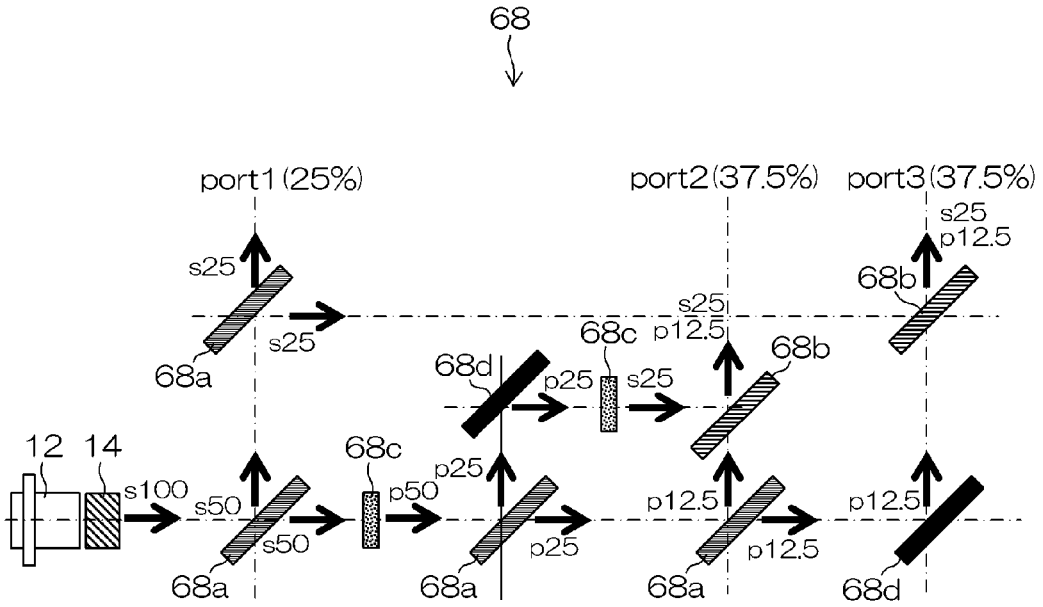
FIG. 37 is a diagram illustrating an example of an internal configuration of an optical distributor 68.

FIG. 37 shows an example of an internal structure of the optical distributor 68. The optical distributor 68 can be configured to include a plurality of non-polarizing beam splitters 68*a*, polarizing beam splitter 68*b*, a ½λ plate 68*c*, and mirrors 68*d*, which are arranged in the manner described in FIG. 37. With the optical distributor 68 having this configuration, excitation laser light rays emitted from the excitation light source 12 and condensed by the condenser lens 14 can be distributed to the ratios of 25%, 37.5%, and 37.5%.

With this modified example, the same or similar advantageous effects as or to those in the respective reference examples can be obtained.

Next, a description will be given of, as a fourth reference example, a technique of forming a light intensity distribution having a relatively high intensity region in part (and a predetermined light distribution pattern having a relatively high intensity region in part) by means of an optical deflector 201 (see FIG. 4) of the one-dimensional nonresonance/one-dimensional resonance type (2-D optical scanner (fast resonant and slow static combination)) in the vehicle lighting fixture 10 (see FIG. 2) as described in the above-mentioned reference example.

First, with reference to (a) of FIG. 38, a description will be given of a technique of forming a light intensity distribution having a relatively high intensity region B1 in the vicinity of its center part (see the region surrounded by an alternate dash and long chain line in (a) of FIG. 38) (and a predetermined light distribution pattern having a relatively high intensity region in part) as the light intensity distribution having a relatively high intensity region in part (and the predetermined light distribution pattern having a relatively high intensity region in part in the vicinity of its center part). The technique will be described by applying it to the reference example of FIG. 2 in order to facilitate the understanding the technique with a simple configuration. Therefore, it should be appreciated that this technique can be applied to any of the vehicle lighting fixtures described above as the reference examples.

The vehicle lighting fixture 10 in the following description can be configured to include a controlling unit (for example, such as the controlling unit 24 and the MEMS power circuit 26 illustrated in FIG. 11) for resonantly controlling the first piezoelectric actuators 203 and 204 and nonresonantly controlling the second piezoelectric actuators 205 and 206 in order to form a two-dimensional image on the scanning region A1 of the wavelength conversion member 18 by the excitation light rays scanning in a two-dimensional manner by the mirror part 202 of the optical deflector 201 of the one-dimensional nonresonance/one-dimensional resonance type (2-D optical scanner (fast resonant and slow static combination)). It is assumed that the output (or modulation rate) of the excitation light source 12 is constant and the optical deflector 201 utilizing a 2-D optical scanner (fast resonant and slow static combination) can be arranged so that the first axis X1 is contained in a vertical plane and the second axis X2 is contained in a horizontal plane.

Figure 38:
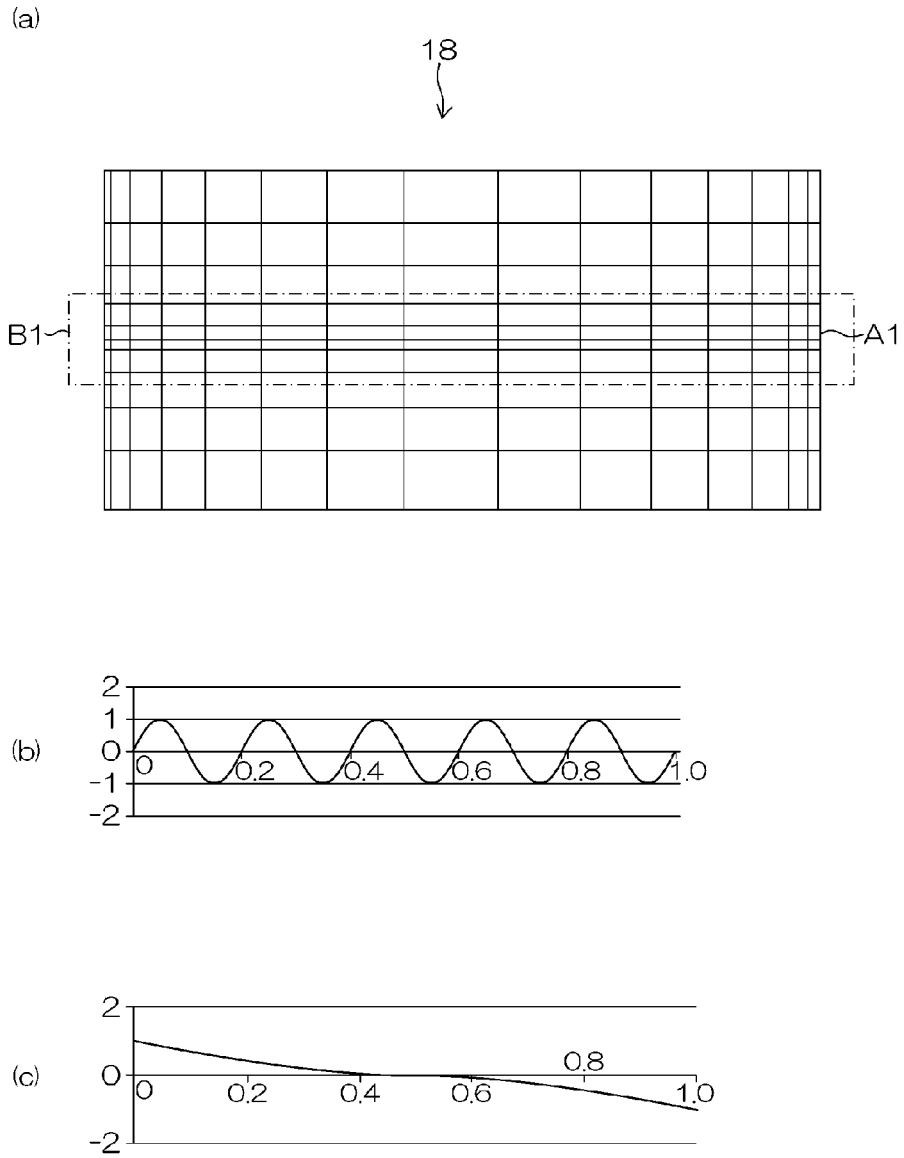
FIG. 38 includes graphs showing (a) an example of a light intensity distribution in which the light intensity at a region B1 in the vicinity of its center is relatively high, (b) an example of a drive signal (sinusoidal wave) in order to form the light intensity distribution of (a), and (c) an example of a drive signal (sawtooth wave or rectangular wave) including a nonlinear region in order to form the light intensity distribution of (a)

The (a) of FIG. 38 shows an example of a light intensity distribution wherein the light intensity in the region B1 in the vicinity of the center area is relatively high. In this case, the scanning region A1 of the wavelength conversion member 18 can be scanned by the excitation light rays in the two-dimensional manner by means of the mirror part 202 to draw a two-dimensional image, thereby forming a light intensity distribution image having a relatively high intensity area in the scanning region A1 of the wavelength conversion member 18. Note that the scanning region A1 is not limited to the rectangular outer shape as illustrated in (a) of FIG. 38, but may be a circular, an oval, and other various shapes.

The light intensity distribution illustrated in (a) of FIG. 38 can have a horizontal center region (in the left-right direction in (a) of FIG. 38) with a relatively low intensity (further with relatively high intensity regions at or near both right and left ends) and a vertical center region B1 (in the up-down direction in (a) of FIG. 38) with a relatively high intensity (further with relatively low intensity regions at or near upper and lower ends). As a whole, the light intensity distribution can have the relatively high intensity region B1 at or near the center thereof required for use in a vehicle headlamp.

The light intensity distribution illustrated in (a) of FIG. 38 can be formed in the following manner. Specifically, the controlling unit can control the first piezoelectric actuators 203 and 204 to resonantly drive them on the basis of a drive signal (sinusoidal wave) shown in (b) of FIG. 38 and also can control the second piezoelectric actuators 205 and 206 to nonresonantly drive them on the basis of a drive signal (sawtooth wave or rectangular wave) including a nonlinear region shown in (c) of FIG. 38. Specifically, in order to form the light intensity distribution, the controlling unit can apply the drive voltage according to the drive signal (sinusoidal wave) shown in (b) of FIG. 38 to the first piezoelectric actuators 203 and 204 and also apply the drive voltage according to the drive signal (sawtooth wave or rectangular wave) including a nonlinear region shown in (c) of FIG. 38 to the second piezoelectric actuators 205 and 206. The reason therefor is as follows.

Specifically, assume a case where the optical deflector 201 of one-dimensional nonresonance/one-dimensional resonance type (2-D optical scanner (fast resonant and slow static combination)) applies the drive voltage according to the drive signal (sinusoidal wave) shown in (b) of FIG. 38 to the first piezoelectric actuators 203 and 204. In this case, the reciprocal swing speed (scanning speed in the horizontal direction) around the first axis X1 of the mirror part 202 can be maximized in the horizontal center region in the scanning region A1 of the wavelength conversion member 18 while it can be minimized in both the right and left ends in the horizontal direction. This is because, first, the drive signal shown in (b) of FIG. 38 is a sinusoidal wave, and second, the controlling unit can control the first piezoelectric actuators 203 and 204 to resonantly drive them on the basis of the drive signal (sinusoidal wave).

In this case, the amount of excitation light rays per unit area in the center region is relatively reduced where the reciprocal swing speed around the first axis X1 of the mirror part 202 is relatively high. Conversely, the amount of excitation light rays per unit area in both the left and right end regions is relatively increased where the reciprocal swing speed around the first axis X1 of the mirror part 202 is relatively low. As a result, the light intensity distribution as illustrated in (a) of FIG. 38 can have a relatively low intensity horizontal center region while having relatively high intensity regions at or near both right and left ends.

In (a) of FIG. 38, the distances between adjacent lines of the plurality of lines extending in the vertical direction represent the scanning distance per unit time of the excitation light rays from the excitation light source 12 to be scanned in the horizontal direction by the mirror part 202. Specifically, the distance between adjacent vertical lines can represent the reciprocal swing speed around the first axis X1 of the mirror part 202 (scanning speed in the horizontal direction). The shorter the distance is, the lower the reciprocal swing speed around the first axis X1 of the mirror part 202 (scanning speed in the horizontal direction) is.

With reference to (a) of FIG. 38, the distance between adjacent vertically extending lines is relatively wide in the vicinity of the center region, meaning that the reciprocal swing speed around the first axis X1 of the mirror part 202 is relatively high in the vicinity of the center region. Further, the distance between adjacent vertically extending lines is relatively narrow in the vicinity of both the left and right end regions, meaning that the reciprocal swing speed around the first axis X1 of the mirror part 202 is relatively low in the vicinity of the left and right end regions.

Specifically, assume a case where the optical deflector 201 of one-dimensional nonresonance/one-dimensional resonance type (2-D optical scanner (fast resonant and slow static combination)) applies the drive voltage according to the drive signal (sawtooth wave or rectangular wave) shown in (c) of FIG. 38 to the second piezoelectric actuators 205 and 206. In this case, the reciprocal swing speed (scanning speed in the vertical direction) around the second axis X2 of the mirror part 202 can become relatively low in the vertical center region B1 in the scanning region A1 of the wavelength conversion member 18. This is because, first, the drive signal (sawtooth wave or rectangular wave) including a nonlinear region shown in (c) of FIG. 38 is a drive signal including a nonlinear region that is adjusted such that the reciprocal swing speed around the second axis X2 of the mirror part 202 becomes relatively low while the center region B1 in the scanning region A1 of the wavelength conversion member 18 can be scanned by the excitation light rays in the two-dimensional manner by means of the mirror part 202 to draw a two-dimensional image in the region B1. Second, the controlling unit can control the second piezoelectric actuators 205 and 206 to nonresonantly drive them on the basis of the drive signal (sawtooth wave or rectangular wave).

In this case, the amount of excitation light rays per unit area in the center region B1 is relatively increased where the reciprocal swing speed around the second axis X2 of the mirror part 202 is relatively low. In addition, the pixels in the center region B1 are relatively dense to increase its resolution. Conversely, the amount of excitation light rays per unit area in both the upper and lower end regions is relatively decreased where the reciprocal swing speed around the second axis X2 of the mirror part 202 is relatively high. In addition, the pixels in the upper and lower end regions are relatively coarse to decrease its resolution. As a result, the light intensity distribution as illustrated in (a) of FIG. 38 can have the relatively high intensity vertical center region B1 while having relatively low intensity regions at or near both upper and lower ends.

In (a) of FIG. 38, the distances between adjacent lines of the plurality of lines extending in the horizontal direction represent the scanning distance per unit time of the excitation light rays from the excitation light source 12 to be scanned in the vertical direction by the mirror part 202. Specifically, the distance between adjacent horizontal lines can represent the reciprocal swing speed around the second axis X2 of the mirror part 202 (scanning speed in the vertical direction). The shorter the distance is, the lower the reciprocal swing speed around the second axis X2 of the mirror part 202 (scanning speed in the vertical direction) is. Also, the pixels are relatively dense to increase its resolution.

With reference to (a) of FIG. 38, the distance between adjacent horizontally extending lines is relatively narrow in the vicinity of the center region B1, meaning that the reciprocal swing speed around the second axis X2 of the mirror part 202 is relatively low in the vicinity of the center region B1. Further, the distance between adjacent horizontally extending lines is relatively wide in the vicinity of both the upper and lower end regions, meaning that the reciprocal swing speed around the second axis X2 of the mirror part 202 is relatively high in the vicinity of the upper and lower end regions.

In this manner, the light intensity distribution with a relatively high center region B1 in the scanning region A1 of the wavelength conversion member 18 can be formed as illustrated in (a) of FIG. 38. Since the formed light intensity distribution can have relatively high resolution as well as dense pixels in the vicinity of the center region B1, in which the apparent size of an opposing vehicle observed becomes relatively smaller and also can have relatively low resolution as well as coarse pixels in the vicinity of both the left and right end regions, in which the apparent size of an opposing vehicle observed becomes relatively large, it can be suitable for the formation of a high-beam light distribution pattern to achieve ADB. This light intensity distribution ((a) of FIG. 38) having the relatively high intensity region B1 in the vicinity of the center region can be projected forward by the projector lens assembly 20, thereby forming a high-beam light distribution pattern with a high intensity center region on a virtual vertical screen.

As a comparison, FIG. 39 shows a case where the controlling unit can apply a drive voltage according to a drive signal shown in (b) of FIG. 39 (the same as that in (b) of FIG. 38) to the first piezoelectric actuators 203 and 204 while applying a drive voltage according to a drive signal (sawtooth wave or rectangular wave) including a linear region shown in (c) of FIG. 39 to the second piezoelectric actuators 205 and 206 in place of the drive signal including a nonlinear region shown in (c) of FIG. 38, to thereby obtain the light intensity distribution shown in (a) of FIG. 39 formed in the scanning region A1 of the wavelength conversion member 18.

As shown in (a) of FIG. 39, the light intensity distribution in the horizontal direction can be configured such that the light intensity in the vicinity of horizontal center (left-right direction in (a) of FIG. 39) is relatively low (thus low in the left and right end regions) while the light intensity between the vertically upper and lower end regions is substantially uniform. This light intensity distribution is thus not suitable for use in a vehicle headlamp. Furthermore, the light intensity distribution in the vertical direction can be configured such that the light intensity between the vertical upper and lower end regions is substantially uniform while the drive signal shown in (c) of FIG. 39 is not a drive signal including a nonlinear region as shown in (c) of FIG. 38, but a drive signal including a linear region. As a result, the scanning speed in the vertical direction becomes constant.

As described above, in the vehicle lighting fixture of the present reference example, which utilizes the mirror part 202 of the optical deflector 201 of the one-dimensional nonresonance/one-dimensional resonance type (2-D optical scanner (fast resonant and slow static combination)) (see FIG. 4), the light intensity distribution with a relatively high intensity region in part (for example, in the center region B1) required for use in a vehicle lighting fixture (in particular, vehicle headlamp) can be formed (see (a) of FIG. 38).

This is because the controlling unit can control the second piezoelectric actuators 205 and 206 such that the reciprocal swing speed around the second axis X2 of the mirror part 202 can be relatively low while the two-dimensional image is drawn in a partial region (for example, the center region B1) of the scanning region A1 of the wavelength conversion member 18 with the excitation light rays scanning in the two-dimensional manner by the mirror part 202.

Further, according to the present reference example that utilizes the optical deflector 201 utilizing a 2-D optical scanner (fast resonant and slow static combination) (see FIG. 4), the predetermined light distribution pattern (for example, high-beam light distribution pattern) having a relatively high light intensity region in part (for example, the center region B1) can be formed.

This is because the light intensity distribution having a relatively high intensity region in part (for example, the region B1 in the vicinity of its center part, as shown in (a) of FIG. 38) can be formed, and in turn, the predetermined light distribution pattern having a relatively high intensity region in part (for example, high-beam light distribution pattern) can be formed by projecting the light intensity distribution having the relatively high intensity region in part (for example, the region B1 in the vicinity of its center part).

Furthermore, according to the present reference example, the light intensity distribution formed in the scanning region A1 can have relatively high resolution as well as dense pixels in the vicinity of the center region B1, in which the apparent size of an opposing vehicle observed becomes relatively smaller and also can have relatively low resolution as well as coarse pixels in the vicinity of both the left and right end regions, in which the apparent size of an opposing vehicle observed becomes relatively large, it can be suitable for the formation of a high-beam light distribution pattern to achieve ADB.

Further, by adjusting the drive signal (see (c) of FIG. 38) including a nonlinear region for controlling the second piezoelectric actuators 205 and 206, a relatively high light intensity distribution with a relatively high intensity region in any optional region other than the center region B1 can be formed, meaning that a predetermined light distribution pattern having a relatively high intensity region at any optional region can be formed.

Figure 40:
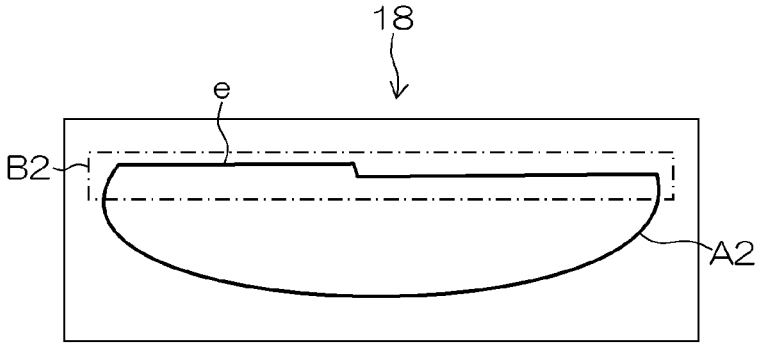
FIG. 40 is a diagram illustrating an example of a light intensity distribution in which the light intensity at a region B2 in the vicinity of the side e corresponding to a cut-off line is relatively high.

For example, as illustrated in FIG. 40, a light intensity distribution having a relatively high intensity region in a region B2 near its one side e corresponding to its cut-off line (see the region surrounded by alternate dash and dot line in FIG. 40) can be formed, thereby forming a low-beam light distribution pattern with a relatively high intensity region in the vicinity of the cut-off line. This can be easily achieved as follows. Specifically, as the drive signal (sawtooth wave or rectangular wave) including a nonlinear region shown for controlling the second piezoelectric actuators 205 and 206, the controlling unit can utilize a drive signal including a nonlinear region that is adjusted such that the reciprocal swing speed around the second axis X2 of the mirror part 202 becomes relatively low while the region B2 in the scanning region A2 of the wavelength conversion member 18 near its side e corresponding to the cut-off line can be scanned by the excitation light rays in the two-dimensional manner by means of the mirror part 202 to draw a two-dimensional image in the region B2.

Next, a description will be given of, as a fifth reference example, a technique of forming a light intensity distribution having a relatively high intensity region in part (and a predetermined light distribution pattern having a relatively high intensity region in part) by means of an optical deflectors 161 (see FIG. 16) of the two-dimensional nonresonance type in the vehicle lighting fixture 10 (see FIG. 2) as described in the above-mentioned first reference example in place of the optical deflector 201 of one-dimensional nonresonance/one-dimensional resonance type.

First, with reference to (a) of FIG. 41, a description will be given of a technique of forming a light intensity distribution having relatively high intensity regions B1 and B3 in the vicinity of its center parts (see the regions surrounded by an alternate dash and long chain line in (a) of FIG. 41) (and a predetermined light distribution pattern having relatively high intensity regions in part) as the light intensity distribution having relatively high intensity regions in part (and the predetermined light distribution pattern having relatively high intensity regions in part). The technique will be described by applying it to the reference example of FIG. 2 in order to facilitate the understanding the technique with a simple configuration. Therefore, it should be appreciated that this technique can be applied to any of the vehicle lighting fixtures described above as the reference examples and their modified examples thereof.

The vehicle lighting fixture 10 in the following description can be configured to include a controlling unit (for example, such as the controlling unit 24 and the MEMS power circuit 26 illustrated in FIG. 11) for nonresonantly controlling the first piezoelectric actuators 163 and 164 and the second piezoelectric actuators 165 and 166 in order to form a two-dimensional image on the scanning region A1 of the wavelength conversion member 18 by the excitation light rays scanning in a two-dimensional manner by the mirror part 162 of the optical deflector 161 of the two-dimensional nonresonance type. It is assumed that the output (or modulation rate) of the excitation light source 12 is constant and the optical deflector 161 of two-dimensional nonresonance type can be arranged so that the third axis X3 is contained in a vertical plane and the fourth axis X4 is contained in a horizontal plane.

The (a) of FIG. 41 shows an example of a light intensity distribution wherein the light intensity in the regions B1 and B3 in the vicinity of the center areas are relatively high. In this case, the scanning region A1 of the wavelength conversion member 18 can be scanned by the excitation light rays in the two-dimensional manner by means of the mirror part 162 to draw a two-dimensional image, thereby forming a light intensity distribution image having a relatively high intensity area in the scanning region A1 of the wavelength conversion member 18. Note that the scanning region A1 is not limited to the rectangular outer shape as illustrated in (a) of FIG. 41, but may be a circular, an oval, and other various shapes.

The light intensity distribution illustrated in (a) of FIG. 41 can have the horizontal center region B3 (in the left-right direction in (a) of FIG. 41) with a relatively high intensity (further with relatively low intensity regions at or near both right and left end regions) and the vertical center region B1 (in the up-down direction in (a) of FIG. 41) with a relatively high intensity (further with relatively low intensity regions at or near upper and lower end regions). As a whole, the light intensity distribution can have the relatively high intensity regions B1 and b3 at or near the center thereof required for use in a vehicle headlamp.

The light intensity distribution illustrated in (a) of FIG. 41 can be formed in the following manner. Specifically, the controlling unit can control the first piezoelectric actuators 163 and 164 to nonresonantly drive them on the basis of a first drive signal including a first nonlinear region (sawtooth wave or rectangular wave) shown in (b) of FIG. 41 and also can control the second piezoelectric actuators 165 and 166 to nonresonantly drive them on the basis of a second drive signal including a second nonlinear region (sawtooth wave or rectangular wave) shown in (c) of FIG. 41. Specifically, in order to form the light intensity distribution, the controlling unit can apply the drive voltage according to the first drive signal including the first nonlinear region (sawtooth wave or rectangular wave) shown in (b) of FIG. 41 to the first piezoelectric actuators 163 and 164 and also apply the drive voltage according to the second drive signal including the second nonlinear region (sawtooth wave or rectangular wave) shown in (c) of FIG. 41 to the second piezoelectric actuators 165 and 166. The reason therefor is as follows.

Specifically, assume a case where the optical deflector 161 of two-dimensional nonresonance type applies the drive voltage according to the first drive signal including the first nonlinear region (sawtooth wave or rectangular wave) shown in (b) of FIG. 41 to the first piezoelectric actuators 163 and 164. In this case, the reciprocal swing speed (scanning speed in the horizontal direction) around the third axis X3 of the mirror part 162 can be relatively reduced in the horizontal center region B3 in the scanning region A1 of the wavelength conversion member 18. This is because, first, the first drive signal including the first nonlinear region (sawtooth wave or rectangular wave) shown in (b) of FIG. 41 is a drive signal including a nonlinear region that is adjusted such that the reciprocal swing speed around the third axis X3 of the mirror part 162 becomes relatively low while the center region B3 in the scanning region A1 of the wavelength conversion member 18 can be scanned by the excitation light rays in the two-dimensional manner by means of the mirror part 162 to draw a two-dimensional image in the region B3. Second, the controlling unit can control the first piezoelectric actuators 163 and 164 to nonresonantly drive them on the basis of the first drive signal including the first nonlinear region (sawtooth wave or rectangular wave).

In this case, the amount of excitation light rays per unit area in the center region B3 is relatively increased where the reciprocal swing speed around the third axis X3 of the mirror part 162 is relatively low. In addition, the pixels in the center region B3 are relatively dense to increase its resolution. Conversely, the amount of excitation light rays per unit area in both the left and right end regions is relatively decreased where the reciprocal swing speed around the third axis X3 of the mirror part 162 is relatively high. In addition, the pixels in the left and right end regions are relatively coarse to decrease its resolution. As a result, the light intensity distribution as illustrated in (a) of FIG. 41 can have the relatively high intensity horizontal center region B3 while having relatively low intensity regions at or near both left and right end regions.

In (a) of FIG. 41, the distances between adjacent lines of the plurality of lines extending in the vertical direction represent the scanning distance per unit time of the excitation light rays from the excitation light source 12 to be scanned in the horizontal direction by the mirror part 162. Specifically, the distance between adjacent vertical lines can represent the reciprocal swing speed around the third axis X3 of the mirror part 162 (scanning speed in the horizontal direction). The shorter the distance is, the lower the reciprocal swing speed around the third axis X3 of the mirror part 162 (scanning speed in the horizontal direction) is. Also, the pixels are relatively dense to increase its resolution.

With reference to (a) of FIG. 41, the distance between adjacent vertically extending lines is relatively narrow in the vicinity of the center region B3, meaning that the reciprocal swing speed around the third axis X3 of the mirror part 162 is relatively low in the vicinity of the center region B3. Further, the distance between adjacent vertically extending lines is relatively wide in the vicinity of both the left and right end regions, meaning that the reciprocal swing speed around the third axis X3 of the mirror part 162 is relatively high in the vicinity of the left and right end regions.

On the other hand, assume a case where the optical deflector 161 of two-dimensional nonresonance type applies the drive voltage according to the second drive signal including the second nonlinear region (sawtooth wave or rectangular wave) shown in (c) of FIG. 41 to the second piezoelectric actuators 165 and 166. In this case, the reciprocal swing speed (scanning speed in the vertical direction) around the fourth axis X4 of the mirror part 162 can become relatively low in the vertical center region B1 in the scanning region A1 of the wavelength conversion member 18. This is because, first, the second drive signal including the second nonlinear region (sawtooth wave or rectangular wave) shown in (c) of FIG. 41 is a drive signal including a nonlinear region that is adjusted such that the reciprocal swing speed around the fourth axis X4 of the mirror part 162 becomes relatively low while the center region B1 in the scanning region A1 of the wavelength conversion member 18 can be scanned by the excitation light rays in the two-dimensional manner by means of the mirror part 162 to draw a two-dimensional image in the region B1. Second, the controlling unit can control the second piezoelectric actuators 165 and 166 to nonresonantly drive them on the basis of the second drive signal including the second nonlinear region (sawtooth wave or rectangular wave).

In this case, the amount of excitation light rays per unit area in the center region B1 is relatively increased where the reciprocal swing speed around the fourth axis X4 of the mirror part 162 is relatively low. In addition, the pixels in the center region B1 are relatively dense to increase its resolution.

In this case, the amount of excitation light rays per unit area in the upper and lower end regions is relatively decreased where the reciprocal swing speed around the fourth axis X4 of the mirror part 162 is relatively high. In addition, the pixels in the upper and lower end regions are relatively coarse to decrease its resolution. As a result, the light intensity distribution as illustrated in (a) of FIG. 41 can have the relatively high intensity vertical center region B1 while having relatively low intensity regions at or near both upper and lower end regions.

In (a) of FIG. 41, the distances between adjacent lines of the plurality of lines extending in the horizontal direction represent the scanning distance per unit time of the excitation light rays from the excitation light source 12 to be scanned in the vertical direction by the mirror part 162. Specifically, the distance between adjacent horizontal lines can represent the reciprocal swing speed around the fourth axis X4 of the mirror part 162 (scanning speed in the vertical direction). The shorter the distance is, the lower the reciprocal swing speed around the fourth axis X4 of the mirror part 162 (scanning speed in the vertical direction) is. Also, the pixels are relatively dense to increase its resolution.

With reference to (a) of FIG. 41, the distance between adjacent horizontally extending lines is relatively narrow in the vicinity of the center region B1, meaning that the reciprocal swing speed around the fourth axis X4 of the mirror part 162 is relatively low in the vicinity of the center region B1. Further, the distance between adjacent horizontally extending lines is relatively wide in the vicinity of both the upper and lower end regions, meaning that the reciprocal swing speed around the fourth axis X4 of the mirror part 162 is relatively high in the vicinity of the upper and lower end regions.

In this manner, the light intensity distribution with the relatively high center regions B1 and B3 in the scanning region A1 of the wavelength conversion member 18 can be formed as illustrated in (a) of FIG. 41. Since the formed light intensity distribution can have relatively high resolution as well as dense pixels in the vicinity of the center region B1, in which the apparent size of an opposing vehicle observed becomes relatively smaller and also can have relatively low resolution as well as coarse pixels in the vicinity of both the left and right end regions, in which the apparent size of an opposing vehicle observed becomes relatively large, it can be suitable for the formation of a high-beam light distribution pattern to achieve ADB. This light intensity distribution ((a) of FIG. 41) having the relatively high intensity regions B1 and B3 in the vicinity of the center regions can be projected forward by the projector lens assembly 20, thereby forming a high-beam light distribution pattern with a high intensity center region on a virtual vertical screen.

As a comparison, FIG. 42 shows a case where the controlling unit can apply a drive voltage according to a drive signal including a linear region (sawtooth wave or rectangular wave) shown in (b) of FIG. 42 to the first piezoelectric actuators 163 and 164 in place of the first drive signal including the first nonlinear region shown in (b) of FIG. 41. Furthermore, in this case, the controlling unit can apply a drive signal including a linear region (sawtooth wave or rectangular wave) shown in (c) of FIG. 42 to the second piezoelectric actuators 165 and 166 in place of the second drive signal including the second nonlinear region shown in (c) of FIG. 41, to thereby obtain the light intensity distribution shown in (a) of FIG. 42 formed in the scanning region A1 of the wavelength conversion member 18.

As shown in (a) of FIG. 42, the light intensity distribution in the horizontal direction can be configured such that the light intensity between the left and right end regions is substantially uniform in the horizontal direction (in the left-right direction in (a) of FIG. 42) and the light intensity between vertically upper and lower end regions is substantially uniform. This light intensity distribution is thus not suitable for use in a vehicle headlamp. Furthermore, the light intensity distribution in the horizontal direction can be configured such that the light intensity between left and right end regions is substantially uniform while the drive signal shown in (b) of FIG. 42 is not a drive signal including a nonlinear region as shown in (b) of FIG. 41, but a drive signal including a linear region. As a result, the scanning speed in the horizontal direction becomes constant. Similarly, the light intensity distribution in the vertical direction can be configured such that the light intensity between the vertical upper and lower end regions is substantially uniform while the drive signal shown in (c) of FIG. 42 is not a drive signal including a nonlinear region as shown in (c) of FIG. 41, but a drive signal including a linear region. As a result, the scanning speed in the vertical direction becomes constant.

As described above, in the vehicle lighting fixture of the present reference example, which utilizes the mirror part 162 of the optical deflector 161 of the two-dimensional nonresonance type (see FIG. 16), the light intensity distribution with a relatively high intensity region in part (for example, in the center regions B1 and B3) required for use in a vehicle lighting fixture (in particular, vehicle headlamp) can be formed (see (a) of FIG. 41).

This is because the controlling unit can control the first and second piezoelectric actuators 163, 164, 165, and 166 such that the reciprocal swing speed around the third and fourth axes X3 and X4 of the mirror part 162 can be relatively low while the two-dimensional image is drawn in a partial region (for example, the center regions B1 and B3) of the scanning region A1 of the wavelength conversion member 18 with the excitation light rays scanning in the two-dimensional manner by the mirror part 162.

Further, according to the present reference example that utilizes the optical deflector 161 of two-dimensional nonresonance type (see FIG. 16), the predetermined light distribution pattern (for example, high-beam light distribution pattern) having the relatively high light intensity regions in part (for example, the center regions B1 and B3) can be formed.

This is because the light intensity distribution having the relatively high intensity regions in part (for example, the regions B1 and B3 in the vicinity of its center part as shown in (a) of FIG. 41) can be formed, and in turn, the predetermined light distribution pattern having the relatively high intensity regions in part can be formed by projecting the light intensity distribution having the relatively high intensity regions in part (for example, the regions B1 and B3 in the vicinity of its center part).

Furthermore, according to the present reference example, the light intensity distribution formed in the scanning region A1 can have relatively high resolution as well as dense pixels in the vicinity of the center region B1, in which the apparent size of an opposing vehicle observed becomes relatively smaller and also can have relatively low resolution as well as coarse pixels in the vicinity of both the left and right end regions, in which the apparent size of an opposing vehicle observed becomes relatively large, it can be suitable for the formation of a high-beam light distribution pattern to achieve ADB.

Further, by adjusting the first and second drive signals including a nonlinear region for controlling the first and second piezoelectric actuators 163, 164, 165, and 166, a relatively high light intensity distribution with a relatively high intensity region in any optional region other than the center regions B1 and B3 can be formed, meaning that a predetermined light distribution pattern having a relatively high intensity region at any optional region can be formed.

For example, as illustrated in FIG. 40, a light intensity distribution having a relatively high intensity region in a region B2 near its one side e corresponding to its cut-off line (see the region surrounded by alternate dash and dot line in FIG. 40) can be formed, thereby forming a low-beam light distribution pattern with a relatively high intensity region in the vicinity of the cut-off line. This can be easily achieved as follows. Specifically, as the second drive signal including the second nonlinear region (sawtooth wave or rectangular wave) shown for controlling the second piezoelectric actuators 165 and 166, the controlling unit can utilize a drive signal including a nonlinear region that is adjusted such that the reciprocal swing speed around the fourth axis X4 of the mirror part 162 becomes relatively low while the region B2 in the scanning region A2 of the wavelength conversion member 18 near its side e corresponding to the cut-off line can be scanned by the excitation light rays in the two-dimensional manner by means of the mirror part 162 to draw a two-dimensional image in the region B2.

Next, as another reference example, a description will be given of a light intensity distribution shown in (a) of FIG. 43 in the vehicle lighting fixture 10 of the first reference example (see FIG. 2) that utilizes an optical deflector 201A of two-dimensional resonance type (see FIG. 17) in place of the optical deflector 201 of one-dimensional nonresonance/one-dimensional resonance type. Specifically, the light intensity distribution (see (a) of FIG. 43) can be formed in the scanning region A1 of the wavelength conversion member 18 by the controlling unit that applies a drive voltage according to a drive signal (sinusoidal wave) shown in (b) of FIG. 43 to the first piezoelectric actuators 15Aa and 15Ab and applies a drive voltage according to a drive signal (sinusoidal wave) shown in (c) of FIG. 43 to the second piezoelectric actuators 17Aa and 17Ab.

Specifically, the vehicle lighting fixture 10 in the following description can be configured to include a controlling unit (for example, such as the controlling unit 24 and the MEMS power circuit 26 illustrated in FIG. 11) for resonantly controlling the first piezoelectric actuators 15Aa and 15Ab and the second piezoelectric actuators 17Aa and 17Ab in order to form a two-dimensional image on the scanning region A of the wavelength conversion member 18 by the excitation light rays scanning in a two-dimensional manner by the mirror part 13A of the optical deflector 201A of the two-dimensional resonance type. It is assumed that the output (or modulation rate) of the excitation light source 12 is constant and the optical deflector 201A of two-dimensional resonance type can be arranged so that the fifth axis X5 is contained in a vertical plane and the sixth axis X6 is contained in a horizontal plane.

In this case, the light intensity distribution shown in (a) of FIG. 43 can include a horizontal center region (in the left-right direction in (a) of FIG. 43) with a relatively low intensity (further include relatively high intensity regions at or near both right and left ends) and a vertical center region (in the up-down direction in (a) of FIG. 43) with a relatively low intensity (further include relatively high intensity regions at or near upper and lower ends). Accordingly, the resulting light intensity distribution is not suitable for use in a vehicle headlamp.

A description will now be given of a technique for forming a high-beam light distribution pattern $P_{Hi}$ (see FIG. 44D) as a sixth reference example. Here, the high-beam light distribution pattern $P_{Hi}$ can be formed by overlaying a plurality of irradiation patterns $P_{Hot}$, $P_{Mid}$, and $P_{Wide}$ to form non-irradiation regions C1, C2, and C3 illustrated in FIGS. 44A to 44C.

Hereinafter, a description will be given of an example in which the high-beam light distribution pattern $P_{Hi}$ (see FIG. 44D) is formed by the vehicle lighting fixture 300 as illustrated in the second reference example (see FIGS. 21 to 25). It should be appreciated that the vehicle lighting fixture may be any of those described in the third reference example or may be a combination of a plurality of lighting units for forming the respective irradiation patterns $P_{Hot}$, $P_{Mid}$, and $P_{Wide}$. The number of the irradiation patterns for forming the high-beam light distribution pattern $P_{Hi}$ is not limited to three, but may be two or four or more.

The vehicle lighting fixture 300 can be configured to include an irradiation-prohibitive object detection unit configured to detect an object to which irradiation is prohibited such as a pedestrian and an opposing vehicle in front of a vehicle body in which the vehicle lighting fixture 300 is installed. The irradiation-prohibitive object detection unit may be configured to include an imaging device and the like, such as a camera 30 shown in FIG. 11.

Figure 44A:
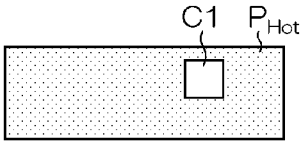
FIG. 44A is a diagram illustrating an example of an irradiation pattern $P_{Hot}$ for forming an unirradiation region C1.
Figure 44B:
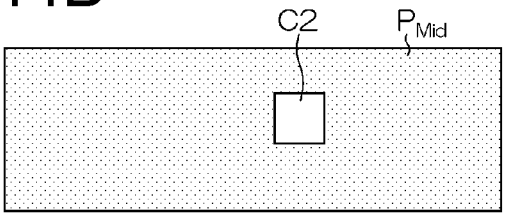
FIG. 44B is a diagram illustrating an example of an irradiation pattern $P_{Mid}$ for forming an unirradiation region C2.
Figure 44C:
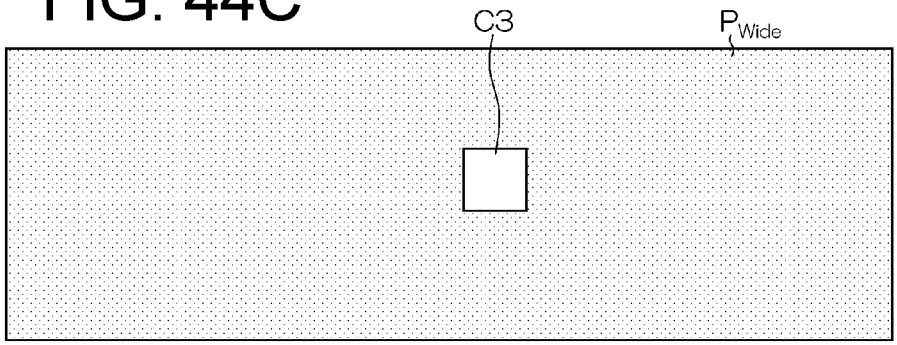
FIG. 44C is a diagram illustrating an example of an irradiation pattern $P_{Wide}$ for forming an unirradiation region C3.

FIG. 44A shows an example of an irradiation pattern $P_{Hot}$ in which the non-irradiation region C1 is formed, FIG. 44B an example of an irradiation pattern $P_{Mid}$ in which the non-irradiation region C2 is formed, and FIG. 44C an example of an irradiation pattern $P_{Wide}$ in which the non-irradiation region C3 is formed.

Figure 44D:
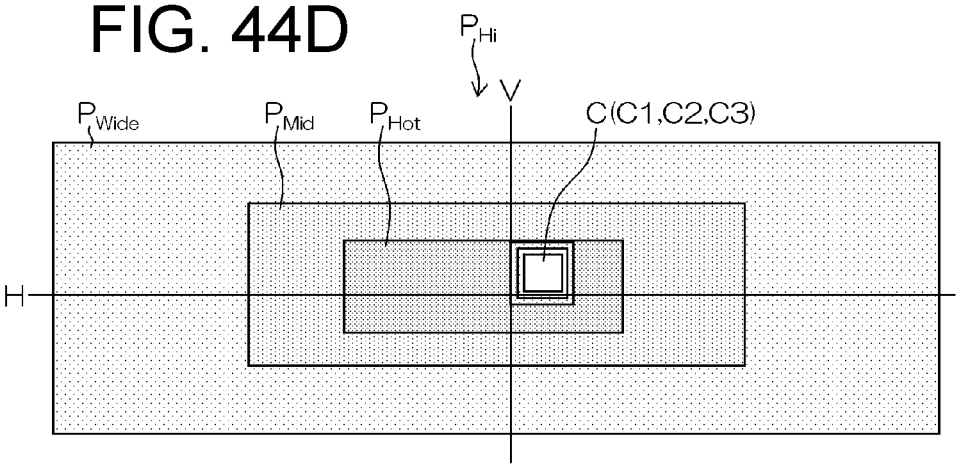
FIG. 44D is a diagram illustrating an example of a high-beam light distribution pattern $P_{Hi}$ configured by overlaying a plurality of irradiation patterns $P_{Hot}$, $P_{Mid}$, and $P_{Wide}$.

As shown in FIG. 44D, the plurality of irradiation patterns $P_{Hot}$, $P_{Mid}$, and $P_{Wide}$ can be overlaid on one another to overlay the non-irradiation regions C1, C2, and C3 thereby forming a non-irradiation region C.

Figure 45:
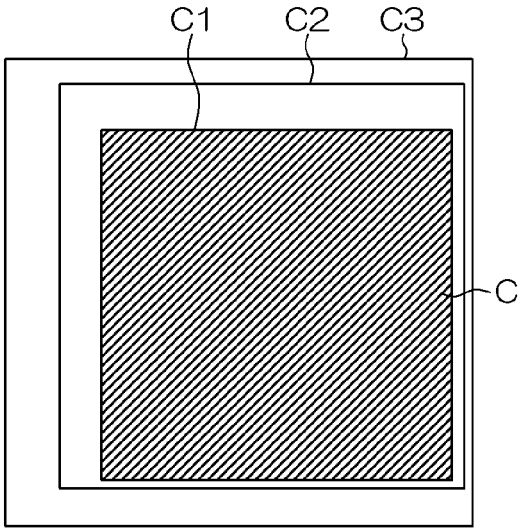
FIG. 45 is a diagram illustrating a state in which the nonirradiation regions C1, C2, and C3 are shifted from each other.

The non-irradiation regions C1, C2, and C3 each can have a different size, as illustrated in FIGS. 44A to 44D. By this setting, even when the non-irradiation regions C1, C2, and C3 formed by the respective irradiation patterns $P_{Hot}$, $P_{Mid}$, and $P_{Wide}$ are displaced from one another due to controlling error in the respective optical deflectors $\mathbf{201}_{Hot}$, $\mathbf{201}_{Mid}$, and $\mathbf{201}_{Wide}$, displacement of the optical axes, as shown in FIG. 45, the area of the resulting non-irradiation region C (see the hatched region in FIG. 45) can be prevented from decreasing. As a result, any glare light to the irradiation-prohibitive object can be prevented from being generated. This is because the sizes of the non-irradiation regions C1, C2, and C3 formed in the respective irradiation patterns $P_{Hot}$, $P_{Mid}$, and $P_{Wide}$ can be different from one another.

The non-irradiation regions C1, C2, and C3 (or the non-irradiation region C) can be formed in respective regions of the plurality of irradiation patterns $P_{Hot}$, $P_{Mid}$, and $P_{Wide}$ corresponding to the irradiation-prohibitive object detected by the irradiation-prohibitive object detection unit. Specifically, the non-irradiation regions C1, C2, and C3 (or the non-irradiation region C) can be formed in a different region corresponding to the position where the irradiation-prohibitive object is detected. As a result, any glare light to the irradiation-prohibitive object such as a pedestrian, an opposing vehicle, etc. can be prevented from being generated.

The plurality of irradiation patterns $P_{Hot}$, $P_{Mid}$, and $P_{Wide}$ can have respective different sizes, and can have a higher light intensity as the size thereof is smaller. By doing so, the vehicle lighting fixture 300 can be configured to form a high-beam light distribution pattern (see FIG. 44D) excellent in far-distance visibility and sense of light distribution. The predetermined light distribution pattern can be configured such that the center light intensity ($P_{Hot}$) is relatively high and the light intensity is gradually lowered from the center to the periphery ($P_{Hot} \rightarrow P_{Mid} \rightarrow P_{Wide}$).

The non-irradiation regions C1, C2, and C3 can have a smaller size as the irradiation pattern including the non-irradiation region is smaller. Therefore, the relation in size of the non-irradiation region C1<the non-irradiation region C2<the non-irradiation region C3 may hold. Therefore, the smallest non-irradiation region C1 can be formed in the smallest irradiation pattern $P_{Hot}$ (with the maximum light intensity). This means that the irradiation pattern $P_{Hot}$ can irradiate with light a wider region brighter when compared with the case where a smallest non-irradiation region C1 is formed in the irradiation patterns $P_{Mid}$ and $P_{Wide}$ other than the smallest irradiation pattern $P_{Hot}$. Furthermore, since the smallest non-irradiation region C1 is formed in the smallest irradiation pattern $P_{Hot}$ with the maximum light intensity, the bright/dark ratio near the contour of the non-irradiation region C can become relatively high (see FIG. 45) when compared with the case where a smallest non-irradiation region C1 is formed in the irradiation patterns $P_{Mid}$ and $P_{Wide}$ other than the smallest irradiation pattern $P_{Hot}$. As a result, the sharp and clear contour of the non-irradiation region C can be formed. It should be appreciated that the non-irradiation regions C1, C2, and C3 may have respective different sizes and the relation in size of the non-irradiation region C1<the non-irradiation region C2<the non-irradiation region C3 is not limitative. In order to blur the contour of the non-irradiation region C, the relation in size of the non-irradiation regions C1, C2, and C3 can be controlled as appropriate in place of the relationship described above.

The non-irradiation regions C1, C2, and C3 formed in the respective irradiation patterns $P_{Hot}$, $P_{Mid}$, and $P_{Wide}$ can have a similarity shape. Even when the non-irradiation regions C1, C2, and C3 formed by the respective irradiation patterns $P_{Hot}$, $P_{Mid}$, and $P_{Wide}$ are displaced from one another, the area of the resulting non-irradiation region C (see the hatched region in FIG. 45) can be prevented from decreasing. As a result, any glare light to the irradiation-prohibitive object can be prevented from being generated. It should be appreciated that the non-irradiation regions C1, C2, and C3 may have a shape other than a similarity shape as long as their sizes are different from each other. Furthermore, the shape thereof is not limited to a rectangular shape as shown in FIGS. 44A to 44D, but may be a circular shape, an oval shape, or other outer shapes.

The high-beam light distribution pattern $P_{Hi}$ shown in FIG. 44D can be formed on a virtual vertical screen by projecting the light intensity distributions formed by the respective scanning regions $A_{Hot}$, $A_{Mid}$, and $A_{Wide}$ by the projector lens assembly 20.

The light intensity distributions can be formed in the respective scanning regions $A_{Hot}$, $A_{Mid}$, and $A_{Wide}$ by the following procedures.

The wide-zone optical deflector $201_{Wide}$ can draw a first two-dimensional image on the wide-zone scanning region $A_{Wide}$ (see FIG. 21) (two-dimensional image corresponding to the irradiation pattern $P_{Wide}$ shown in FIG. 44C) with the excitation light rays $Ray_{Wide}$ two-dimensionally scanning in the horizontal and vertical directions by the mirror part 202 thereof, to thereby form a first light intensity distribution on the wide-zone scanning region $A_{Wide}$ (the light intensity distribution corresponding to the irradiation pattern $P_{Wide}$ shown in FIG. 44C).

The middle-zone optical deflector $201_{Mid}$ can draw a second two-dimensional image on the middle-zone scanning region $A_{Mid}$ (see FIG. 21) (two-dimensional image corresponding to the irradiation pattern $P_{Mid}$ shown in FIG. 44B) with the excitation light rays $Ray_{Wide}$ two-dimensionally scanning in the horizontal and vertical directions by the mirror part 202 thereof in such a manner that the second two-dimensional image overlaps the first two-dimensional image in part, to thereby form a second light intensity distribution on the middle-zone scanning region $A_{Mid}$ (the light intensity distribution corresponding to the irradiation pattern $P_{Mid}$ shown in FIG. 44B). Here, the light intensity of the second light intensity distribution is higher than that of the first light intensity distribution.

The hot-zone optical deflector $201_{Hot}$ can draw a third two-dimensional image on the hot-zone scanning region $A_{Hot}$ (see FIG. 21) (two-dimensional image corresponding to the irradiation pattern $P_{Hot}$ shown in FIG. 44A) with the excitation light rays $Ray_{Hot}$ two-dimensionally scanning in the horizontal and vertical directions by the mirror part 202 thereof in such a manner that the third two-dimensional image overlaps the first and second two-dimensional images in part, to thereby form a third light intensity distribution on the hot-zone scanning region $A_{Hot}$ (the light intensity distribution corresponding to the irradiation pattern $P_{Hot}$ shown in FIG. 44A). Here, the light intensity of the third light intensity distribution is higher than that of the second light intensity distribution.

It should be appreciated that the first to third light intensity distributions can be formed in the respective scanning regions $A_{Wide}$, $A_{Mid}$, and $A_{Hot}$ so as to include the non-irradiation region corresponding to the non-irradiation regions C1, C2, and C3 by overlaying the non-irradiation regions C1, C2, and C3 to form the non-irradiation region.

As described above, the light intensity distributions formed in the respective scanning regions $A_{Wide}$, $A_{Mid}$, and $A_{Hot}$ can be projected forward by the projector lens assembly 20, to thereby form the high-beam light distribution pattern $P_{Hi}$ on a virtual vertical screen as shown in FIG. 44D.

As described above, the present reference example can provide a vehicle lighting fixture configured to form a predetermined light distribution pattern (for example, a high-beam light distribution pattern) by overlaying a plurality of irradiation patterns $P_{Hot}$, $P_{Mid}$, and $P_{Wide}$ including the respective non-irradiation regions C1, C2, and C3. Thus, even when the non-irradiation regions C1, C2, and C3 formed in the respective irradiation patterns $P_{Hot}$, $P_{Mid}$, and $P_{Wide}$ are displaced from one another (as shown in FIG. 45), the area of the resulting non-irradiation region C (the shaded region in FIG. 45) can be prevented from decreasing, and as a result, any glare light toward irradiation-prohibitive objects can be prevented from occurring.

This can be achieved by designing the non-irradiation regions C1, C2, and C3 to have respective different sizes to be formed in the respective irradiation patterns $P_{Hot}$, $P_{Mid}$, and $P_{Wide}$.

Figure 46A:
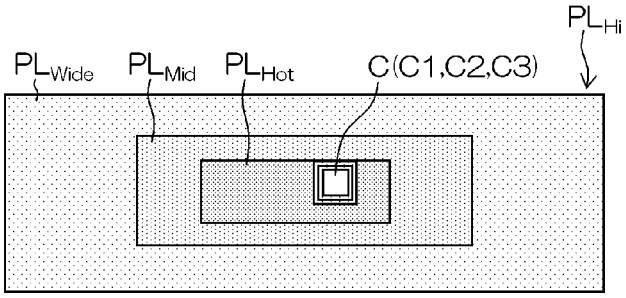
FIG. 46A is a diagram illustrating an example of a high-beam light distribution pattern $PL_{Hi}$ formed by a vehicle lighting fixture 300L disposed on the left side of a vehicle body front portion (on the left side of a vehicle body)
Figure 46B:
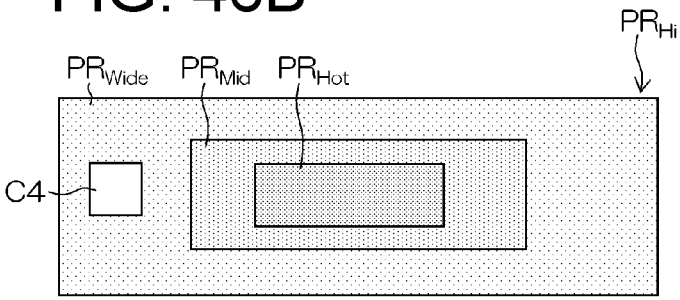
FIG. 46B is a diagram illustrating an example of a high-beam light distribution pattern $PR_{Hi}$ formed by a vehicle lighting fixture 300R disposed on the right side of the vehicle body front portion (on the front side of the vehicle body)

It should be appreciated that two vehicle lighting fixtures 300 can be used to form a single high-beam light distribution pattern $P_{Hi}$ (illustrated in FIG. 46C) by overlaying two high-beam light distribution patterns $PL_{Hi}$ and $PR_{Hi}$ as shown in FIGS. 46A and 46B.

FIG. 46A shows an example of the high-beam light distribution pattern $PL_{Hi}$ formed by a vehicle lighting fixture 300L disposed on the left side of a vehicle body front portion (on the left side of a vehicle body), and FIG. 46B an example of the high-beam light distribution pattern $PR_{Hi}$ formed by a vehicle lighting fixture 300R disposed on the right side of the vehicle body front portion (on the front side of the vehicle body). It should be appreciated that the high-beam light distribution patterns $PL_{Hi}$ and $PR_{Hi}$ are not limited to those formed by overlaying a plurality of irradiation patterns (irradiation patterns $PL_{Hot}$, $PL_{Mid}$, and $PL_{Wide}$ and irradiation patterns $PR_{Hot}$, $PR_{Mid}$, and $PR_{Wide}$), but may be formed by a single irradiation pattern or by a combination of two or four or more irradiation patterns overlaid with each other.

Figure 46C:
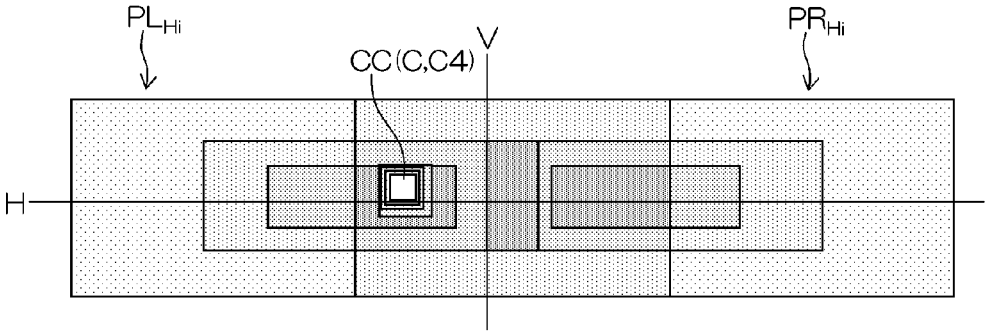
FIG. 46C is a diagram illustrating an example of a high-beam light distribution pattern $P_{Hi}$ configured by overlaying the two irradiation patterns $PL_{Hi}$ and $PR_{Hi}$.

The high-beam light distribution patterns $PL_{Hi}$ and $PR_{Hi}$, as illustrated in FIG. 46C, can be overlaid on each other so that the non-irradiation region C (non-irradiation regions C1, C2, and C3) and non-irradiation region C4 are overlaid on each other to form a non-irradiation region CC.

The non-irradiation region C (non-irradiation regions C1, C2, and C3) and non-irradiation region C4 can have respectively different sizes as illustrated in FIGS. 46A to 46C. For example, the relationship of the non-irradiation region C1<the non-irradiation region C2<the non-irradiation region C3<the non-irradiation region C4 may hold. Therefore, the smallest non-irradiation region C1 can be formed in the smallest irradiation pattern $P_{Hot}$ (with the maximum light intensity). This means that the irradiation pattern $P_{Hot}$ can irradiate with light a wider region brighter when compared with the case where a smallest non-irradiation region C1 is formed in the irradiation patterns $P_{Mid}$ and $P_{Wide}$ other than the smallest irradiation pattern $P_{Hot}$. Furthermore, since the smallest non-irradiation region C1 is formed in the smallest irradiation pattern $P_{Hot}$ with the maximum light intensity, the bright/dark ratio near the contour of the non-irradiation region CC can become relatively high (see FIG. 45) when compared with the case where a smallest non-irradiation region C1 is formed in the irradiation patterns $P_{Mid}$ and $P_{Wide}$ other than the smallest irradiation pattern $P_{Hot}$. As a result, the sharp and clear contour of the non-irradiation region CC can be formed. It should be appreciated that the non-irradiation regions C1, C2, C3, and C4 may have respective different sizes and the relation in size of the non-irradiation region C1<the non-irradiation region C2<the non-irradiation region C3<the non-irradiation region C4 is not limitative. In order to blur the contour of the non-irradiation region CC, the relation in size of the non-irradiation regions C1, C2, C3, and C4 can be controlled as appropriate in place of the relationship described above.

A description will now be given of a vehicle lighting fixture according to a first exemplary embodiment configured to form a predetermined light distribution pattern, wherein the predetermined light distribution can be formed with resolutions different in part, for example, in which the resolution in the horizontal direction is high at the center area and is gradually lowered toward the outer periphery from the center area.

Figure 47:
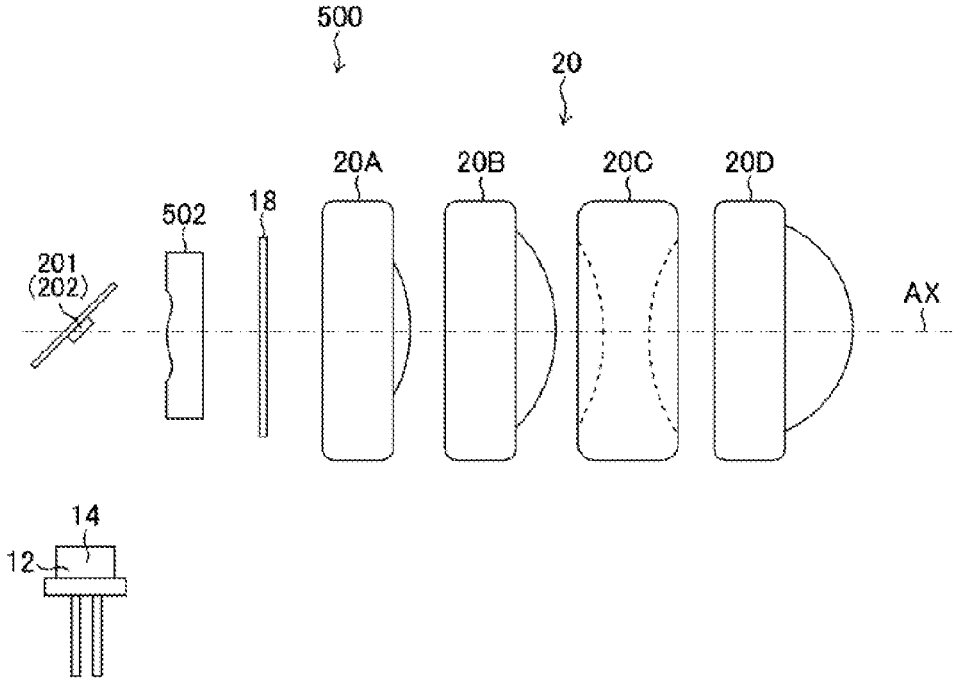
FIG. 47 is a schematic diagram illustrating a vehicle lighting fixture 500 according to a first exemplary embodiment made in accordance with principles of the presently disclosed subject matter.

FIG. 47 is a schematic diagram illustrating a vehicle lighting fixture 500 according to the first exemplary embodiment made in accordance with the principles of the presently disclosed subject matter.

The basic configuration of the vehicle lighting fixture 500 according to this exemplary embodiment can be the same as or similar to the configuration of the vehicle lighting fixture 10 according to the first reference example. As shown in FIG. 47, the vehicle lighting fixture 500 can include an excitation light source 12, a condenser lens 14, an optical deflector 201, a multifocal lens 502, a wavelength conversion member 18 (corresponding to the screen member in the presently disclosed subject matter), a projector lens assembly 20, etc. Here, the optical deflector 201 can be configured to include a mirror part 202 and scan with excitation light, having been emitted from the excitation light source 12 and condensed by the condenser lens 14, in a two-dimensional manner (in horizontal and vertical directions). The excitation light two-dimensionally scanning by the optical deflector 201 can pass through the multifocal lens 502 and form a luminance distribution in the wavelength conversion member 18 corresponding to a predetermined light distribution pattern. The luminance distribution formed in the wavelength conversion member 18 can be projected forward of a vehicle body by the projector lens assembly 20 as an optical system configured to form the predetermined light distribution pattern. The vehicle lighting fixture 500 can include the multifocal lens 502, which is the different point from the vehicle lighting fixture 10 of the first reference example.

Hereinbelow, a description will be given of the different point of the present exemplary embodiment from the first reference example, and the same or similar components of the present exemplary embodiment as those in the first reference example will be denoted by the same reference numerals and a description thereof will be omitted as appropriate.

Figure 48:
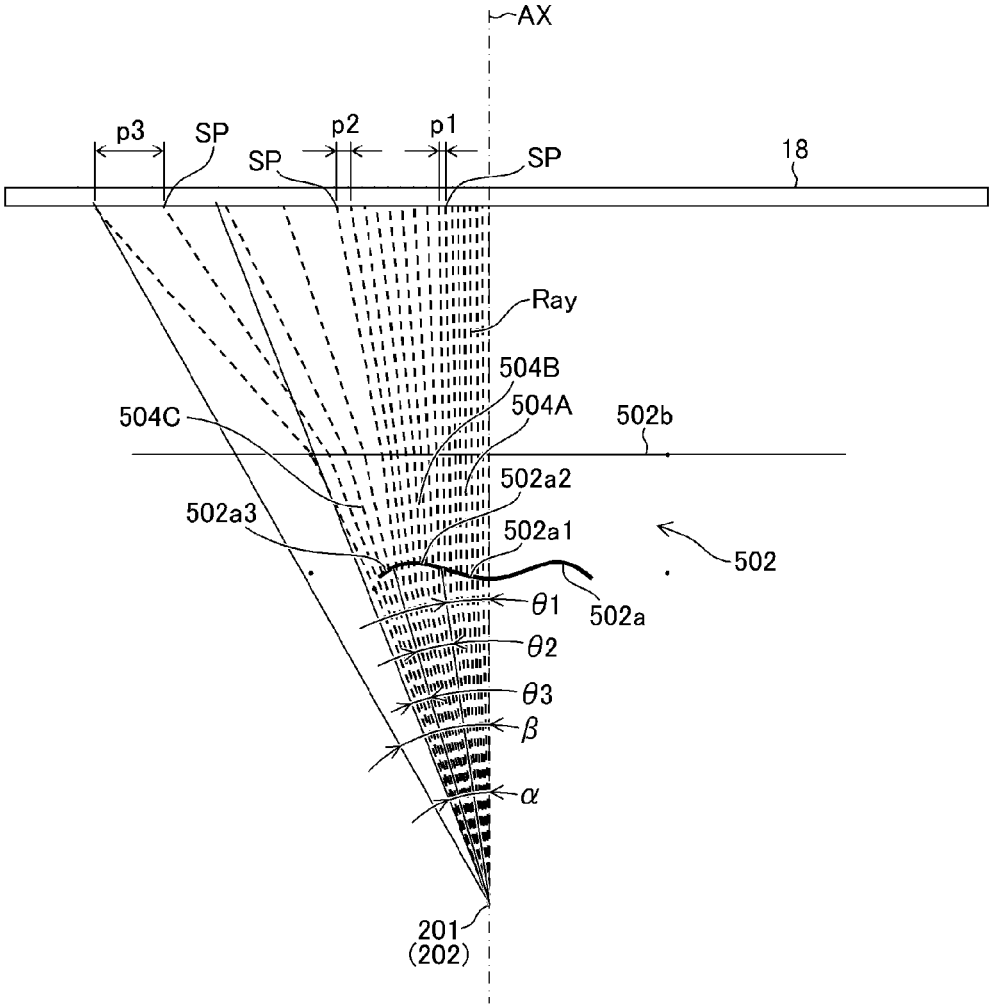
FIG. 48 is a schematic diagram illustrating essential parts of the vehicle lighting fixture 500 including a wavelength conversion member 18 and a multifocal lens 502.

FIG. 48 is a schematic diagram illustrating essential parts of the vehicle lighting fixture 500 including the wavelength conversion member 18 and the multifocal lens 502 illustrated in FIG. 47.

As illustrated in FIG. 48, the optical deflector 201 can be configured to scan excitation light rays Ray in a two dimensional manner by the mirror part 202 in the horizontal and vertical directions (FIG. 48 shows the state in the horizontal direction), so that the excitation light rays Ray passing through the multifocal lens 502 can form a luminance distribution in the wavelength conversion member 18. Specifically, the luminance distribution can be formed with varied resolution, in which the resolution in the horizontal direction is high (fine) at the center area (in the vicinity of the intersection of the wavelength conversion member 18 and the reference axis AX) and is gradually lowered (coarse) toward the outer periphery from the center area (in the right and left directions in FIG. 48). FIG. 48 shows the excitation light rays Ray only on the left side with respect to the reference axis AX for convenience sake, but in actual cases, the excitation light rays Ray can scan bisymmetrically with respect to the reference axis AX.

The luminance distribution formed in the wavelength conversion member 18 can be projected by the projector lens assembly 20 forward in front of the vehicle body, so that the predetermined light distribution pattern can be formed to have a high resolution at the center area in the horizontal direction and gradually lower resolution outward from the center area.

The luminance distribution (predetermined light distribution pattern) with the high center resolution in the horizontal direction and lowered resolution toward the outer periphery from the center area can be achieved by the multifocal lens 502.

Specifically, the vehicle lighting unit 500 can form groups of spots SP of excitation light rays Ray scanning in a two-dimensional manner by the optical deflector 201 on the wavelength conversion member 18. The multifocal lens 502 can be an optical controlling member configured to change a pitch between spots SP in a group of spots SP among the groups of spots SP of light. As illustrated in FIG. 48, the multifocal lens 502 can be a lens member having an incident surface 502*a* on which the scanning excitation light rays Ray are incident to enter the multifocal lens 502 and a light exiting surface 502*b* opposite thereto. The multifocal lens 502 can be molded by a glass material, a transparent resin such as an acrylic resin or a polycarbonate resin, and the like.

The incident surface 502*a* can be composed of, for example, a first incident surface 502*a*1, a second incident surface 502*a*2, and a third incident surface 502*a*3. In this case, the first incident surface 502*a*1 can receive the excitation light rays within a first range (±θ1, for example, ±0° to 8°) of a swing angle of scanning in the horizontal direction by the optical deflector 201. The second incident surface 502*a*2 can receive the excitation light rays within a second range (±θ2, for example, ±8° to 15°) of a swing angle of scanning in the horizontal direction by the optical deflector 201. The third incident surface 502*a*3 can receive the excitation light rays within a third range (±θ3, for example, ±15° to 20°) of a swing angle of scanning in the horizontal direction by the optical deflector 201.

Figure 55:
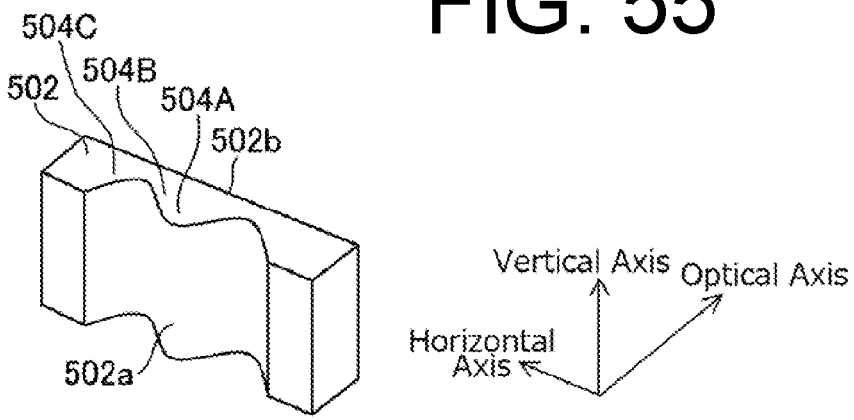
FIG. 55 is a perspective view of a multifocal lens 502.

FIG. 55 is a perspective view of the multifocal lens 502. As illustrated, the multifocal lens 502 can be configured to include a first lens portion 504A between the first incident surface 502*a*1 and the light exiting surface 502*b*, a second lens portion 504B between the second incident surface 502*a*2 and the light exiting surface 502*b*, and a third lens portion 504C between the third incident surface 502*a*3 and the light exiting surface 502*b*.

Figure 49A:
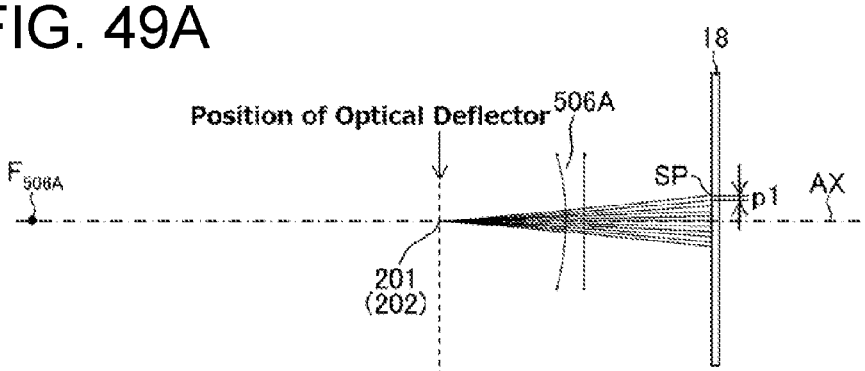
FIG. 49A is a diagram illustrating a state (simulation result) in which excitation light directed from an optical deflector 201 and passing through a single focus lens 506A forms a high-resolution region by a group of spots SP of light in a horizontal direction on the wavelength conversion member 18 at a pitch p1.

FIG. 49A is a diagram illustrating a state (simulation result) in which excitation light rays directed from an optical deflector 201 and passing through a single focus lens 506A (having a focal point $F_{506A}$) forms a high-resolution region by a group of spots SP of light in the horizontal direction on the wavelength conversion member 18 at a pitch p1. Here, suppose that the first lens portion 504A is configured as a single focus lens having the same focal distance as that of the single focus lens 506A (focal distance F=−100 mm, being a concave lens). In this case, the excitation light rays Ray directed from the optical deflector 201 and passing through the first lens portion 504A can form a high-resolution region by a group of spots SP of light in the horizontal direction on the wavelength conversion member 18 at the pitch p1 in the same manner as the excitation light rays directed from the optical deflector 201 and passing through the single focus lens 506A of FIG. 49A. The range (width of the high-resolution region) may be widened as appropriate in order to correspond to the case of swivel operation of the vehicle lighting fixture 500 in addition to normal operations. Note that such a swivel operation is performed when an automobile is turned right or left, so that the vehicle lighting fixture can project light with a high luminance and wide high-resolution pattern controlled with high precision to the right or left road surface and/or pedestrian to be irradiated with light.

Figure 49B:
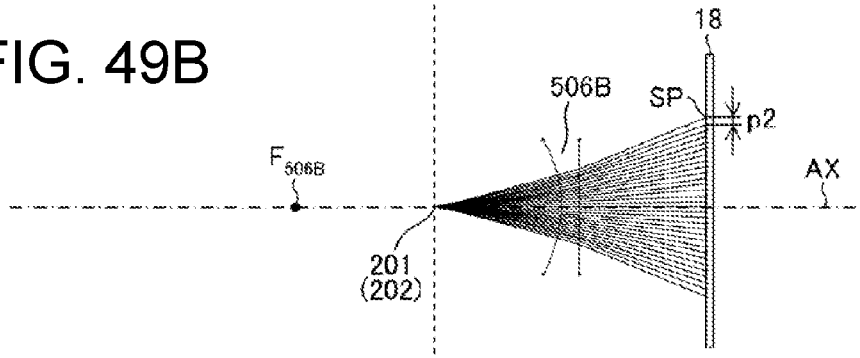
FIG. 49B is a diagram illustrating a state (simulation result) in which excitation light directed from the optical deflector 201 and passing through a single focus lens 506B forms a middle-resolution region by a group of spots SP of light in the horizontal direction on the wavelength conversion member 18 at a pitch p2.

FIG. 49B is a diagram illustrating a state (simulation result) in which excitation light directed from the optical deflector 201 and passing through a single focus lens 506B (having a focal point $F_{506B}$) forms a middle-resolution region by a group of spots SP of light in the horizontal direction on the wavelength conversion member 18 at a pitch p2. Here, suppose that the second lens portion 504B is configured as a single focus lens having the same focal distance as that of the single focus lens 506B (focal distance F=−50 mm, being a concave lens), which is shorter than that of the single focus lens 506A. In this case, the excitation light rays Ray directed from the optical deflector 201 and passing through the second lens portion 504B can form a middle-resolution region by a group of spots SP of light in the horizontal direction on the wavelength conversion member 18 at the pitch p2 (p2>p1) in the same manner as the excitation light rays directed from the optical deflector 201 and passing through the single focus lens 506B of FIG. 49B.

Figure 49C:
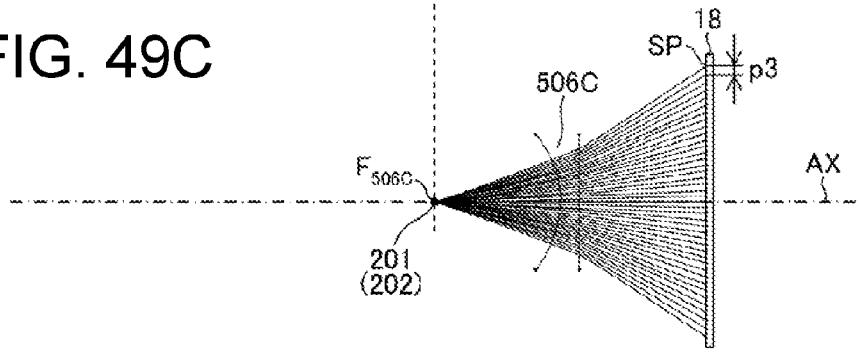
FIG. 49C is a diagram illustrating a state (simulation result) in which excitation light directed from the optical deflector 201 and passing through a single focus lens 506C forms a low-resolution region by a group of spots SP of light in the horizontal direction on the wavelength conversion member 18 at a pitch p3.

FIG. 49C is a diagram illustrating a state (simulation result) in which excitation light directed from the optical deflector 201 and passing through a single focus lens 506C (having a focal point $F_{506C}$) forms a low-resolution region by a group of spots SP of light in the horizontal direction on the wavelength conversion member 18 at a pitch p3. Here, suppose that the third lens portion 504C is configured as a single focus lens having the same focal distance as that of the single focus lens 506C (focal distance F=−25 mm, being a concave lens), which is shorter than that of the single focus lens 506B. In this case, the excitation light rays Ray directed from the optical deflector 201 and passing through the third lens portion 504C can form a low-resolution region by a group of spots SP of light in the horizontal direction on the wavelength conversion member 18 at the pitch p3 (p3>p2) in the same manner as the excitation light rays directed from the optical deflector 201 and passing through the single focus lens 506C of FIG. 49C.

As described above, the multifocal lens 502 can be configured by the first, second, and third lens portions 504A, 504B, and 504C such that the lens portion through which the excitation light rays directed by a larger swing angle in the horizontal direction can pass can have a shorter focal distance (the focal distance of the first lens portion 504A>the focal distance of the second lens portion 504B>the focal distance of the third lens portion 504C). With this configuration, the vehicle lighting fixture 500 can achieve the luminance distribution (predetermined light distribution pattern) with the high resolution at the center area in the horizontal direction and lowered resolution toward the outer periphery from the center area.

The varied resolution being high at the center area and low at the peripheral area can provide the following advantageous effects.

Figure 50A:
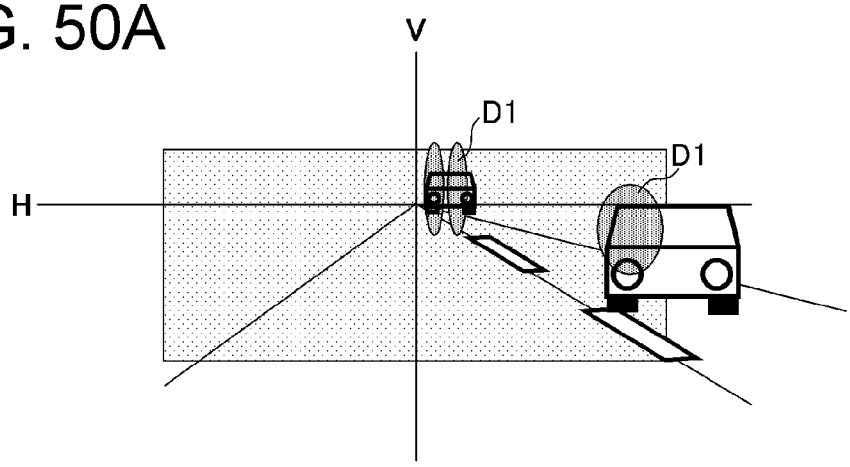
FIG. 50A is a diagram illustrating a predetermined light distribution pattern having a high resolution at a horizontal center and a lower resolution toward the periphery thereof.
Figure 50B:
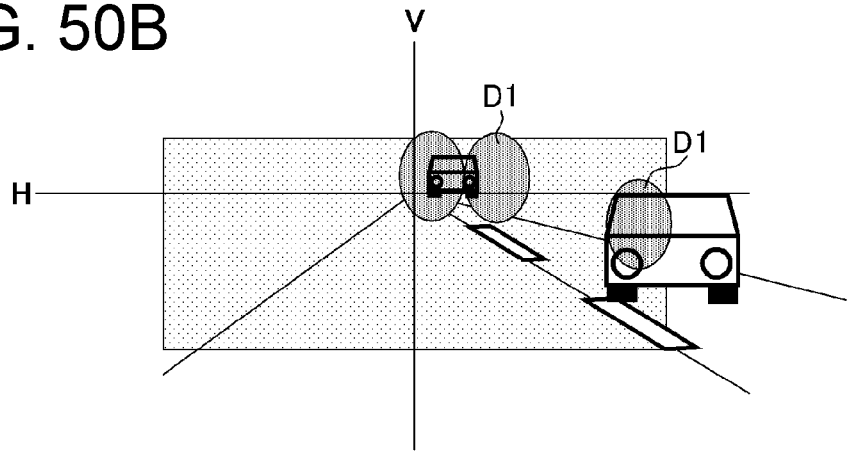
FIG. 50B is a diagram illustrating a predetermined light distribution pattern having a constant, relatively low resolution in the horizontal direction.

When the resolution in the horizontal direction is maintained at a constant and relatively low level as the same level as that shown in FIG. 49C, for example, a non-irradiation region D1 with respect to an irradiation-prohibitive object such as a preceding vehicle or an oncoming vehicle located farther away from the vehicle body with the vehicle lighting fixture as illustrated in FIG. 50B relatively becomes large. Accordingly, the vehicle lighting fixture with this configuration cannot brightly irradiate a wide range with light, resulting in failure of securing favorable field of view.

Figure 50C:
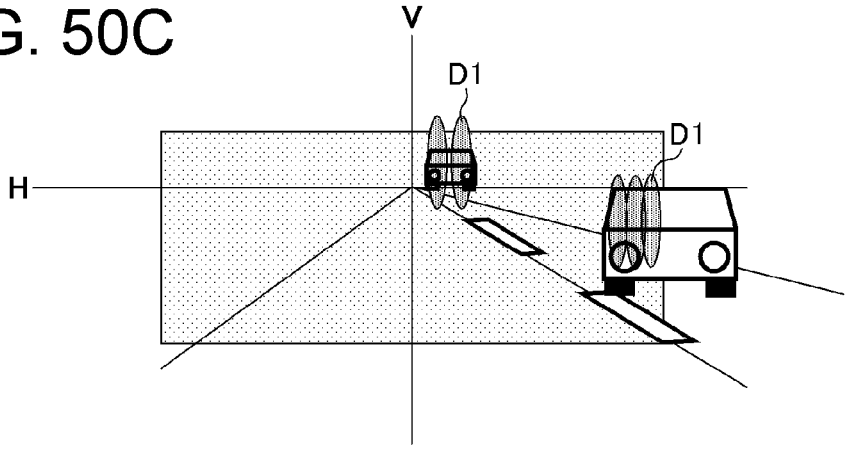
FIG. 50C is a diagram illustrating a predetermined light distribution pattern having a constant, relatively high resolution in the horizontal direction.

On the other hand, when the resolution in the horizontal direction is maintained at a constant and relatively high level as the same level as that shown in FIG. 49A, for example, the non-irradiation region D1 with respect to an irradiation-prohibitive object such as a preceding vehicle or an oncoming vehicle located farther away from the vehicle body with the vehicle lighting fixture as illustrated in FIG. 50C relatively becomes small. Accordingly, the vehicle lighting fixture with this configuration can relatively brightly irradiate a wide range with light, but the swing angle in the horizontal direction by the excitation light rays scanning by the optical deflector 201 should be controlled to be relatively larger, resulting in reducing the reliability of the optical deflector 201.

On the contrary to these cases, when the resolution in the horizontal direction is maintained at a high level at the center area and gradually lowered toward the outer periphery from the center area as shown in FIGS. 48 and 50A, for example, the non-irradiation region D1 with respect to an irradiation-prohibitive object such as a preceding vehicle or an oncoming vehicle located farther away from the vehicle body with the vehicle lighting fixture as illustrated in FIG. 50C relatively becomes small. Accordingly, the vehicle lighting fixture with this configuration can relatively brightly irradiate a wide range with light. In this case, it is not necessary that the swing angle (for example, an angle α in FIG. 48) in the horizontal direction by the excitation light rays scanning by the optical deflector 201 is controlled to be relatively larger, but it is possible to scan the same angle range (for example, an angle β in FIG. 48) as that when the swing angle in the horizontal direction by the excitation light rays scanning by the optical deflector 201 is controlled to be relatively larger. This can be achieved by the action of the multifocal lens 502 that can deflect the excitation light rays from the optical deflector 201 more outward. As a result, it is possible to scan the same angle range (for example, the angle β in FIG. 48) as that when the swing angle in the horizontal direction by the excitation light rays scanning by the optical deflector 201 is controlled to be relatively larger without increasing the swing angle (or the movable range of the mirror part 202 of the optical deflector 201) in the horizontal direction by the excitation light rays scanning by the optical deflector 201. Accordingly, it is possible to prevent the reliability of the optical deflector 201 from decreasing.

The incident surface 502*a* can be configured by a curved surface concave toward the optical deflector 201 in the horizontal direction (in the horizontal cross section) form the viewpoint of suppressing the spherical aberration. The incident surface 502*a* is not curved in the vertical direction (do not show a curved line in the vertical cross section). The light exiting surface 502*b* can be configured by a planar surface perpendicular to the reference axis AX extending in the front-rear direction of the vehicle body.

A description will now be given of an example of a system configuration of the vehicle lighting fixture 500.

Figure 51:
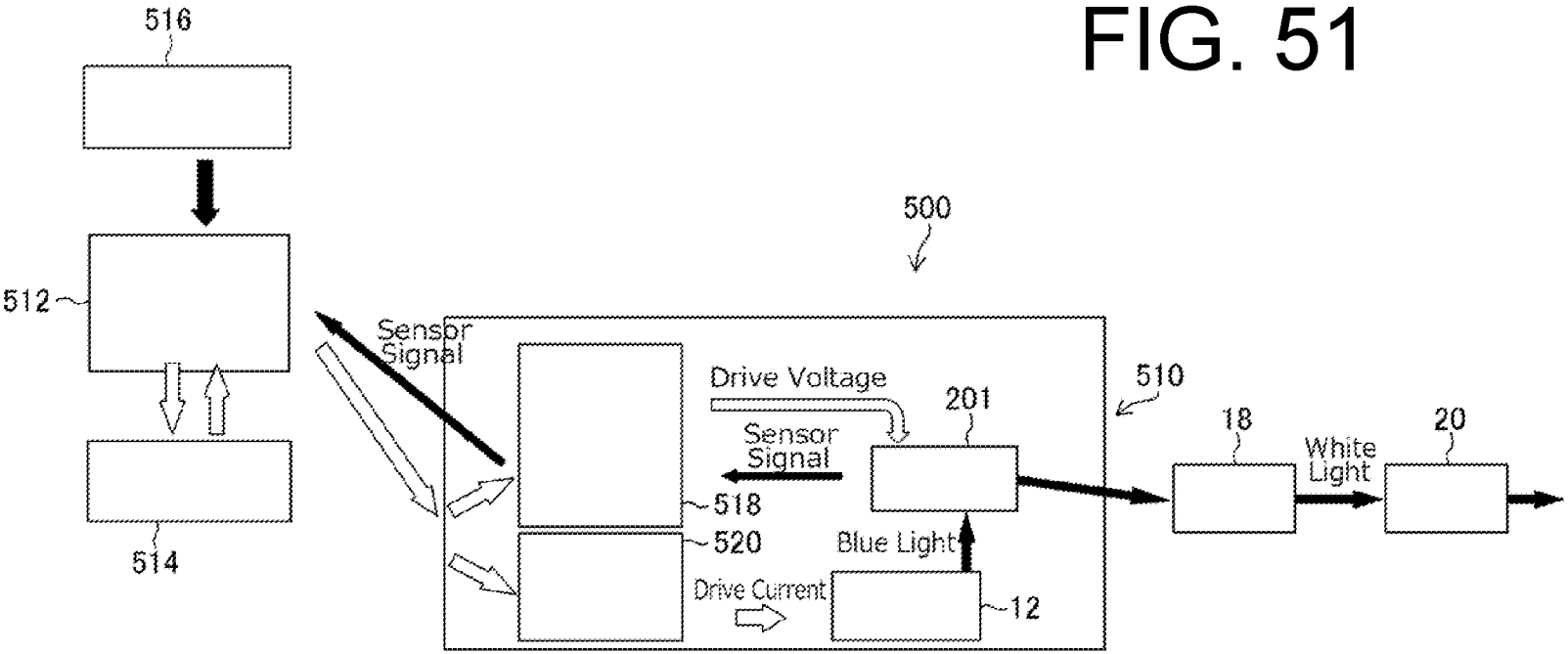
FIG. 51 is a block diagram schematically illustrating the vehicle lighting fixture 500.

FIG. 51 is a block diagram schematically illustrating the system configuration of the vehicle lighting fixture 500.

The vehicle lighting fixture 500 can include an optical unit 510, an imaging engine CPU 512, a storage device 514, the wavelength conversion member 18 (phosphor plate, for example), the projector lens assembly 20, an imaging device 516 such as a CCD as a detection unit configured to detect an irradiation-prohibitive object(s) in front of the vehicle body.

The optical unit 510 can include the excitation light source 12, the optical deflector 201, a deflector driving unit/synchronous signal controlling unit 518, a laser driving unit 520, etc.

The storage device 514 can store basic light distribution data, data relating to voltage-swing angle characteristics (for example, see FIGS. 28A and 28B), data relating to current-luminance characteristics, swing angle data (for example, 40 degrees in the lateral direction and 20 degrees in the vertical direction), etc.

The basic light distribution data stored in the storage device 514 in advance can include a luminance image(s) represented by a plurality of bits for respective pixels (luminance values). For example, the luminance image may be a luminance distribution having a maximum luminance value at or near the center area and lowered luminance values toward respective sides (upper, lower, right, and left sides). The basic light distribution data may be generated by predetermined calculation. For example, the basic light distribution data can be generated by predetermined calculation so as to have a maximum luminance value at a position in accordance with the rotation direction and angle of a steering wheel.

The imaging engine CPU 512 can control the deflector driving unit/synchronous signal controlling unit 518 on the basis of the basic light distribution data (and also swing angle data and data of voltage-swing angle characteristics) so as to adjust a drive voltage and apply the drive voltage to the optical deflector 201. Here, the drive voltage can be controlled such that the vertical and horizontal widths of the luminance distribution d (see FIG. 52) to be formed on the wavelength conversion member 18 coincide with those of the luminance distribution (light intensity distribution) represented by the basic light distribution data (or swing angle data). In this manner, the imaging engine CPU 512 can output a drive signal to the deflector driving unit/synchronous signal controlling unit 518.

Furthermore, the imaging engine CPU 512 can control the laser driving unit 520 on the basis of the basic light distribution data (and also data of current-luminance characteristics) so as to adjust a drive current and apply the drive current to the excitation light source 12. Here, the drive current can be controlled such that the luminance distribution d to be formed on the wavelength conversion member 18 coincides with the luminance distribution (light intensity distribution) represented by the basic light distribution data. In this manner, the imaging engine CPU 512 can output a drive signal to the laser driving unit 520.

The deflector driving unit/synchronous signal controlling unit 518 can apply the drive voltage to the optical deflector 201, where the drive voltage has been controlled such that the vertical and horizontal widths of the luminance distribution d to be formed on the wavelength conversion member 18 coincide with those of the luminance distribution (light intensity distribution) represented by the basic light distribution data (or swing angle data) in accordance with the control (drive signal) from the imaging engine CPU 512. In this manner, for example, the deflector driving unit/synchronous signal controlling unit 518 can apply the drive voltage for resonantly driving or for nonresonantly driving (for example, see FIG. 12).

The laser driving unit 520 can apply the drive current that has been controlled such that the luminance distribution d to be formed on the wavelength conversion member 18 coincides with the luminance distribution represented by the basic light distribution data in accordance with the control (drive signal) from the imaging engine CPU 512. In this manner, for example, the laser driving unit 520 can apply the drive current to the excitation light source 12.

A brief description will now be given of an operation example of the vehicle lighting fixture 500 with the above-described configuration.

The following processing can be achieved by causing the imaging engine CPU 512 to read a predetermined program from the storage device 514 into a not-illustrated RAM and execute the program.

First, a not-illustrated headlamp turn-on switch is turned on to read basic light distribution data from the storage device 514. Here, the basic light distribution data may be generated through a predetermined calculation.

Figure 53:
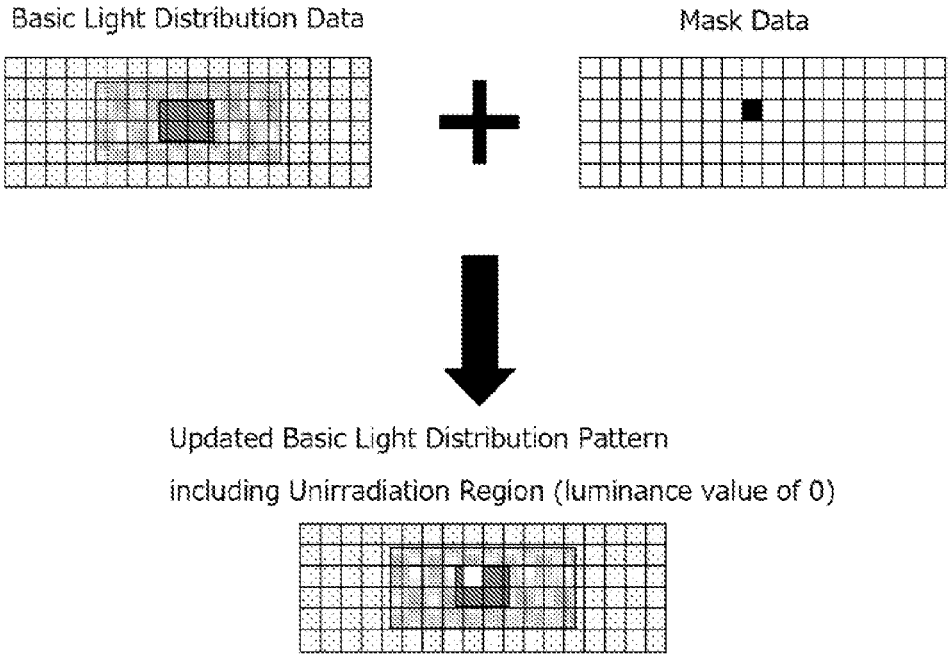
FIG. 53 is a diagram illustrating an example in which basic light distribution data and mask data are used to generate a basic light distribution pattern including an unirradiation region.

Next, the imaging device 516 such as a CCD, which is electrically connected to the imaging engine CPU 512, can capture an image in front of the vehicle body including a preceding vehicle(s), an oncoming vehicle(s), a pedestrian(s), etc., which are irradiation-prohibitive objects. On the basis of the data of the image, if the image includes any of such an oncoming vehicle(s), a pedestrian(s), etc., updated basic light distribution data can be generated to include an unirradiation region(s) where the irradiation-prohibitive objects are present and thus the luminance value thereof is 0 (zero). This updated basic light distribution data can be generated by performing a predetermined calculation using the read-out basic light distribution data and mask data as illustrated in FIG. 53.

Next, the data of voltage-swing angle characteristics can be read out from the storage device 514. If the voltage-swing angle characteristics are varied with time, the data thereof may be appropriately updated.

Then, the imaging engine CPU 512 can control the excitation light source 12 and the optical deflector 201 to form the luminance distribution d (see FIG. 52) including the non-irradiation region D1 on the wavelength conversion member 18.

Specifically, the imaging engine CPU 512 can control the deflector driving unit/synchronous signal controlling unit 518 on the basis of the basic light distribution data (and also swing angle data and data of voltage-swing angle characteristics) so as to adjust a drive voltage and apply the drive voltage to the optical deflector 201. Here, the drive voltage can be controlled such that the vertical and horizontal widths of the luminance distribution d to be formed on the wavelength conversion member 18 coincide with those of the luminance distribution (light intensity distribution) represented by the basic light distribution data (or swing angle data). In this manner, the imaging engine CPU 512 can output a drive signal to the deflector driving unit/synchronous signal controlling unit 518.

In addition thereto, the imaging engine CPU 512 can control the laser driving unit 520 on the basis of the basic light distribution data (and also data of current-luminance characteristics) so as to adjust a drive current and apply the drive current to the excitation light source 12. Here, the drive current can be controlled such that the luminance distribution d (including the unirradiation region d1) to be formed on the wavelength conversion member 18 coincides with the luminance distribution (including the unirradiation region) represented by the basic light distribution data. In this manner, the imaging engine CPU 512 can output a drive signal to the laser driving unit 520.

Then, the deflector driving unit/synchronous signal controlling unit 518 can apply the drive voltage the optical deflector 201, where the drive voltage has been controlled such that the vertical and horizontal widths of the luminance distribution d to be formed on the wavelength conversion member 18 coincide with those of the luminance distribution represented by the basic light distribution data (or swing angle data) in accordance with the control (drive signal) from the imaging engine CPU 512. In this manner, for example, the deflector driving unit/synchronous signal controlling unit 518 can apply the drive voltage for resonantly driving or for nonresonantly driving (for example, see FIG. 12).

In synchronization with the above-mentioned process, the laser driving unit 520 can apply the drive current that has been controlled such that the luminance distribution d (including the unirradiation region d1) to be formed on the wavelength conversion member 18 coincides with the luminance distribution (including the unirradiation region) represented by the basic light distribution data in accordance with the control (drive signal) from the imaging engine CPU 512. In this manner, for example, the laser driving unit 520 can apply the drive current to the excitation light source 12.

Figure 52:
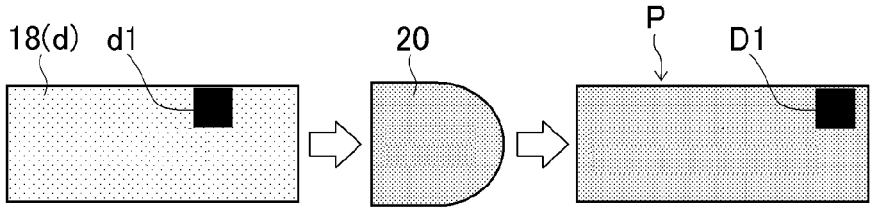
FIG. 52 is a schematic diagram showing the relationship among the wavelength conversion member 18 (luminous distribution d), the projector lens 20, and the predetermined light distribution pattern P.

As described above, the excitation light source 12 and the optical deflector 201 can be controlled in synchronization with each other to two-dimensionally scan with the excitation light rays by the mirror part 202 of the optical deflector 201 in the horizontal and vertical directions. In this manner, the luminance distribution d including the unirradiation region d1 can be formed on the wavelength conversion member 18 as illustrated in FIG. 52. Thus, the imaging engine CPU 512 can function as a controller configured to control the lighting state of the excitation light source 12 so as to form the unirradiation region d1 corresponding to the irradiation-prohibitive object(s) such as an oncoming vehicle detected by the imaging device 516 serving as a detector, in the luminance distribution d.

In this case, since the excitation light rays two-dimensionally scanning in the horizontal and vertical directions by the optical deflector 201 can pass through the multifocal lens 502, the luminance distribution d including the unirradiation region d1 formed in the wavelength conversion member 18 can be formed with resolutions different in part, for example, in which the resolution in the horizontal direction is high at the center area and is gradually lowered toward the outer periphery from the center area.

This luminance distribution d including the unirradiation region d1 formed in the wavelength conversion member 18 can be projected forward by the projector lens assembly 20 so as to form the predetermined light distribution pattern P (including the unirradiation region D1, as illustrated in FIGS. 50A and 52) on a virtual vertical screen with resolutions different in part, for example, in which the resolution in the horizontal direction is high at the center area and is gradually lowered toward the outer periphery from the center area.

As described above, according to this exemplary embodiment, the excitation light source 12 and the optical deflector 201 can be controlled in synchronization with each other to two-dimensionally scan with the excitation light rays by the mirror part 202 of the optical deflector 201. In this manner, the luminance distribution d including the unirradiation region d1 can be formed on the wavelength conversion member 18 and projected forward by the projector lens assembly 20 so as to form the predetermined light distribution pattern P corresponding to the luminance distribution d. Thus the vehicle lighting fixture 500 with this configuration can form the luminance distribution and the predetermined light distribution pattern with resolutions different in part, for example, in which the resolution in the horizontal direction is high at the center area and is gradually lowered toward the outer periphery from the center area.

This can be achieved by providing the vehicle lighting fixture 500 with the multifocal lens 502 configured to change a pitch between spots in a group of spots SP among the groups of spots of light on the wavelength conversion member 18 wherein the optical deflector 201 can two-dimensionally scan with the excitation light rays.

Furthermore, according to this exemplary embodiment, the excitation light rays two-dimensionally scanning by the mirror part 202 of the optical deflector 201 can form the luminance distribution d including the unirradiation region d1 on the wavelength conversion member 18, which is further projected forward by the projector lens assembly 20 so as to form the predetermined light distribution pattern corresponding to the luminance distribution d. Thus the vehicle lighting fixture 500 with this configuration can form the luminance distribution and the predetermined light distribution pattern with resolutions different in part, for example, in which the resolution in the horizontal direction is high at the center area and is gradually lowered toward the outer periphery from the center area. This can be achieved by the provision of the multifocal lens 502 that is configured by the first, second, and third lens portions 504A, 504B, and 504C such that the lens portion through which the excitation light rays directed by a larger swing angle in the horizontal direction can pass can have a shorter focal distance (the focal distance of the first lens portion 504A>the focal distance of the second lens portion 504B>the focal distance of the third lens portion 504C).

According to this exemplary embodiment, it is possible to scan the same angle range (for example, the angle β in FIG. 48) as that when the swing angle in the horizontal direction by the excitation light rays scanning by the optical deflector 201 is controlled to be relatively larger without increasing the swing angle (for example, the angle α in FIG. 48) in the horizontal direction by the excitation light rays scanning by the optical deflector 201. This can be achieved by the action of the multifocal lens 502 that can deflect the excitation light rays from the optical deflector 201 more outward. As a result, it is possible to scan the same angle range (for example, the angle β in FIG. 48) as that when the swing angle in the horizontal direction by the excitation light rays scanning by the optical deflector 201 is controlled to be relatively larger without increasing the swing angle (or the movable range of the mirror part 202 of the optical deflector 201) in the horizontal direction by the excitation light rays scanning by the optical deflector 201. Accordingly, it is possible to prevent the reliability of the optical deflector 201 from decreasing.

Next, modified examples will be described.

In the previous exemplary embodiment, the vehicle lighting fixture 500 can be configured to form the luminance distribution and the predetermined light distribution pattern with resolutions different in part, for example, in which the resolution in the horizontal direction is high at the center area and is gradually lowered toward the outer periphery from the center area. When the multifocal lens can be configured such that the lens portion through which the excitation light rays directed by a larger swing angle in the vertical direction (and also in the horizontal direction) can pass can have a shorter focal distance. In this case, the vehicle lighting fixture 500 can be configured to form the luminance distribution and the predetermined light distribution pattern with resolutions different in part, for example, in which the resolution in the vertical direction is high at the center area and is gradually lowered toward the outer periphery from the center area in the vertical direction. Thus, the resolutions in the vertical direction can also be controlled. In this case, the region where the resolution is high can be relatively wider in order to cope with the case of levelling of the vehicle lighting fixture 500.

The number of the lens portions provided to the multifocal lens 502 can be changed to 2 or 4 or more although the three lens portions 504A to 504C are described in the previous exemplary embodiment. Also in this case, the lens portion through which the excitation light rays directed by a larger swing angle in the horizontal direction can pass can have a shorter focal distance to achieve the formation of the luminance distribution and the predetermined light distribution pattern with resolutions different in part, for example, in which the resolution in the horizontal direction is high at the center area and is gradually lowered toward the outer periphery from the center area.

The vehicle lighting fixture 500 according to the previous exemplary embodiment can have the multifocal lens 502 with the incident surface 502*a* thereof being a curved surface concave toward the optical deflector. However, the shape of the incident surface 502*a* may be a curved surface convex toward the optical deflector 201 or a planar surface shape.

The vehicle lighting fixture 500 according to the previous exemplary embodiment can have the multifocal lens 502 with the light exiting surface 502*b* thereof being a planar surface perpendicular to the reference axis AX extending in the front-rear direction of the vehicle body. However, the light exiting surface 502*b* may be a curved surface.

Figure 54:
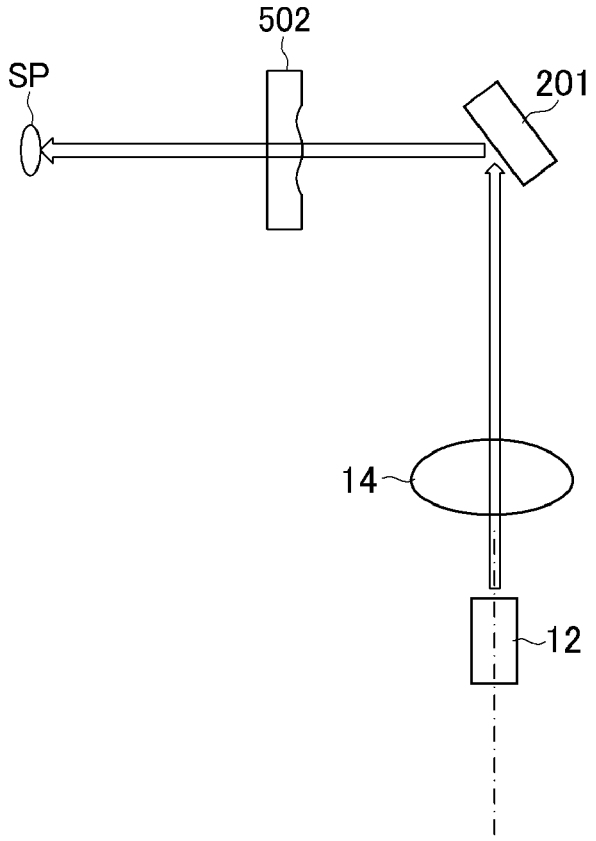
FIG. 54 is a diagram illustrating a modified example of the vehicle lighting fixture 500.

In the previous exemplary embodiment, the vehicle lighting fixture 500 can be configured to include the wavelength conversion member 18 and the projector lens assembly 20. In a modified example thereof, as illustrated in FIG. 54, the wavelength conversion member 18 and the projector lens assembly 20 may be omitted. Even in this modified example, the predetermined light distribution pattern with resolutions different in part, for example, in which the resolution in the horizontal direction is high at the center area and is gradually lowered toward the outer periphery from the center area can be formed.

Furthermore, the multifocal lens 502 of the previous exemplary embodiment may be replaced with an optical controlling mirror having the same or similar function as or to that of the multifocal lens 502.

Figure 56:
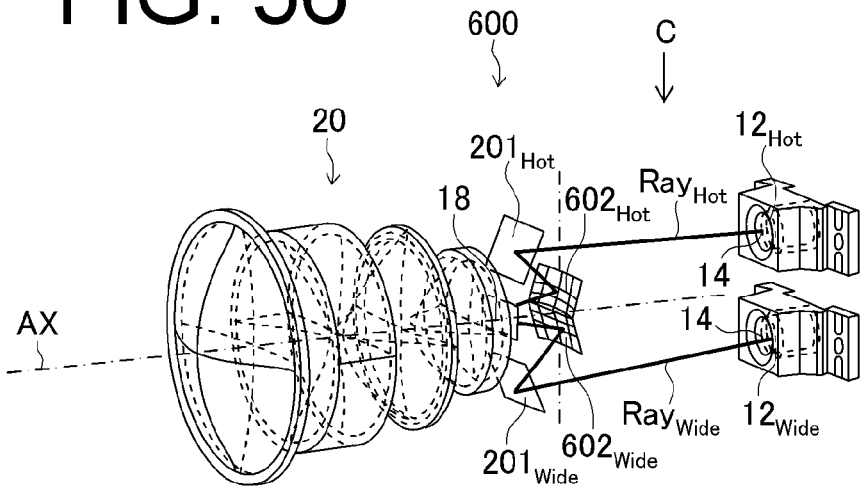
FIG. 56 is a perspective view of a vehicle lighting fixture 600.

As another exemplary embodiment, a description will now be given of a variable light-distribution vehicle lighting fixture 600 (variable light-distribution headlamp) using an optical controlling mirror, as illustrated in FIG. 56.

As shown in the drawing, the vehicle lighting fixture 600 of the present exemplary embodiment can be configured to be different from the vehicle lighting fixture 500 of the previous exemplary embodiment in which optical controlling mirror $\mathbf{602}_{Wide}$ and $\mathbf{602}_{Hot}$ are used in place of the multifocal lens 502 to form the predetermined light distribution pattern with resolutions different in part, for example, in which the resolution in the horizontal direction is high at the center area and is gradually lowered toward the outer periphery from the center area.

Hereinafter, a different point of the present exemplary embodiment will be described and the same or similar components as or to those of the vehicle lighting fixture 500 will be omitted here while the same reference numerals are assigned thereto.

The basic configuration of the vehicle lighting fixture 600 according to this exemplary embodiment can be the same as or similar to the configuration of the vehicle lighting fixture 500 according to the previous exemplary embodiment. As shown in FIG. 56, the vehicle lighting fixture 600 can include two excitation light sources $\mathbf{12}_{Hot}$ and $\mathbf{12}_{Wide}$; two optical deflectors $\mathbf{201}_{Hot}$ and $\mathbf{201}_{Wide}$ each including a mirror part 202 and provided corresponding to the two excitation light sources $\mathbf{12}_{Hot}$ and $\mathbf{12}_{Wide}$, respectively; two optical controlling mirrors $\mathbf{602}_{Hot}$ and $\mathbf{602}_{Wide}$ provided corresponding to the two optical deflectors $\mathbf{201}_{Hot}$ and $\mathbf{201}_{Wide}$, respectively; a wavelength conversion member 18; a projector lens assembly 20; etc. In the wavelength conversion member 18, a luminance distribution can be formed by excitation light rays reflected by the optical controlling mirrors $\mathbf{602}_{Hot}$ and $\mathbf{602}_{Wide}$. The luminance distribution formed in the wavelength conversion member 18 can be projected forward of a vehicle body by the projector lens assembly 20 as an optical system configured to form the predetermined light distribution pattern. The number of the excitation light sources 12, the optical deflectors 201, and the optical controlling mirrors is not limited to 2 (two), but may be 1 (one) or 3 (three) or more.

As illustrated, the projector lens assembly 20, the wavelength conversion member 18, the optical deflectors $\mathbf{201}_{Hot}$ and $\mathbf{201}_{Wide}$, the optical controlling mirrors $\mathbf{602}_{Hot}$ and $\mathbf{602}_{Wide}$, and the excitation light sources $\mathbf{12}_{Hot}$ and $\mathbf{12}_{Wide}$ can be disposed in this order along a reference axis AX (or referred to as an optical axis). These members can be disposed and secured to a predetermined holder member (not illustrated) as in the aforementioned reference examples and exemplary embodiment(s). With this configuration, the common holding member holding the respective components together with the excitation light sources $\mathbf{12}_{Hot}$ and $\mathbf{12}_{Wide}$ can reduce the parts number and the assembling error.

The excitation light sources $\mathbf{12}_{Hot}$ and $\mathbf{12}_{Wide}$ can be disposed to surround the reference axis AX with a posture positioned in such a manner that excitation light rays $\mathrm{Ray}_{Hot}$ and $\mathrm{Ray}_{Wide}$ are directed forward.

The excitation light rays $\mathrm{Ray}_{Hot}$ and $\mathrm{Ray}_{Wide}$ from the excitation light sources $\mathbf{12}_{Hot}$ and $\mathbf{12}_{Wide}$ can be condensed (or, for example, collimated) by respective condenser lenses 14 disposed in front of the respective excitation light sources $\mathbf{12}_{Hot}$ and $\mathbf{12}_{Wide}$ and then be incident on the respective mirror parts 202 of the optical deflectors $\mathbf{201}_{Hot}$ and $\mathbf{201}_{Wide}$.

The optical deflectors $\mathbf{201}_{Hot}$ and $\mathbf{201}_{Wide}$ can be disposed to surround the reference axis AX with a posture tilted in such a manner that the excitation light rays emitted from the excitation light sources $\mathbf{12}_{Hot}$ and $\mathbf{12}_{Wide}$ and incident on the mirror parts 202 thereof can be reflected by the same and directed rearward and toward the reference axis AX.

Furthermore, the optical controlling mirrors $\mathbf{602}_{Hot}$ and $\mathbf{602}_{Wide}$ can be disposed to surround the reference axis AX and be closer to the reference axis AX than the optical deflectors $\mathbf{201}_{Hot}$ and $\mathbf{201}_{Wide}$. Specifically, the optical controlling mirrors $\mathbf{602}_{Hot}$ and $\mathbf{602}_{Wide}$ can be disposed with a posture tilted to be closer to the reference axis AX and also the excitation light rays reflected by the corresponding mirror parts 202 of the optical deflectors $\mathbf{201}_{Hot}$ and $\mathbf{201}_{Wide}$ can be incident on the corresponding optical controlling mirrors $\mathbf{602}_{Hot}$ and $\mathbf{602}_{Wide}$, and reflected by the same to be directed to the wavelength conversion member 18.

As described above, the optical controlling mirrors $602_{Hot}$ and $602_{Wide}$ can be disposed behind the respective optical deflectors $201_{Hot}$ and $201_{Wide}$ so as to irradiate the wavelength conversion member 18, which is disposed forward of these members, with the excitation light rays. This configuration can prevent the size of the vehicle lighting fixture 600 even with the optical controlling mirrors $602_{Hot}$ and $602_{Wide}$ in the front-rear direction from increasing.

The optical deflectors $201_{Hot}$ and $201_{Wide}$ each can be arranged so that the first axis X1 is contained in a vertical plane containing the reference axis AX and the second axis X2 is contained in a horizontal plane (see FIG. 4). The resulting arrangement of the optical deflectors $201_{Hot}$ and $201_{Wide}$ can facilitate the formation (drawing) of a predetermined light distribution pattern (two-dimensional image corresponding to the required predetermined light distribution pattern) being wide in the horizontal direction and narrow in the vertical direction required for a vehicular headlight.

The wide-zone optical deflector $201_{Wide}$ can draw a first two-dimensional image on the wavelength conversion member 18 with the excitation light rays $Ray_{Wide}$ two-dimensionally scanning in the horizontal and vertical directions by the mirror part 202 thereof. In this manner, a first light intensity distribution (luminance distribution) can be formed on the wavelength conversion member 18.

The hot-zone optical deflector $201_{Hot}$ can form a second two-dimensional image on the wavelength conversion member 18 with the excitation light rays $Ray_{Hot}$ two-dimensionally scanning in the horizontal and vertical directions by the mirror part 202 thereof in such a manner that the second two-dimensional image overlaps the first two-dimensional image in part, to thereby form a second light intensity distribution (luminance distribution) with a higher luminance than the first light intensity distribution on the wavelength conversion member 18.

Here, the optical controlling mirrors $602_{Hot}$ and $602_{Wide}$ can be a reflecting surface made of aluminum or the like metal deposition.

Here, the size of the optical controlling mirrors $602_{Hot}$ and $602_{Wide}$ can be reduced more as the distance thereof from the optical deflectors $201_{Hot}$ and $201_{Wide}$ is smaller. Therefore, it is desirable to dispose the optical controlling mirrors $602_{Hot}$ and $602_{Wide}$ in the vicinity of the optical deflectors $201_{Hot}$ and $201_{Wide}$.

Figure 57A:
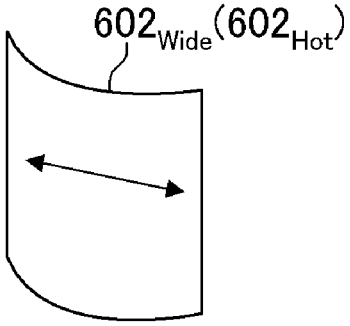
FIGS. 57A and 57B are each a perspective view of each of optical controlling mirrors $\mathbf{602}_{Wide}$ and $\mathbf{602}_{Hot}$.
Figure 57B:
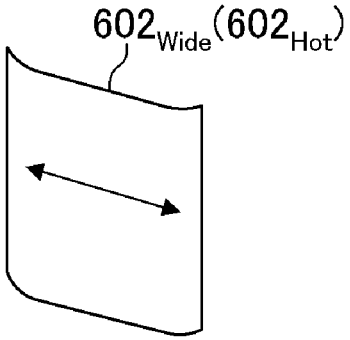

FIGS. 57A and 57B are each a perspective view of each of the optical controlling mirrors $602_{Wide}$ and $602_{Hot}$.

The optical controlling mirrors $602_{Wide}$ and $602_{Hot}$ can be an optical controlling member configured to change a pitch between spots SP in a group of spots SP among the groups of spots SP of light on the wavelength conversion member 18 two-dimensionally scanned with the excitation light rays by the optical deflectors 201. As illustrated in FIGS. 57A and 57B, each of the optical controlling mirrors $602_{Wide}$ and $602_{Hot}$ can be formed as a reflecting surface in which the center portion thereof can be made flat and both end portions can be curved with respect to the horizontal direction (horizontal cross section as indicated by an arrow in each of the drawings), for example, be convex toward the wavelength conversion member 18. Further, each of the optical controlling mirrors $602_{Wide}$ and $602_{Hot}$ is not configured to include a curved cross section in the vertical direction in the illustrated embodiment.

The surface shape of each of the optical controlling mirrors $602_{Wide}$ and $602_{Hot}$ can be adjusted to achieve the formation of the luminance distribution and the predetermined light distribution pattern with resolutions different in part, for example, in which the resolution in the horizontal direction is high at the center area and is gradually lowered toward the outer periphery from the center area as in the previous exemplary embodiment. It is desired that the optical controlling mirrors $602_{Wide}$ and $602_{Hot}$ should be subjected to surface treatment such as aluminum deposition or increased reflection coating (such as a multilayered coating of $SiO_2$ and $TiO_2$) in order to reduce the optical loss by reflection.

Note that if the optical controlling mirrors $602_{Wide}$ and $602_{Hot}$ can be flat at a center portion and curved surfaces at both end portions in the vertical direction (convex toward the wavelength conversion member 18, for example), the vehicle lighting fixture with this configuration can form a luminance distribution and a predetermined light distribution pattern with resolutions different in part in the vertical direction, for example, in which the resolution in the vertical direction is high at the center area and is gradually lowered toward the outer periphery from the center area in the vertical direction.

As described above, the provision of the optical controlling member such as a multifocal lens configured to change a pitch between spots in a group of spots among groups of spots of light that two-dimensionally scans can achieve the formation of a predetermined light distribution pattern with resolutions different in part, for example, in which the resolution in the horizontal direction is high at the center area and is gradually lowered toward the outer periphery from the center area. This essential configuration can be adopted by any types of vehicle lighting fixtures configured to form a predetermined light distribution pattern with light rays two-dimensionally scanning. Examples of the vehicle lighting fixtures may include those of the first to sixth reference examples and those described in Japanese Patent Application Laid-Open No. 2011-222238.

In the above-described exemplary embodiments and reference examples, the luminance distribution formed on the wavelength conversion member 18 (screen member) by the excitation thereof by the excitation light rays from the excitation light source 12 is a white image (white light or pseudo white light). However, the excitation light source 12 can be replaced with a white light source such as a white laser light source. In this case, the white laser light source can be composed of RGB laser light sources RGB light rays of which are combined by introducing them to a single optical fiber. In another modified example, the light source can be configured to include a blue LD element and a yellow wavelength conversion member such as a YAG phosphor used in combination.

When a white light source is used in place of the excitation light source 12, there is no need to wavelength convert the light. Thus, a diffusion member can be used in place of the wavelength conversion member 18. In this case, the white laser light rays emitted from the white laser light source and two-dimensionally scanning by the optical deflector 201 can form a white image (luminance distribution) on the diffusion member (corresponding to the screen member in the presently disclosed subject matter) corresponding to a predetermined light distribution pattern.

The material for the diffusion member may be any material as long as the diffusion member can diffuse the laser light rays like the wavelength conversion member 18 and can be formed in the same shape as or similar to the shape of the wavelength conversion member 18. Examples of the material for the diffusion member may include a composite material (sintered body) containing YAG (for example, 25%) and alumina ($Al_2O_3$, for example, 75%) without any dopant such as Ce, a composite material containing YAG and glass, a material of alumina in which air bubbles are dispersed, and a glass material in which air bubbles are dispersed.

Also the combination of the white light source and the diffusion member in place of the excitation light source and the wavelength conversion member can be applied to any of the above-described exemplary embodiments and reference examples, to thereby form a luminance distribution on the diffusion member being the screen member. As a result, the same advantageous effects can be provided.

Furthermore, the numerical values shown in the exemplary embodiments, modified examples, examples, and reference examples are illustrative, and therefore, any suitable numerical value can be adopted for the purpose of the achievement of the vehicle lighting fixture in the presently disclosed subject matter.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting fixture comprising:

a light source;

an optical deflector configured to two-dimensionally scan with groups of spots of light having been incident thereon from the light source;

a screen member in which the light scanning by the optical deflector forms a luminance distribution corresponding to a predetermined light distribution pattern;

an optical system configured to project the luminance distribution formed in the screen member forward of a vehicle body; and an optical controlling member configured to change a pitch between spots in a group of spots among the groups of spots of light scanning by the optical deflector on the screen member, wherein the optical controlling member is a multifocal lens disposed between the optical deflector and the screen member and configured to allow the light scanning by the optical deflector to pass therethrough, the screen member is configured to form the luminance distribution with the light scanning with the optical deflector and passing through the multifocal lens, and the multifocal lens is configured to have lens portions having respective focal distances such that the focal distance is shorter at a lens portion of the multifocal lens where the light with a larger deflection angle passes.

2. The vehicle lighting fixture according to claim 1, wherein the optical controlling member changes the pitch between spots on the screen member such that the pitch on the screen member becomes large as the light scanning in a two-dimensional manner is directed by a larger deflection angle.

3. The vehicle lighting fixture according to claim 2, wherein the multifocal lens is configured to have the lens portions having the respective focal distances such that the focal distance is shorter at a lens portion of the multifocal lens where the light with a larger deflection angle in a horizontal direction passes.

4. The vehicle lighting fixture according to claim 2, wherein the multifocal lens is configured to have the lens portions having the respective focal distances such that the focal distance is shorter at a lens portion of the multifocal lens where the light with a larger deflection angle in a vertical direction passes.

5. The vehicle lighting fixture according to claim 3, wherein the multifocal lens is configured to have the lens portions having the respective focal distances such that the focal distance is shorter at a lens portion of the multifocal lens where the light with a larger deflection angle in a vertical direction passes.

6. The vehicle lighting fixture according to claim 1, wherein the multifocal lens is configured to have the lens portions having the respective focal distances such that the focal distance is shorter at a lens portion of the multifocal lens where the light with a larger deflection angle in a horizontal direction passes.

7. The vehicle lighting fixture according to claim 6, wherein the multifocal lens is configured to have the lens portions having the respective focal distances such that the focal distance is shorter at a lens portion of the multifocal lens where the light with a larger deflection angle in a vertical direction passes.

8. The vehicle lighting fixture according to claim 1, wherein the multifocal lens is configured to have the lens portions having the respective focal distances such that the focal distance is shorter at a lens portion of the multifocal lens where the light with a larger deflection angle in a vertical direction passes.

9. A vehicle headlamp comprising:

a light source;

an optical deflector configured to two-dimensionally scan with groups of spots of light having been incident thereon from the light source;

a screen member in which the light scanning by the optical deflector forms a luminance distribution corresponding to a predetermined light distribution pattern;

an optical system configured to project the luminance distribution formed in the screen member forward of a vehicle body; and an optical controlling member configured to change a pitch between spots in a group of spots among the groups of spots of light scanning by the optical deflector on the screen member, wherein the optical controlling member changes the pitch between spots on the screen member such that the pitch on the screen member becomes large as the light scanning in a two-dimensional manner is directed by a larger deflection angle, the optical deflector configured to two-dimensionally scan is resonantly driven in at least one direction, the optical controlling member is an optical member configured to receive light which has been two-dimensionally scanned, and a direction in which the pitch between the spots in the group of spots is changed by the optical controlling member is the at least one direction in which the optical deflector is resonantly driven.

* * * * *